United States Patent [19]

Donohue et al.

[11] 4,054,380

[45] Oct. 18, 1977

[54] CONTROL SYSTEM FOR HIGH SPEED COPIER/DUPLICATORS

[75] Inventors: James M. Donohue, Rochester; Ronald J. Carter, Webster; Kenton W. Fiske, Fairport; Daniel L. Mueller, Fairport; Donald S. Post, Fairport; Edward G. Reehil, Henrietta; Edward L. Steiner, Macedon, all of N.Y.

[73] Assignee: Xerox Corporation, Stamford, Conn.

[21] Appl. No.: 445,014

[22] Filed: Feb. 22, 1974

[51] Int. Cl.[2] ..... G03G 15/00

[52] U.S. Cl. ..... 355/14; 355/3 R

[58] Field of Search ..... 355/3 R, 14, 16

[56] References Cited

U.S. PATENT DOCUMENTS

| | | | |
|---|---|---|---|
| 3,512,885 | 5/1970 | Osborne et al. | 355/14 |
| 3,698,805 | 10/1972 | Hickey et al. | 355/14 |
| 3,709,485 | 1/1973 | Aquaviva, Jr. | 355/14 X |
| 3,746,443 | 7/1973 | Hickey | 355/14 |
| 3,806,242 | 4/1974 | Reehil | 355/14 |
| 3,813,157 | 5/1974 | Fantozzi | 355/14 |
| 3,819,266 | 6/1974 | Price | 355/14 |
| 3,830,590 | 8/1974 | Harris et al. | 355/14 |

*Primary Examiner*—Russell E. Adams

[57] ABSTRACT

A processing system having central control including an automated condition responsive system for automatically sequencing and integrating the operation of selected external features utilizable in conjunction with an electrostatographic reproducing process. The processing operation is monitored by means of a central timing control initiated in accordance with a preprogrammed sequence for each of the peripheral operations to be performed in conjunction with the central processing sequence. Sequence control is provided for controlling the sequencing of the peripheral operation in accordance with the timing cycles controlling the central reproducing process. More specifically, control means are set up for automatic document handling, sorting, billing, and jam and recovery control. By utilization of central command logic and separate processing logic, integration of all these operations in accordance with externally controlled program operation is achieved.

30 Claims, 21 Drawing Figures

MACHINE PULSE
500
CL
502
DECODE MATRIX R
504
506
a
b
c
d
e
PITCH
508
206
510
FUSER OIL
450
Q7
X. P. S.
462
FLASH TRIGGER
464
538
536
FLASH SHIFT
456
FLASHING
SELECT (98%)
512
Q25
Q18
Q17
Q5
Q4
Q3
Q2
Q1
512a
512b
512c
512d
CYCLE UP DELAY
S
R
520
524
522
518
514
516
532
676
678
ADH MANUAL MODE
ILL. P. S.
463
PRINT
INITIALIZE
JAM
PRINT MODE
ADH INPUT READY FOR FLASH
EARLY CYCLE OUT
FUNCTION SELECT INHIBIT
PROCESSOR JAM
Q18-25
Q12-17
Q5-11
660
662
664
665
666
670
672
674
680
682
684
686
688
690
PRINT RESET

TIMING SHOWN IN SHIFT REGISTER Q STAGES AND MATRIX TIMES WITH TWO COPY SHEETS IN PROCESS (960 DECODE TIMES/Q STAGE)

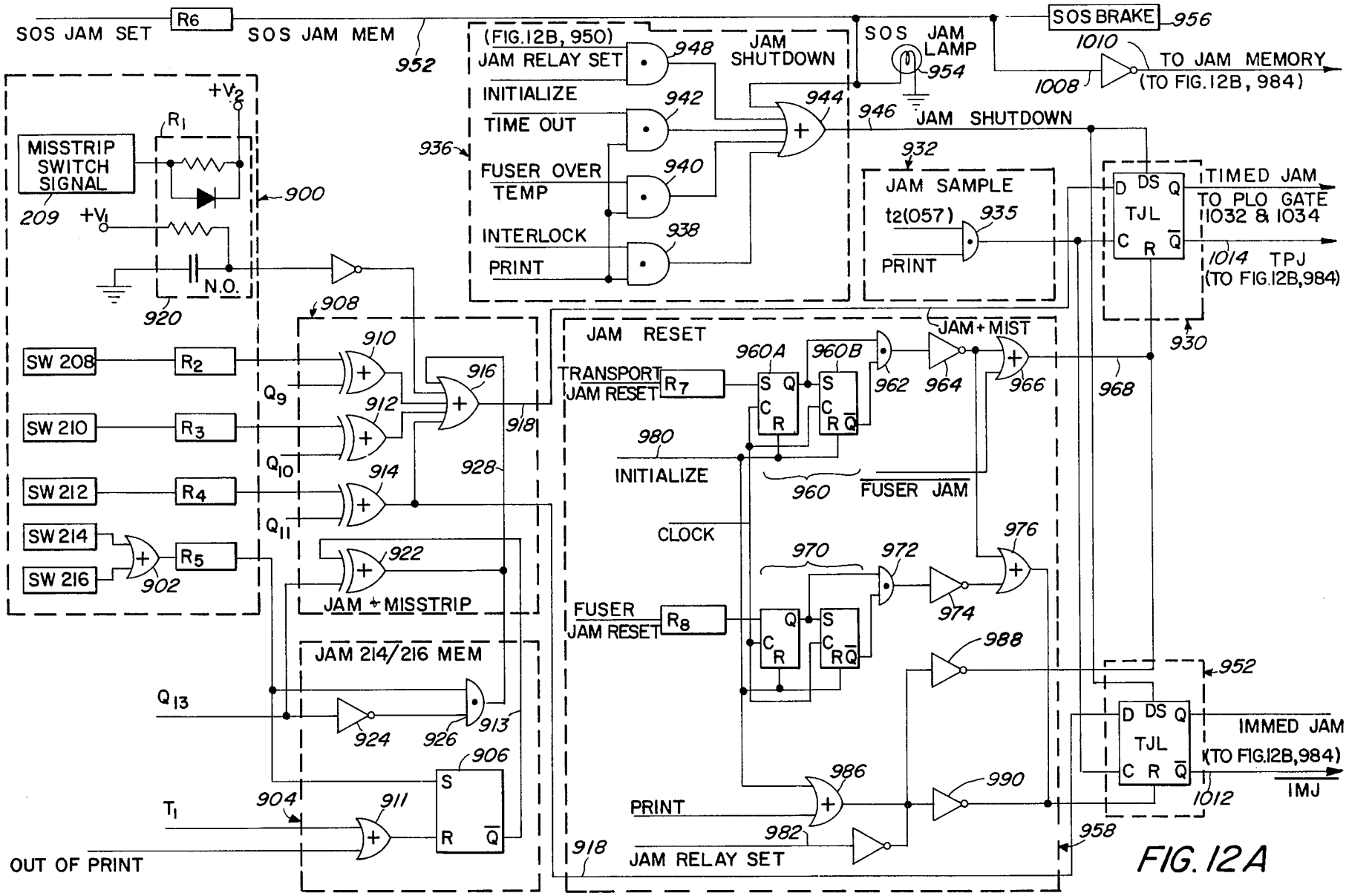
SOS BRAKE
956
TO JAM MEMORY
(TO FIG.12B, 984)
1010
1008
TIMED JAM
TO PLO GATE
1032 & 1034
1014
TPJ
(TO FIG.12B,984)
930
968
IMMED JAM
(TO FIG.12B,984)
IMJ
952
1012
958
FIG. 12A
SOS JAM LAMP
954
JAM SHUTDOWN
946
JAM SAMPLE
935
932
t2(1057)
PRINT
JAM+MIST
966
964
962
976
974
972
988
990
FUSER JAM
960B
960A
960
970
986
982
JAM SHUTDOWN
944
948
942
940
938
(FIG.12B, 950)
JAM RELAY SET
INITIALIZE
TIME OUT
FUSER OVER TEMP
INTERLOCK
PRINT
936
JAM RESET
TRANSPORT JAM RESET
R7
980
INITIALIZE
CLOCK
FUSER JAM RESET
R8
PRINT
JAM RELAY SET
918
952
SOS JAM MEM
918
916
928
910
912
914
922
908
JAM + MISSTRIP
JAM 214/216 MEM
913
926
924
906
911
904
900
R6
SOS JAM SET
+V2
R1
N.O.
920
MISSTRIP SWITCH SIGNAL
209
+V1
R2
R3
R4
R5
902
SW 208
SW 210
SW 212
SW 214
SW 216
Q9
Q10
Q11
Q13
T1
OUT OF PRINT KB
322
DATA LOAD
1102
1104
COPY SELECT REG.
1120
DEL. COINC.
1122
1116
FLASH COINC
1118
FLASH INC.
(FROM FIG.7A, 464)
1110
1106
COPY COUNT REG.
1136
LDCC
1138
LDTS
1134
TEMP STOR. REG.
1126
HOLD
1124
DEL. INC.
1112
COPY DELIV. REG.
LDCD
1140
1108
1148
1142
DISPLAY
1144
1150
RECALL
1146
JOB INCOMPLETE
SYSTEM RUNNING
1130
PRINT
1132
S
Q
R
1128
PRINT
CLEAR

CONTROL SYSTEM FOR HIGH SPEED COPIER/DUPLICATORS

This invention relates to document processing and more particularly to a high speed duplicator document processing control system integrating the use of several peripheral features, singly or in conjunction with a central document processing station, and the monitoring of the processing operation.

The evolution of document processing, with its ever increasing demands for speed and reproduction quality as well as flexibility in operation, has provided a need for a document processing system which will encompass various combinations of desirable features and operations under the control of a central system operable by external command with the least amount of external interference with machine operation. Features which are desirable in a complete processing system include automatic document handling and feeding, multi-level sorting and stacking, and a quality reproductive process. In addition to document control, the system desirably incorporates automatic development control, jam detection and clearance, misfeed sensing, charge and exposure control for electrostatographic processes, and safety and diagnostic monitoring. In addition, various imaging controls such as size reduction and optical compensation for size reduction are also desirable. Furthermore, programming control for copy counting and billing as well as a reliable form of central control, reducing operator intervention and monitoring of all machine parameters including document levels and handling at all stages of the machine operation is desirable.

The development of a single central control system which will operate in a most efficient manner to coordinate an interrelationship between one or more various machine features with a central processing operation has heretofore required extensive use of electromechanical and operator control stages of operation. The use of external operator control results in a substantial amount of non-operating machine time which is both detrimental to the user and the commercial manufacturer of such machinery.

It is therefore, the principal object of the present invention to provide a central control for a document processing system which will allow the integration of various machine functions with the reproducing process.

It is a further object of the present invention to provide a central control for a copying system which permits a minimum amount of operator interference by monitoring various stages of the operation in accordance with desired and selected processing features.

It is another object of the present invention to provide a push-button controlled centralized processing system which will combine many external features utilizable in conjunction with the central processor as is desired with a minimum amount of operator interaction.

In accordance with the foregoing objects, the present invention provides for a central control including an automated condition responsive system for automatically sequencing and integrating the operation of selected external features utilizable in conjunction with an electrostatographic reproducing process. The processing operation is monitored by means of a central timing control initiated in accordance with a preprogrammed sequence for each of the peripheral operations to be performed in conjunction with the central processing sequence. Sequence control is provided for controlling the sequencing of the peripheral operations in accordance with the timing cycles controlling the central reproducing process. More specifically, control means are set up for automatic document handling, sorting, billing, and jam and recovery control. By utilization of central command logic and separate processing logic, integration of all these operations in accordance with externally controlled program operation may be utilized in a heretofore unknown and efficient manner.

Other objects, features and advantages of the present invention will become more apparent from the following more detailed description and appended drawings, wherein.

Figure 7A:
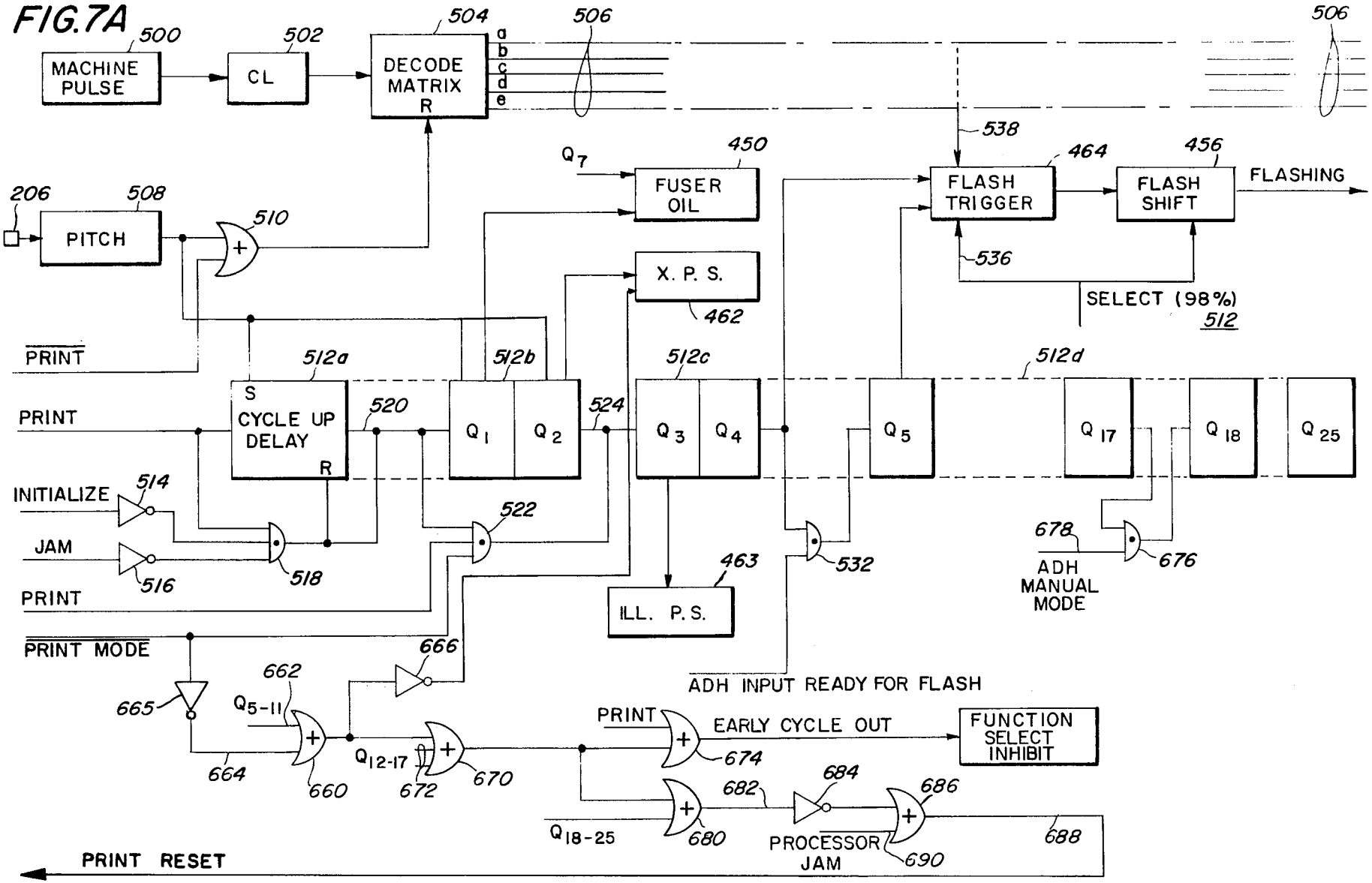
Figure 7B:
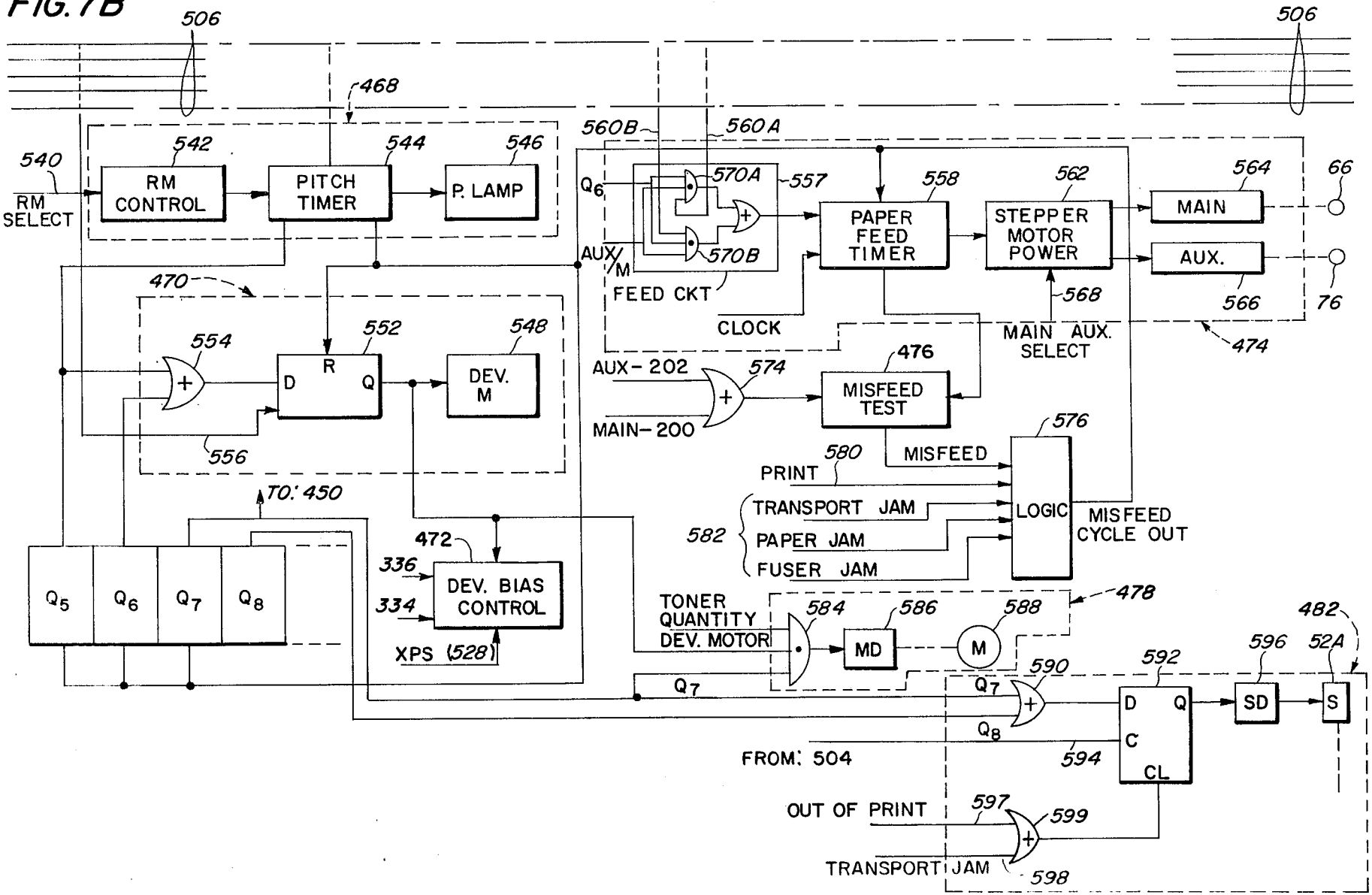
Figure 7C:
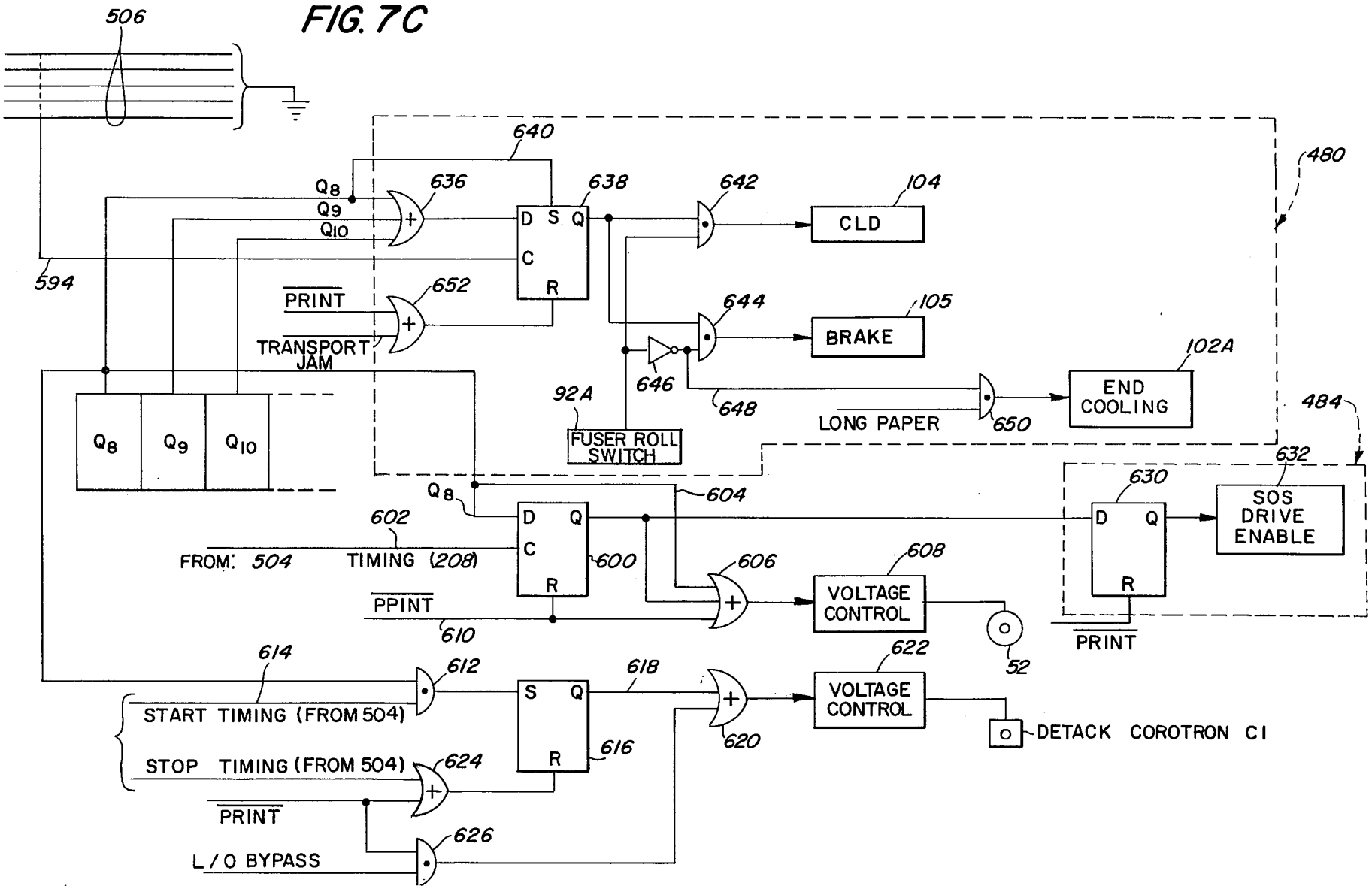
Figure 8A:
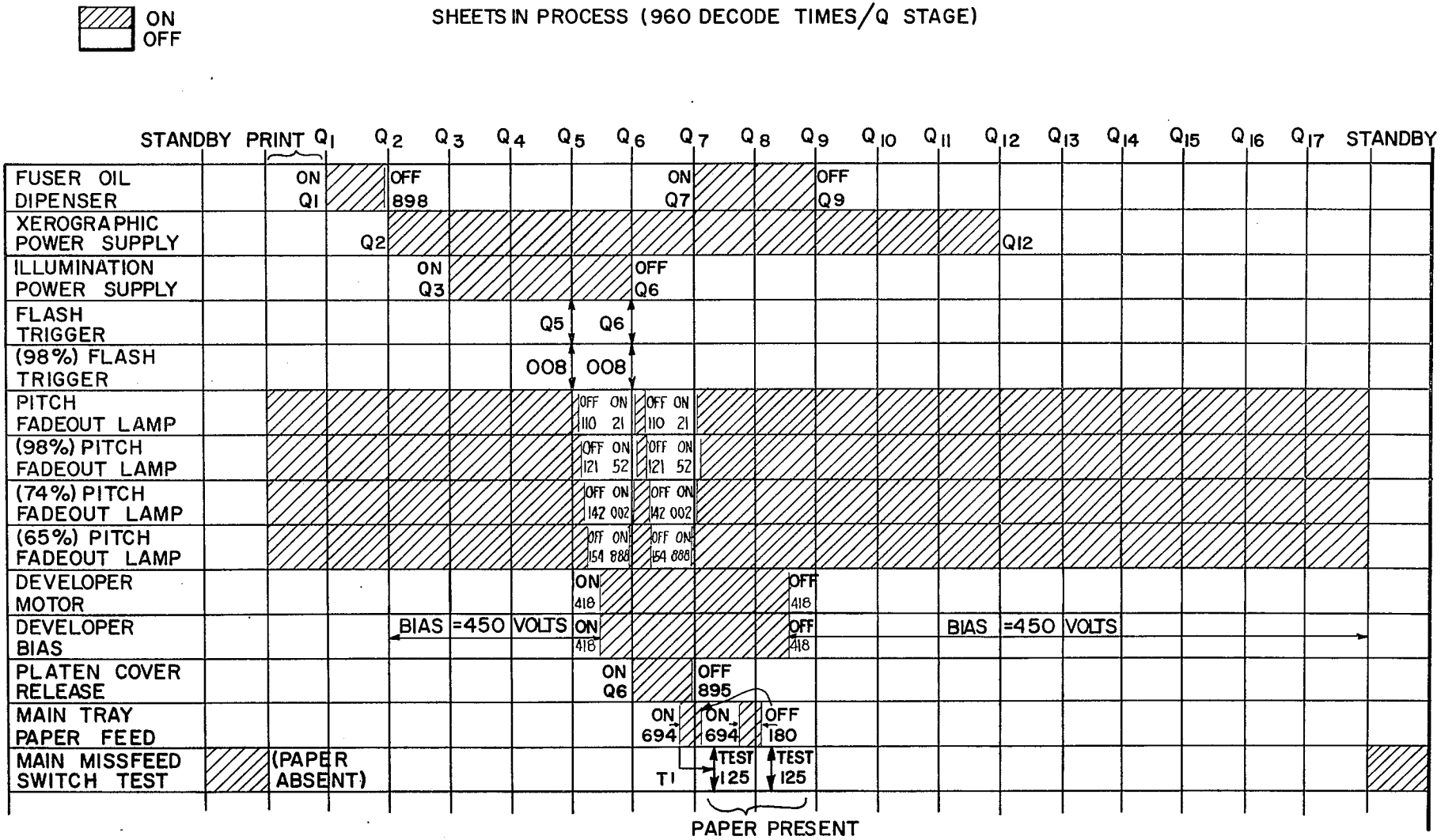
Figure 8B:
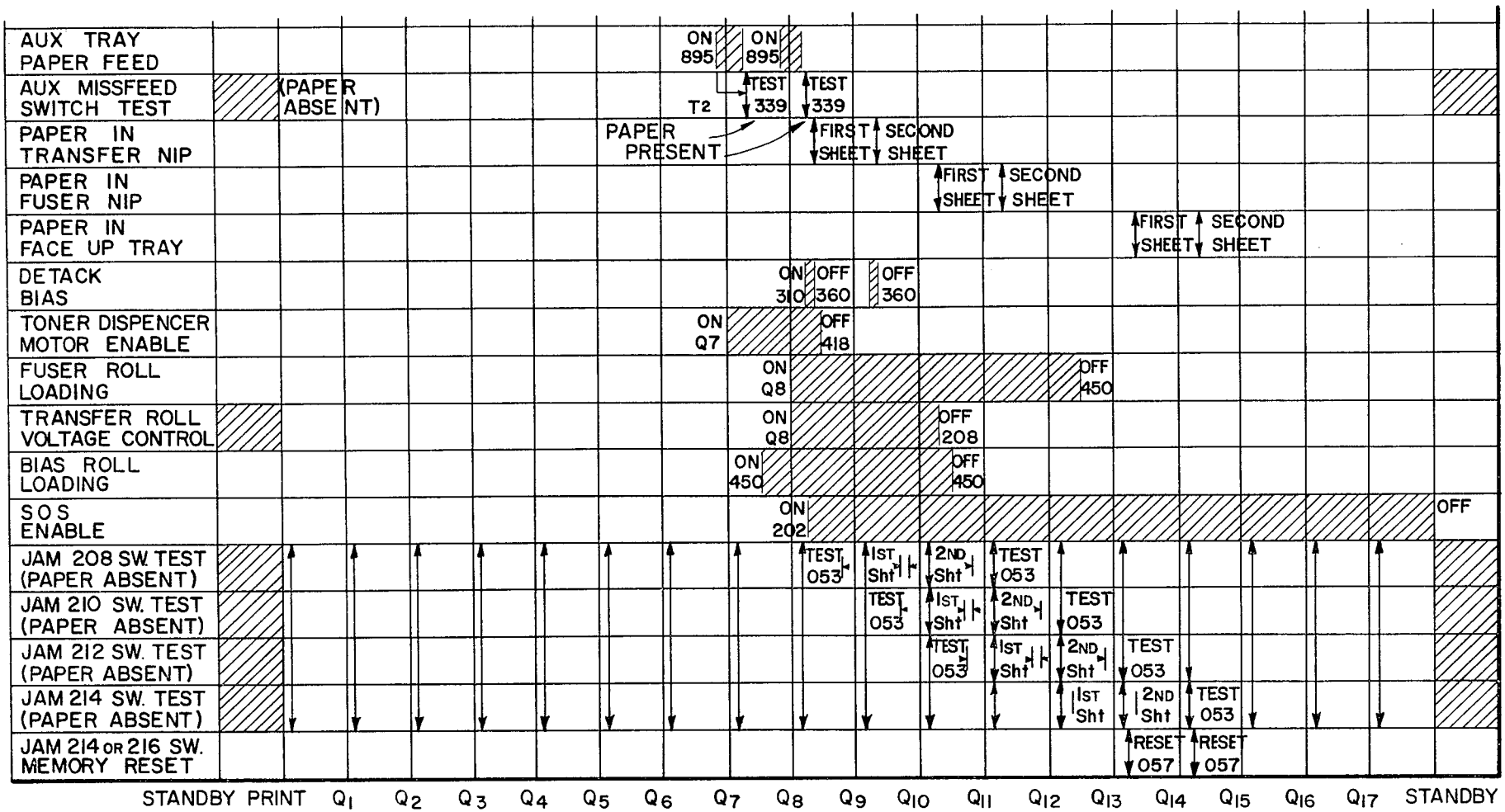
Figure 9:
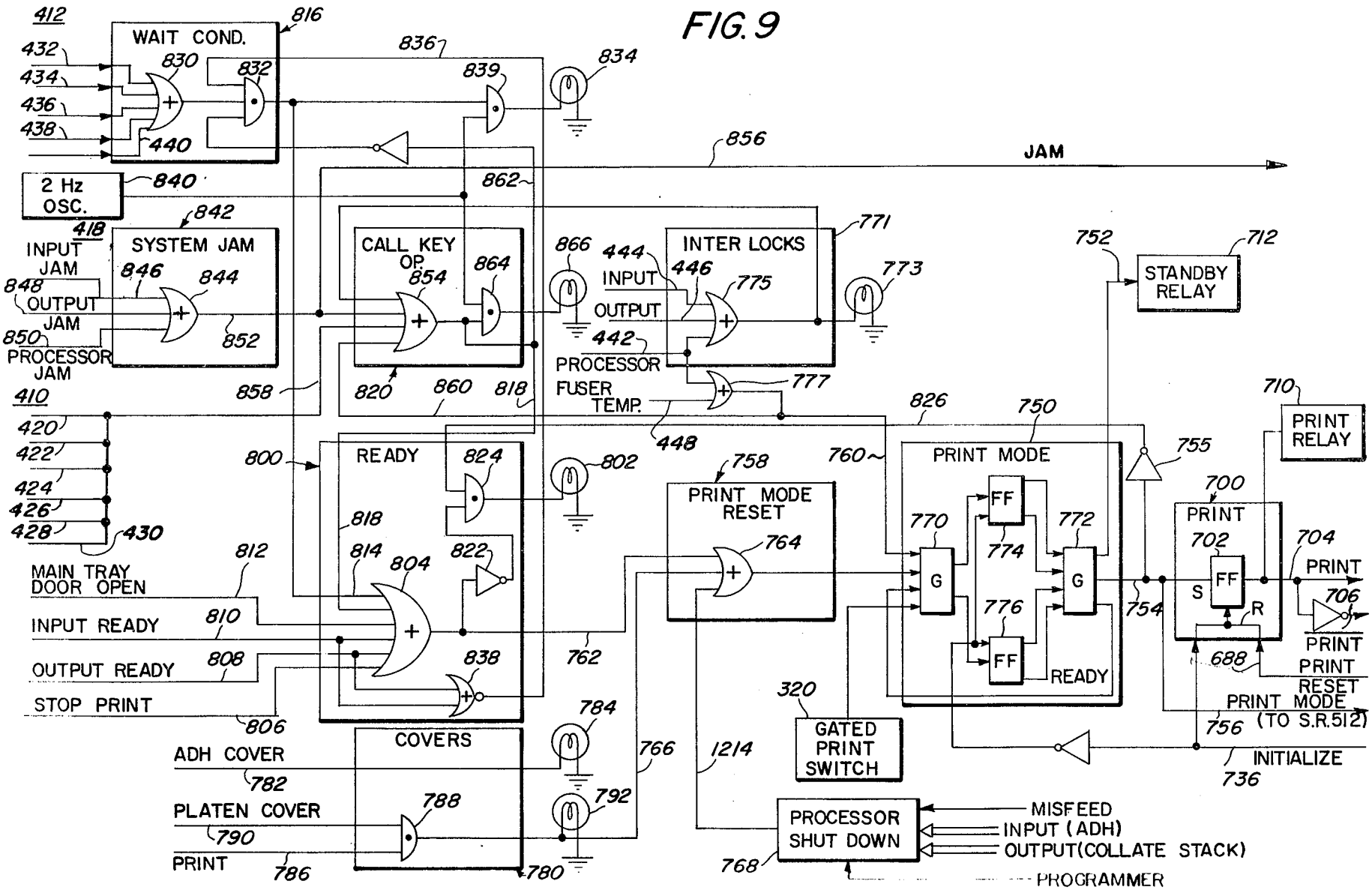
Figure 10:
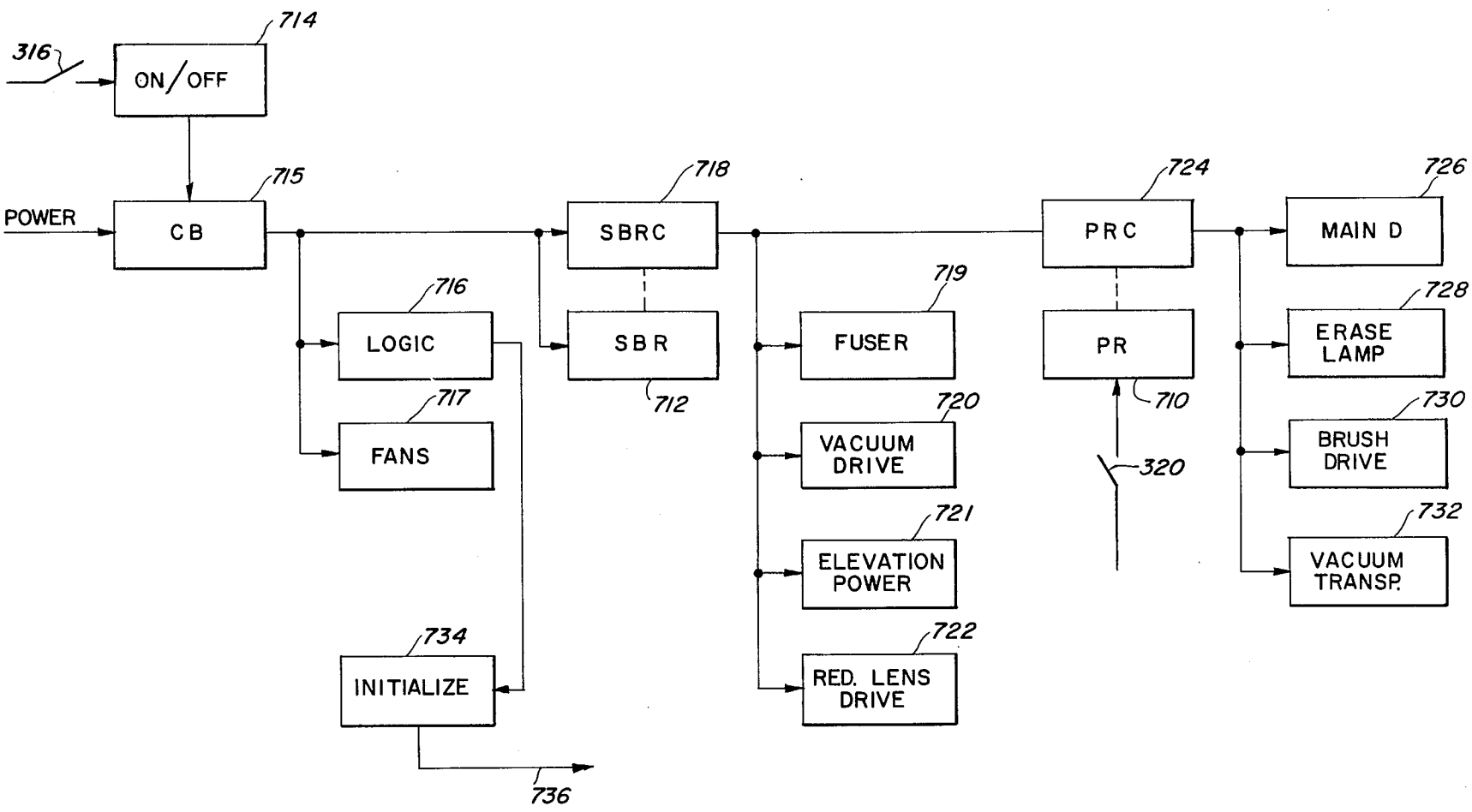
Figure 11:
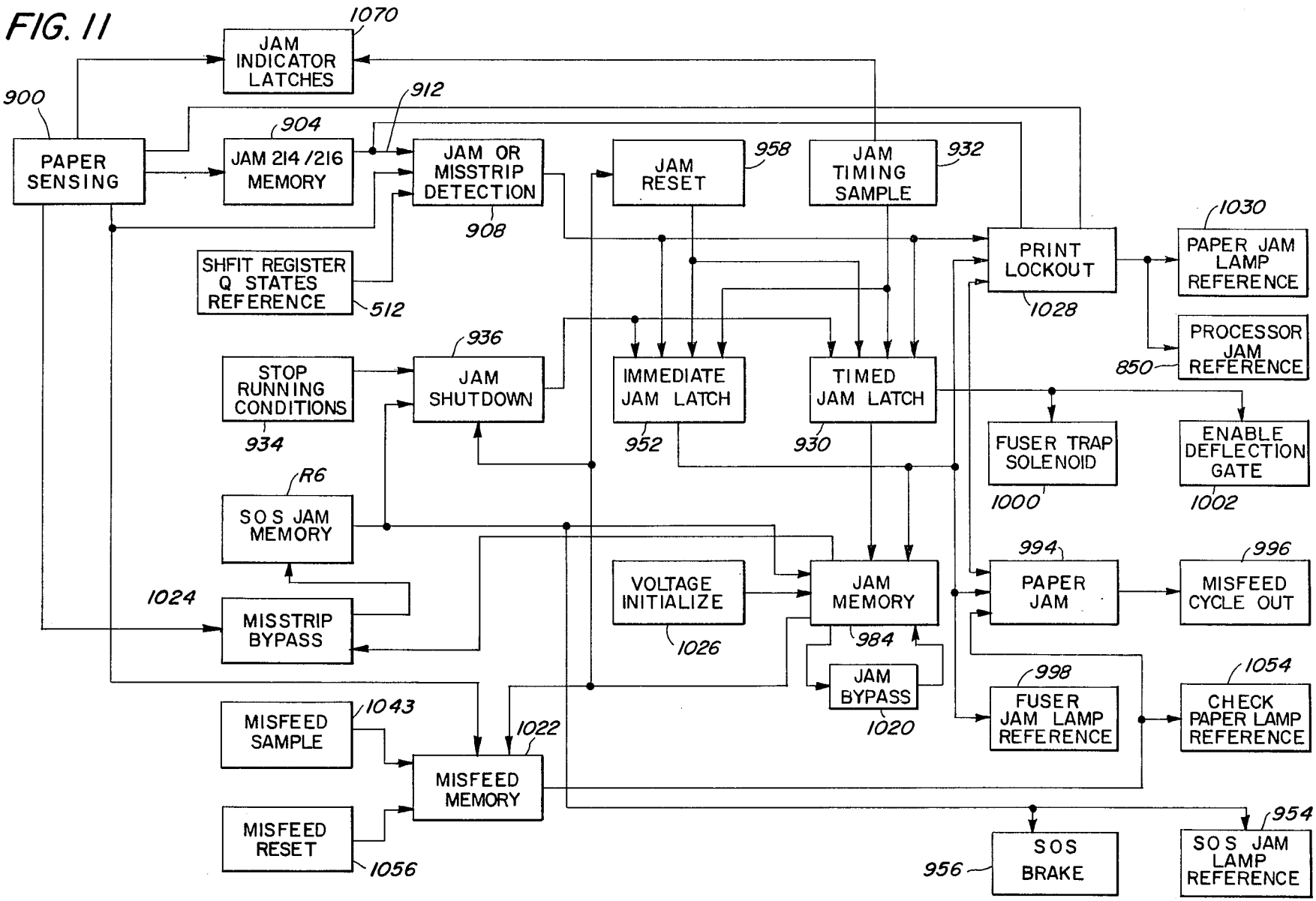
Figure 12B:
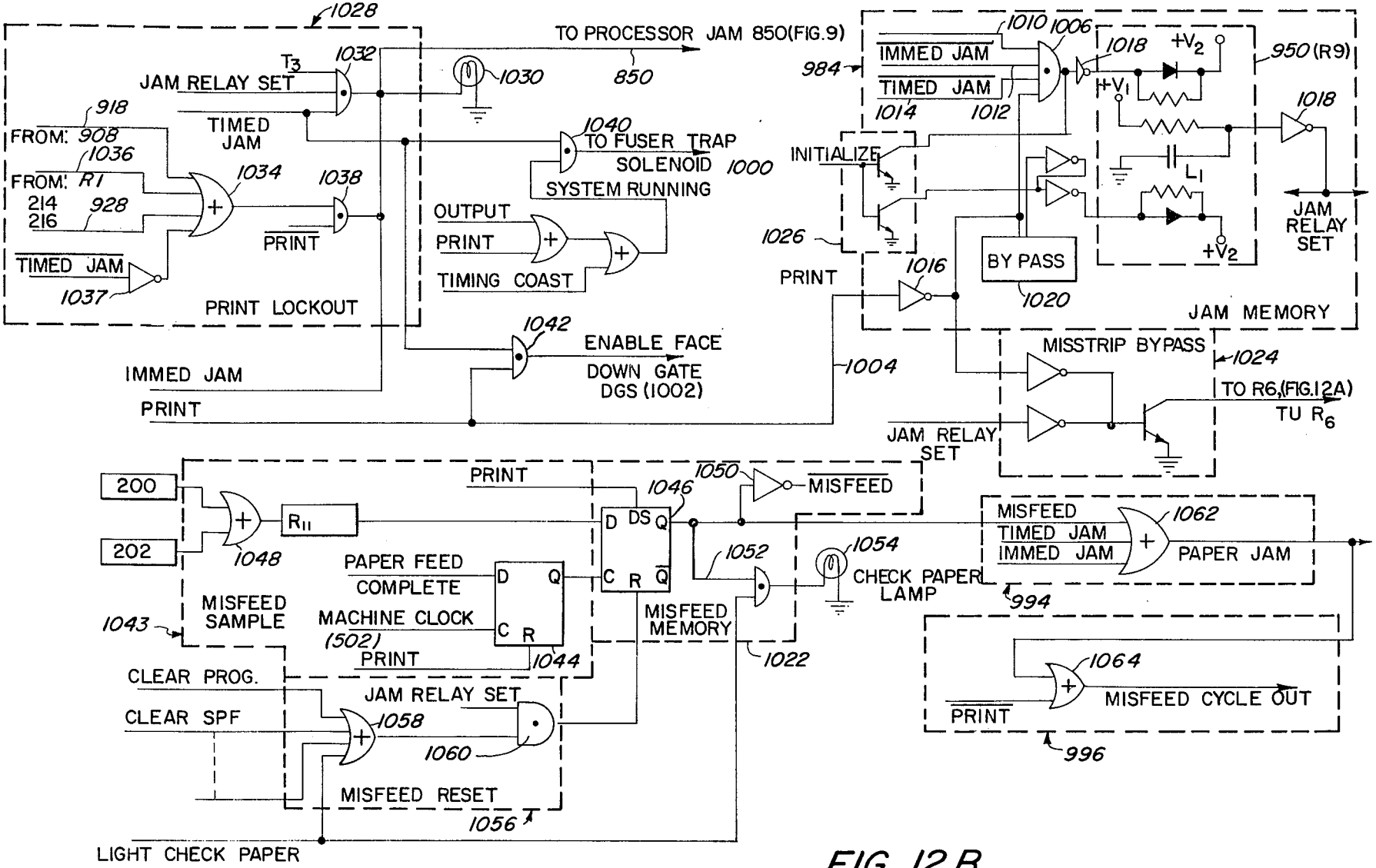
Figure 13:
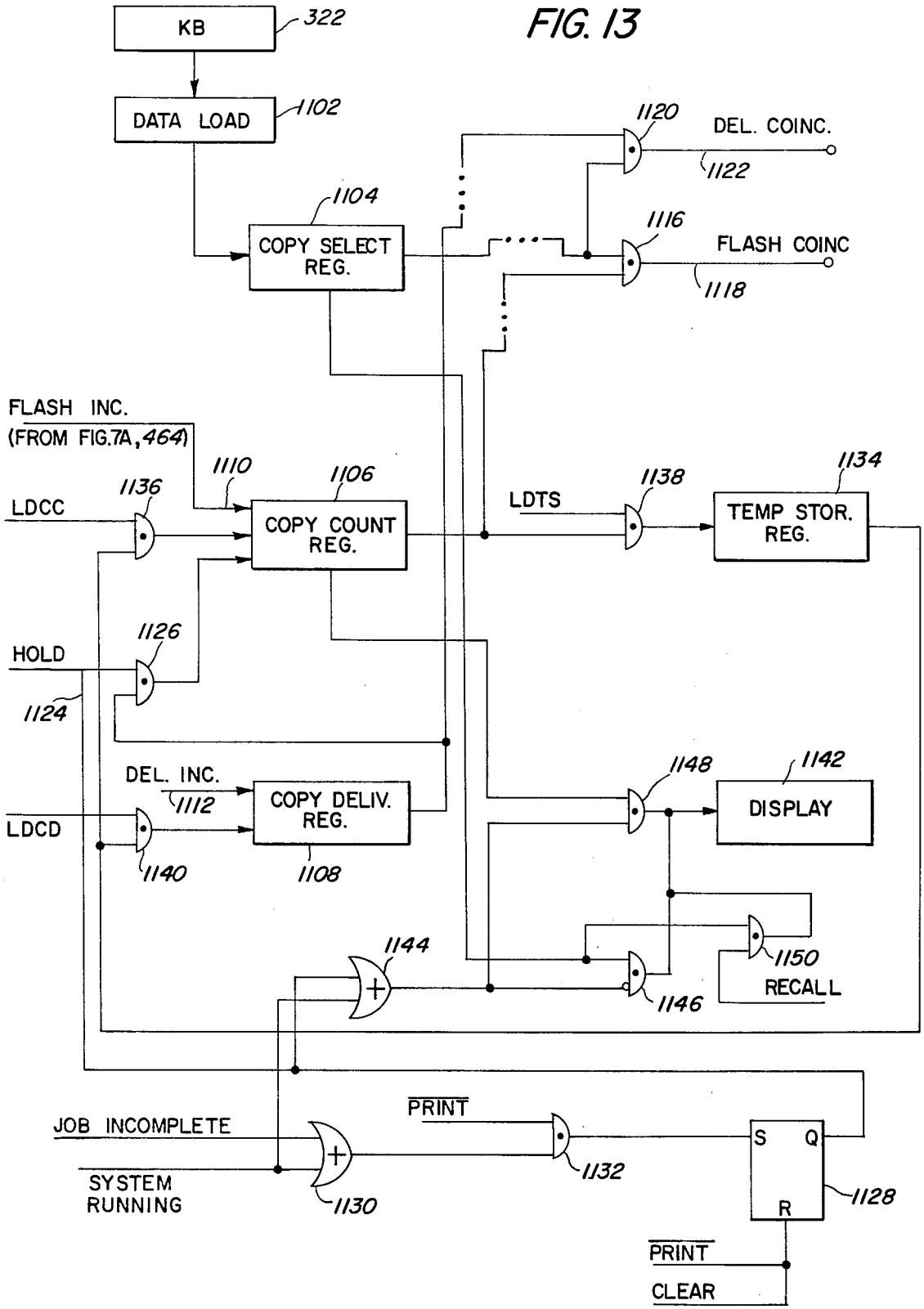
Figure 14:
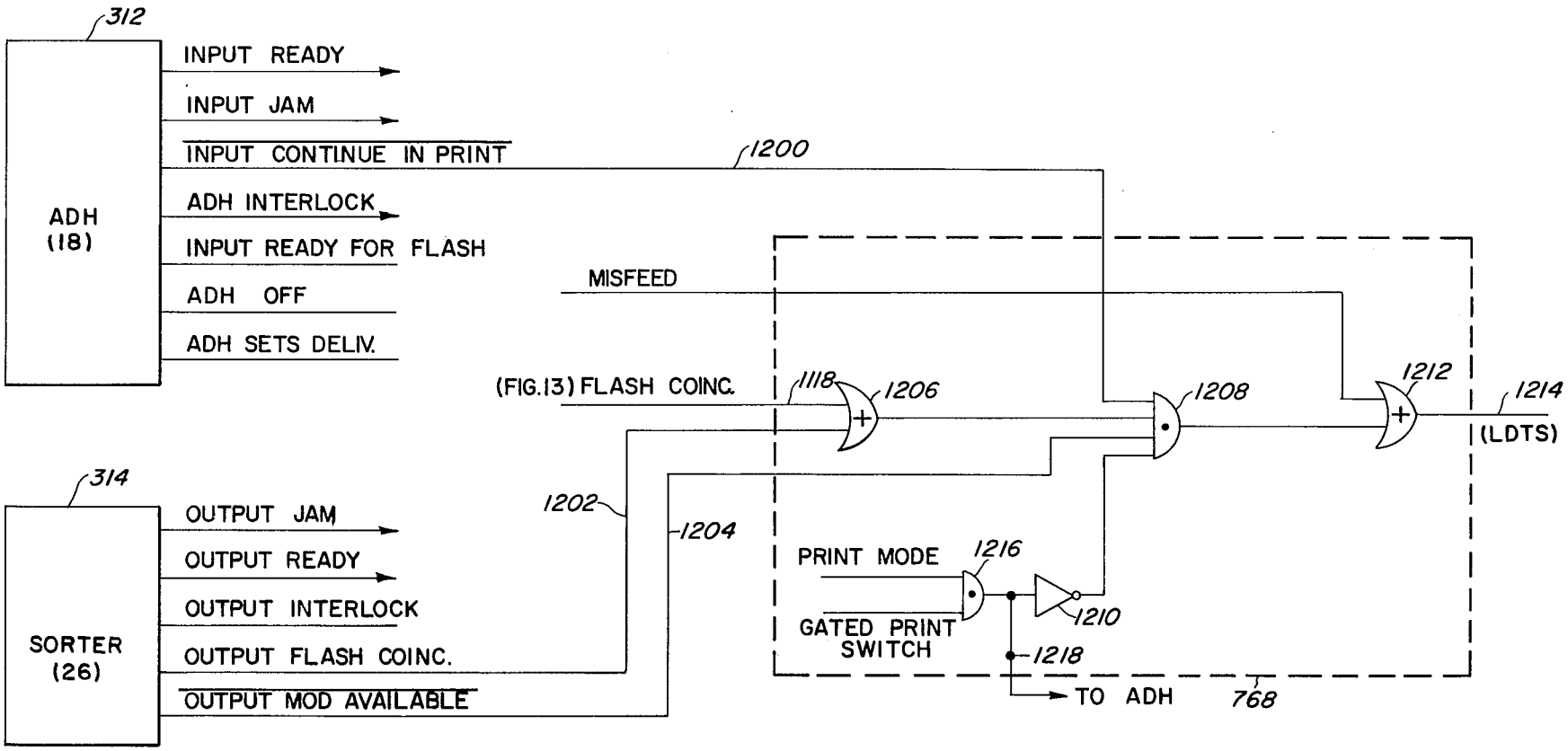
Figure 15:
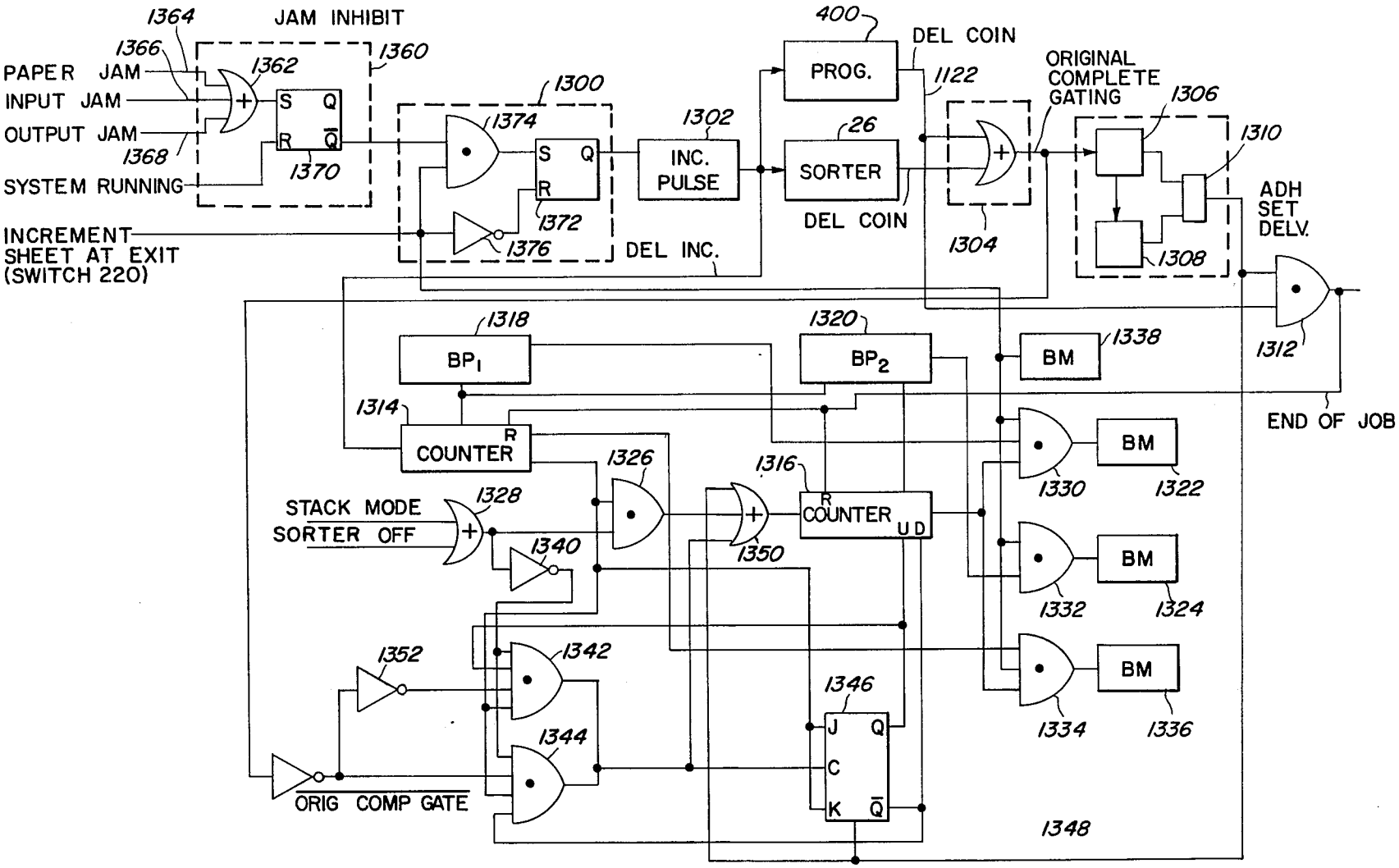

FIGS. 7A, 7B, and 7C show the sequence control electronics;

FIG. 8A and 8B shown the timing applicable to FIGS. 7A, 7B and 7C;

FIG. 9 illustrates the machine conditional operation;

FIG. 10 is a block diagram of the power switching sequence;

FIG. 11 is a general block diagram of the jam system;

FIG. 12A and 12B are more detailed views of the jam system;

FIG. 13 is a block diagram of the programmer unit;

FIG. 14 illustrates the logic circuitry for the normal processor shutdown function; and, FIG. 15 shows the billing logic.

For ease of explanation the following index is provided:

INDEX

DETAILED DESCRIPTION
- I. PROCESSING
- II. PAPER SUPPLY AND FEED PATH
- III. DOCUMENT COPY COLLECTION
- IV. DOCUMENT ORIGINAL HANDLING
- V. COPY SHEET PATH
- VI. CONTROL FUNCTIONS
  - A. Processor Module Copy Processing
  - B. Optics
  - C. Input Module - Document Original
  - D. Output Module stack and Collate
  - E. Timeout
- VII. SYSTEMS PROCESS - AN OVERVIEW
- VIII. SYSTEMS PROCESS - DETAILS
- IX. POWER SEQUENCING
- X. PROCESS OPERATION CONDITION LOGIC
- XI. JAM DETECTION
  - A. Jam Detection System
  - B. Jam or Misstrip Detection -continued

INDEX

C. Stop Running Conditions
D. Jam Reset
E. Jam Latches
F. Jam Memory
G. Print Lockout
H. Timed Solenoid Controls
I. Misfeed
J. Paper Jam
K. Jam Indicator Latches
XII. PROGRAMMER
XIII. PROCESSOR NORMAL SHUTDOWN
XIV. BILLING
XV. SUMMARY Referring to FIG. 1, for orientation purposes a copier system which will utilize the central operational control of the present invention is illustrated.

It will be understood that the present invention is not intended to be limited to any specific type of copying process, it being understood that the inventive control system is utilized in accordance with various types of well known processing systems employing drums, belts, and other recognized forms of reproducing operations, including both electrostatic and nonelectrostatic based systems.

Figure 1:
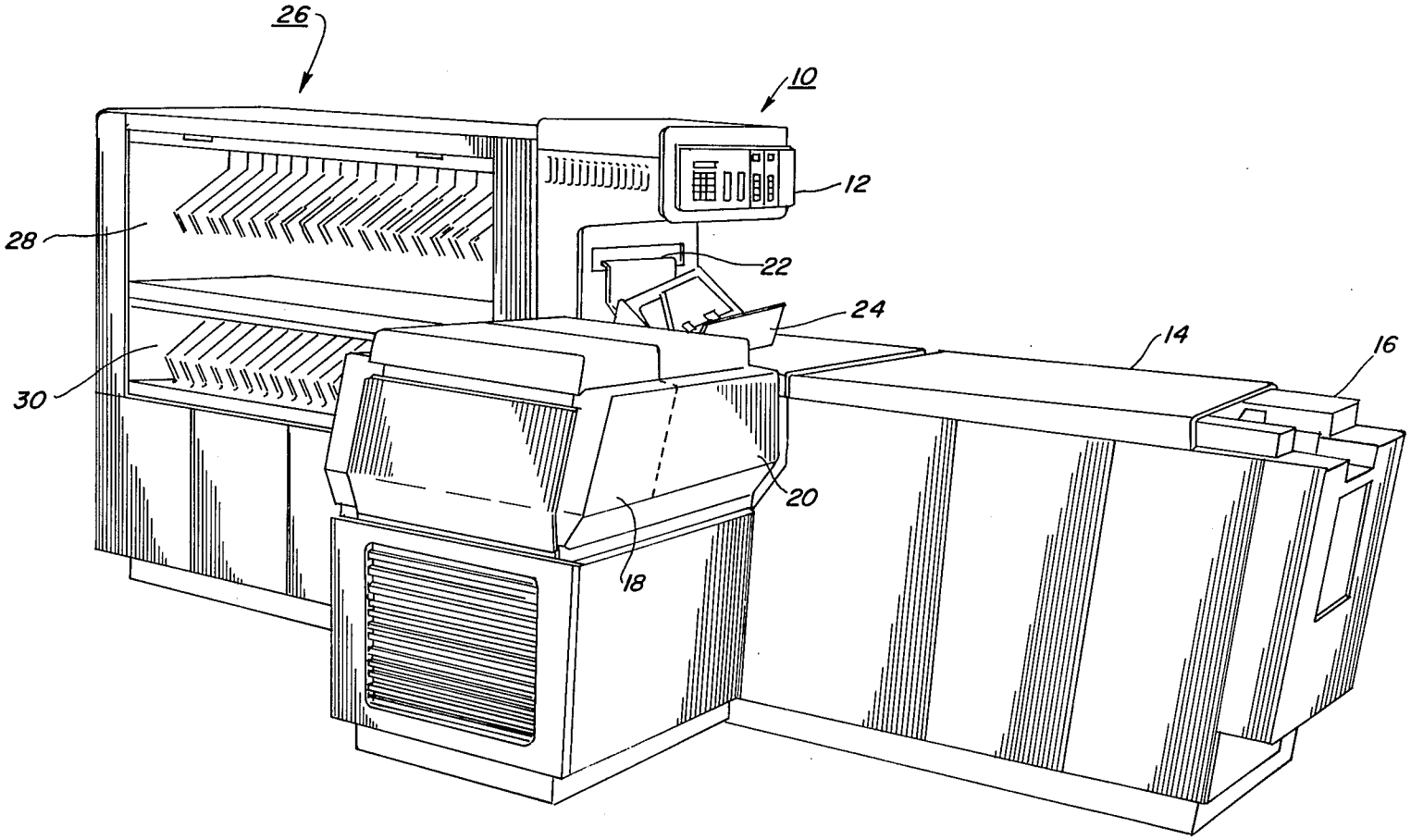
FIG. 1 is a perspective view of a comlete copier system illustrating the conjunctional use of several optional features.

The machine is illustrated in FIG. 1 thus includes several basic operational portions. Central to the concept of the present invention is a controller section designated generally as 10 having a front control panel 12 containing pluralities of suitable controls or actuators such as mechanically switching push buttons or keys for supplementing the various operations to be encompassed by the machine, as well as various indicators for monitoring the various operations. The processing portions of the machine are contained within the segment 14 as are the usual machine components encountered with the use of such processes, such as motor drives, power supplies, fuse controls, and similar apparatus. The paper supply to be used for reproduction is contained within the area illustrated generally as 16. As will be evident from the description provided later herein, the paper supply source will include a main and auxiliary paper stack with appropriate feed control.

The documents to be reproduced are included in a segment identified as an automatic original document handling portion 18 wherein documents or groups of documents may be inserted. The original documents are conveyed along a feed path to the reproducing area 14 for document reproduction onto the paper fed from the supply source 16.

The resultant copy will be driven alternatively through the outlet 22 for accumulation on the paper tray 24 or to an output mechanism illustrated generally as 26 and including an upper module 28 and lower module 30, each of the modules including pluralities of bins for sorting and collection of reproduced documents.

For purposes of reference, the operation of a reproducing process mechanism employed with the present invention will be described within the framework of an electrostatographic reproducing system.

I. PROCESSING

Figure 1A:
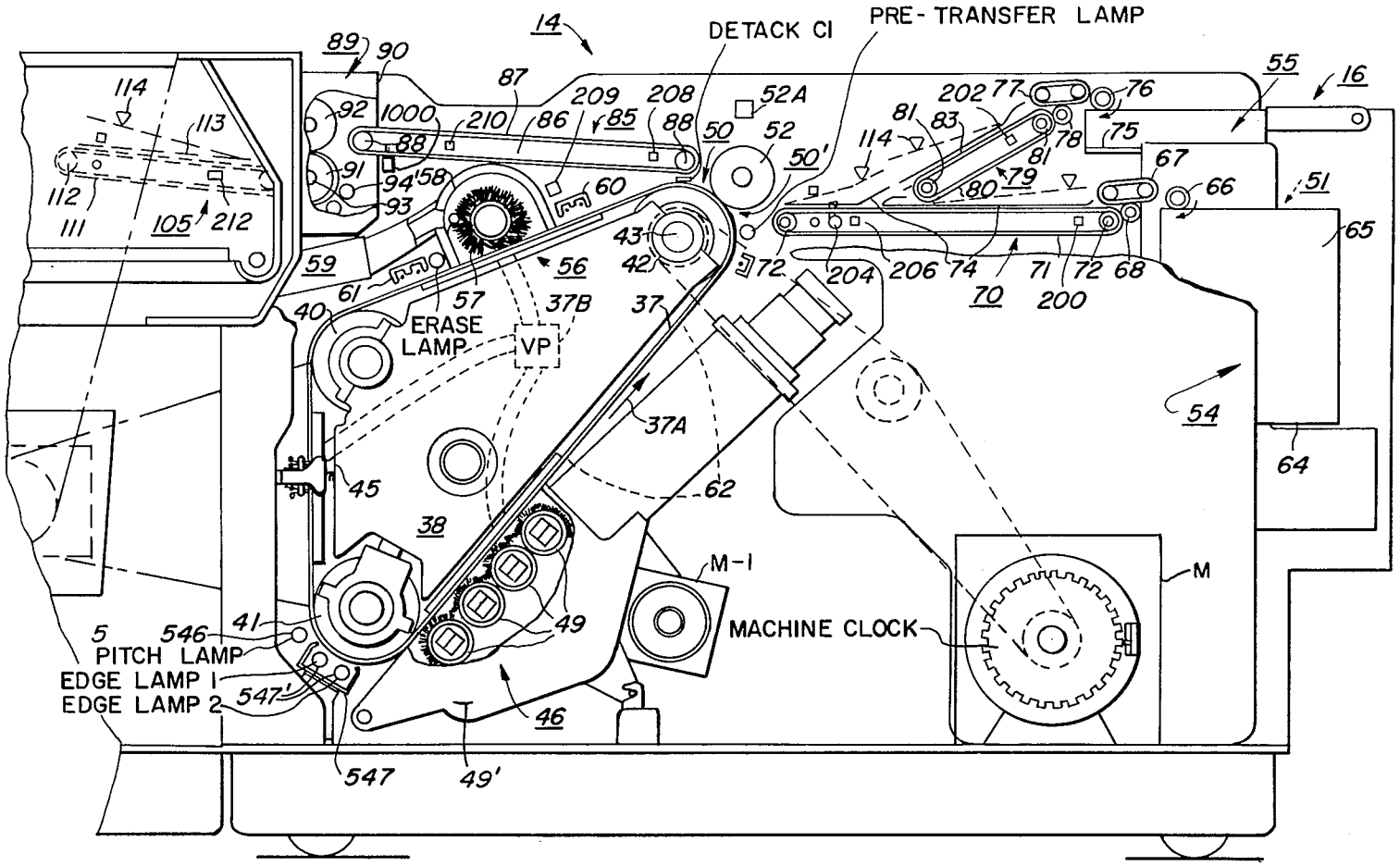
FIGS. 1A and 1B are schematic sectional views of an electrostatic type of reproduction device utilizable in conjunction with the operation of the present invention.
Figure 1B:
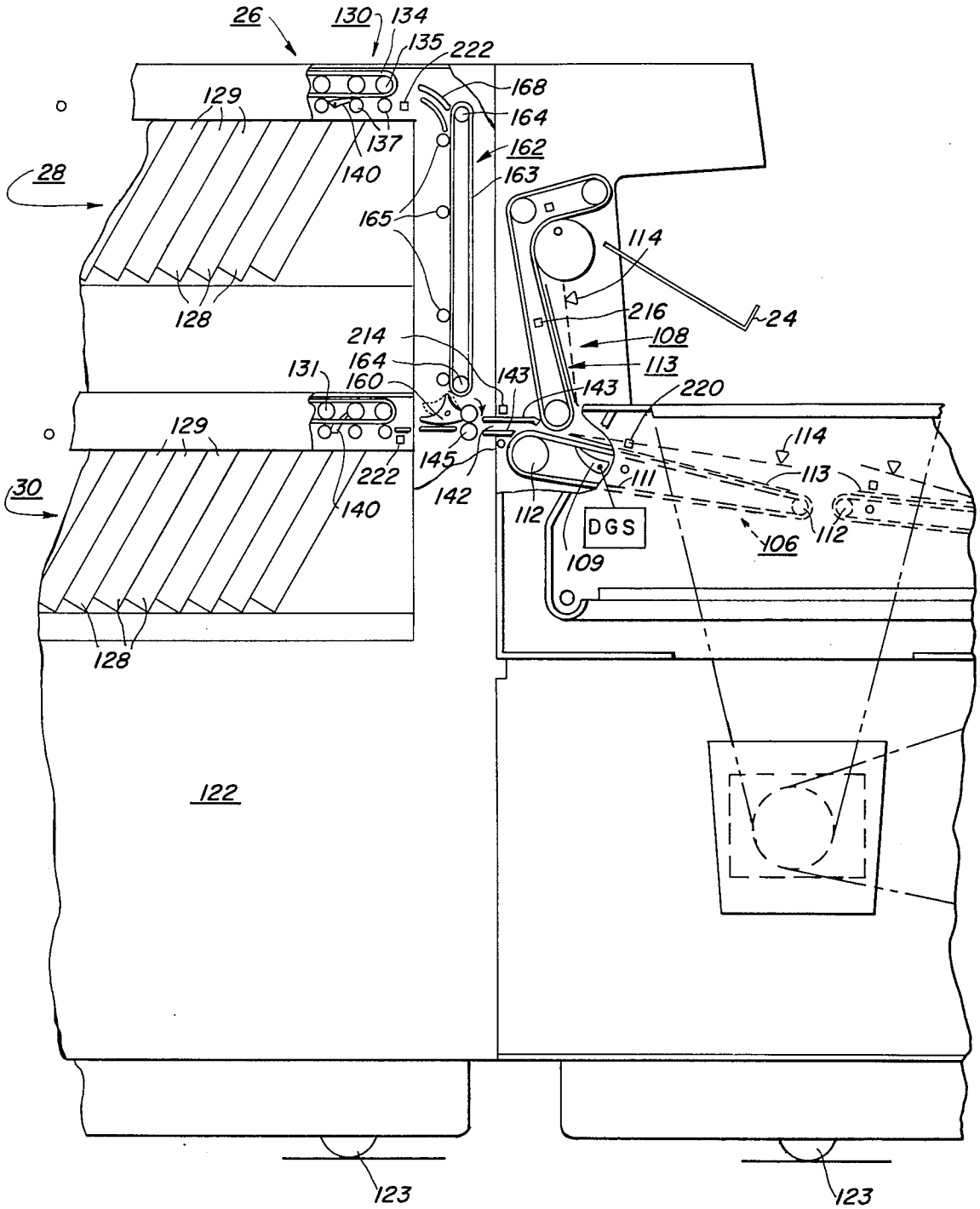

Referring now to FIGS. 1A and 1B, the general machine operation of a typical electrostatograhic system such as the exemplary unit illustrated will be described in detail. As is conventional in such systems, a optical image of the document to be reproduced is projected onto the sensitized surface of the electrostatographic plate to form an electrostatic latent image. Thereafter, the latent image is developed with an oppositely charged developing material to form a xerographic powder or toner image, corresponding to the latent image on the plate surface. The toner image is then electrostatically transferred to a support surface where it is fused by a fusing device so that the toner image is permanently adhered to the support surface.

Figure 2:
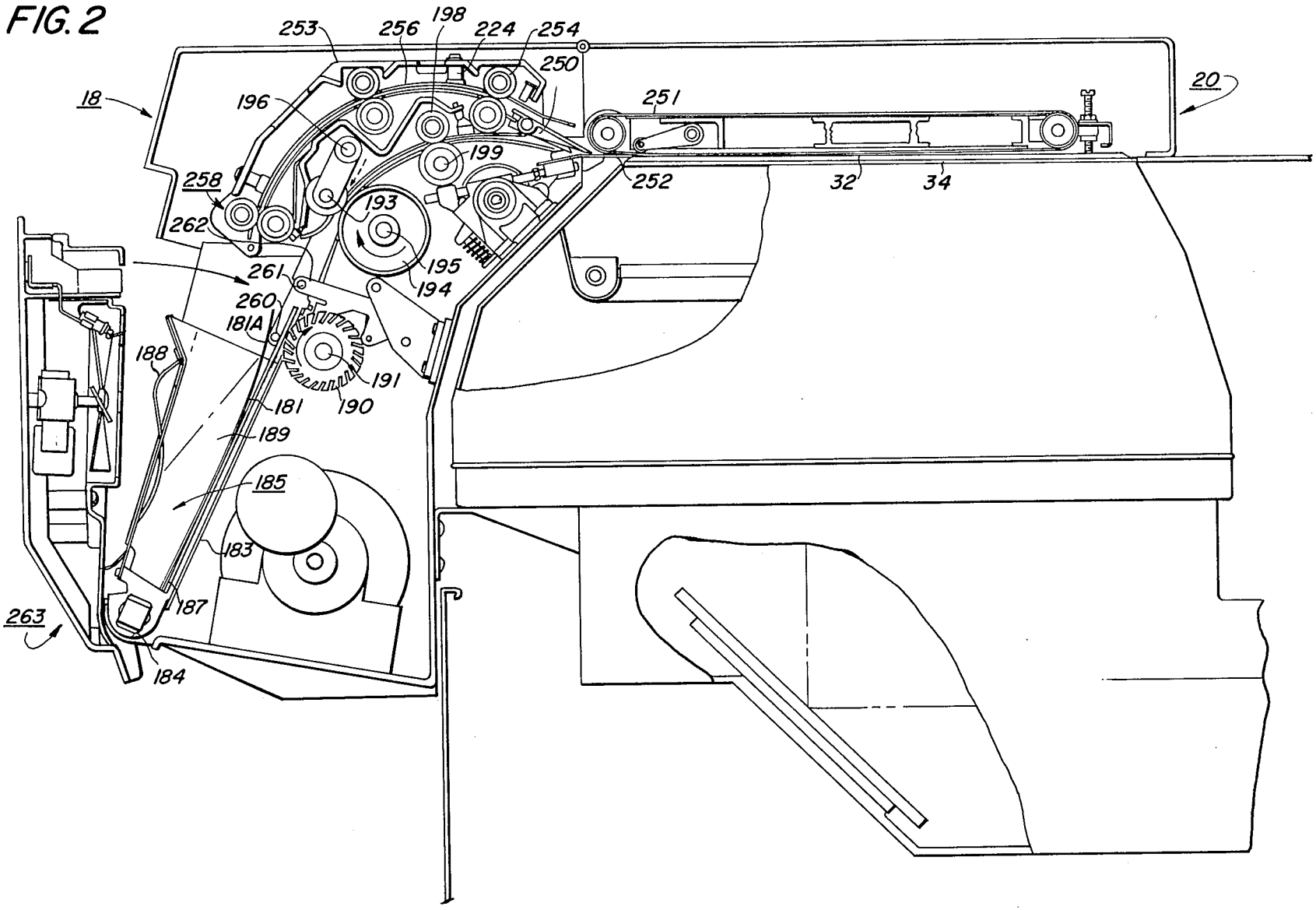
FIG. 2 is a sectional view of an original document handler.

Referring to FIGS. 1A and 1B, the output mechanism and processor 14 including supply source 16 are shown. In FIG. 2, showing the original document handler 18, the original document 32 to be copied is placed upon a transparent platen 34 fixedly arranged in an illumination assembly, generally indicated by the reference numeral 20, and disposed at one end of the processor 14. While upon the platen, the document 32 is illuminated, thereby producing image rays corresponding to the informational areas on the original document. The image rays are projected by means of an optical system onto the photosensitive surface of a xerographic plate, shown in FIG. 1A. In the exemplary copier/reproduction processor 14, the xerographic plate is in the form of a flexible photoconductive belt 37 supported in a belt assembly 38.

The support assembly 38 for photoconductive belt 37 includes three rollers 40, 41 and 42 located with parallel axes at approximately the apices of a triangle. The upper roller 42 is rotatably supported on shaft 43 which in turn is rotatably driven by a suitable motor M and drive means (not shown) to drive belt 37 in the direction shown by the arrow 37A in FIG. 1A. During this movement of the belt, the reflected light image of the original document 32 on platen 34 is flashed upon the photoreceptor surface of belt 37 at an exposure station 45 to produce an electrostatic latent image thereon.

To maintain the processor belt 37 flat at various operation stations and to insure minimal abrasive contact to the belt upon startup, the belt is displaced slightly by a vacuum applied to the underside of the belt at start up so as to move the belt inward, perpendicular to its path of movement. The vacuum is derived from a vaccum plenum 37B and activated by a central control signal at the time of machine activation. The electrostatic image is carried on belt 37 from exposure station 45 past the pitch and edge fadeout areas and through developing station 46 where the latent electrostatic image is developed by means of toner through the use of a multiple magnetic brush system 49. Brushes 49 are driven by motor M-1. From developer station 46, the now developed image on belt 37 moves to transfer station 50 where the developed image is transferred to a support surface, normally a sheet of copy paper 51, brought from main or auxiliary paper trays 54 or 55, respectively, as will appear. The copy sheet 51 passes between transfer roller 52 and belt 37 at transfer station 50 at a speed substantially equal to the speed of belt 37, transfer taking place by means of electrical bias on transfer roller 52 in a manner understood by those skilled in the art.

Following transfer, the belt 37 is cleaned in preparation for the next image at cleaning station 56. There, a suitable cleaning brush 57 housed in vacuum chamber 58 removes residual toner, the toner being drawn from chamber 58 by vacuum through line 59 for deposit in a suitable collecting place (not shown). To assist cleaning, a cleaning corotron 60 is provided upstream of vacuum chamber 58.

Following cleaning of belt 37, the belt 37 is discharged to a residual level by erase means and once again charged as by charging corotron 61 in preparation for the next image.

As will be set forth in further detail, it will be understood that whenever processor 14 is operated to make multiple copies, a number of images, exemplarily shown with a dimension 62, may be on belt 37 simultaneously in various process stages as described above.

Photoconductive belt 37 comprises a photoconductive layer of selenium, which is the light receiving surface and image medium for the apparatus, on a conductive backing. Further details regarding the structure of the belt assembly and its relationship with the machine and support therefor may be found in the U.S. Pat. No. 3,730,623 issued May 1, 1973, assigned to the assignee of the present invention and the disclosure of which is incoporated by reference herein.

II. PAPER SUPPLY AND FEED PATH

Copy sheets 51 are suppled from either main paper tray 54 or auxiliary paper tray 55. Main paper tray 54 includes a suitable elevator type base 64 on which a supply 65 of sheets 51 rest, base 64 being supported for automatic up and down movement by suitable means (not shown) designed to maintain paper feed roll 66 in operative contact with the topmost one of the sheets 51 on elevator 64. Feed roll 66, which is operated intermittently in the direction shown by the solid line arrow in timed relationship to the spacing of images on belt 37, serves to advance the topmost sheet from supply stack 65 into the nip of belt and feed roll pair 67 and 68 respectively, which in turn carry the sheet onto main paper supply transport 70.

Transport 70 includes one or more endless feed belts 71 stretched about support rollers 72, one or both of which are suitably driven. Sheet guides 74 are disposed in operative position above transport belts 71, guides 74 serving to maintain the sheets 51 in operative contact with belt 71 of paper supply transport 70 during movement therealong. Transport 70 carries the sheets 51 forward to transfer roll 52.

Auxiliary tray 55, in the exemplary arrangement shown, is arranged above main tray 54, auxiliary tray 55 including a suitable elevator type base 75 on which a supply of sheets 51 may be provided. As with main supply tray 54, suitable means (not shown) are provided to raise base 75 of auxiliary tray 55 as the supply of sheets thereon are used up so as to maintain the paper feed roll 76 for auxiliary tray 55 in operative contact with the topmost sheet. Paper feed roll 76, which is intermittently driven in the same manner as main tray feed roll 66, advances one sheet at a time into the nip of belt and roller feed pair 77 and 78 respectively which in turn carry the sheets forward to auxiliary paper supply transport 79. Transport 79 which comprises one or more endless belts 80 stretched about support rollers 81, one or both of which are suitably driven, is disposed to discharge sheets 51 drawn from auxiliary tray 55 onto the operating run of main supply transport 70. The sheets 51 from auxiliary tray 55 are thereafter fed to transfer roll 52. Guides 83 serve to maintain the sheets in driving contact with the auxiliary paper supply transport 79 during movement therealong.

Transfer roll 52 acts to transfer the image from the belt to the copy sheet. A suitable bias may be provided to facilitate transfer of the image. The sheets 51 discharged from main supply transport 70 are carried by transfer roller 52 past the detack corona device $C_1$, which strips the leading edge of the copy for engagement by the vacuum transport 85. It is understood that transfer of the image from belt 37 to copy sheet 51 takes place as the sheet 51 passes between transfer roller 52 and belt 37. However, when the machine is not making copies in order to prevent cold flow effects in he selenium belt, it is preferable to remove the physically contacting transfer roller from the surface of the belt 37. This is accomplished by energizing a solenoid 52A which in turn activates the removal of the transfer roll from the belt 37.

Following transfer with the copy sheet 51 removed from the transfer zone 50, the image bearing sheets are carried by vacuum transport 85 to a fuser 89. Transfport 85 includes a vacuum plenum 86 to which vacuum is supplied from a suitable source (not shown), and an endless conveyor belt 87 arranged about rollers 88, belt 87 having suitable perforations therethrough which enable vacuum from plenum 86 to tack the sheets 51 being fed thereto.

The function of the fuser, as is known, is to fuse the particles forming the image to the paper. The fuser 89, shown in greater detail in FIG. 3, includes a suitable housing 90 within which is disposed a lower heated fuser roll 91 and an upper pressure roll 92, rolls 91 and 92 cooperating to form a nip through which the copy sheets 51 pass. Rolls 91 and 92 are suitably supported for rotation and driven in unison by a suitable driven means (not shown). Pressure roll 92 is comprised of a relatively soft rubber-like material with the result that pressure contact between the rolls 91, 92 deforms the surface of pressure roll 92. In this way, an increased contact arc between the copy sheet and the heated fuser roll 91 is obtained.

In the exemplary arrangement illustrated, fuser roll 91 is hollow, roll 92 being formed from a suitable heat conductive material. A source of heat such as lamp 93 is disposed therewith. A suitable temperature variable resistor, i.e. thermistor 94' is supported on the fuser housing 90 in heat exchange relation therewith to sense temperature conditions within fuser 89. Suitable control circuitry (not shown) for controlling fuser lamp 93 in response to fuser temperature conditions as sensed by thermistor 94' is provided.

It is noted that should the copy paper remain on the belt 37 past the transfer station area 50 due to failure of the pickoff mechanism to operate, a condition hereinafter identified as SOS will be created. Automatic detection of this condition, is set forth in U.S. Pat. No. 3,791,729, and issued Feb. 12, 1974, and U.S. Pat. No. 3,809,475, issued May 7, 1974, both U.S. Pat., assigned to the assignee of the present invention, the disclosures of which are incorporated by reference herein.

Figure 3:
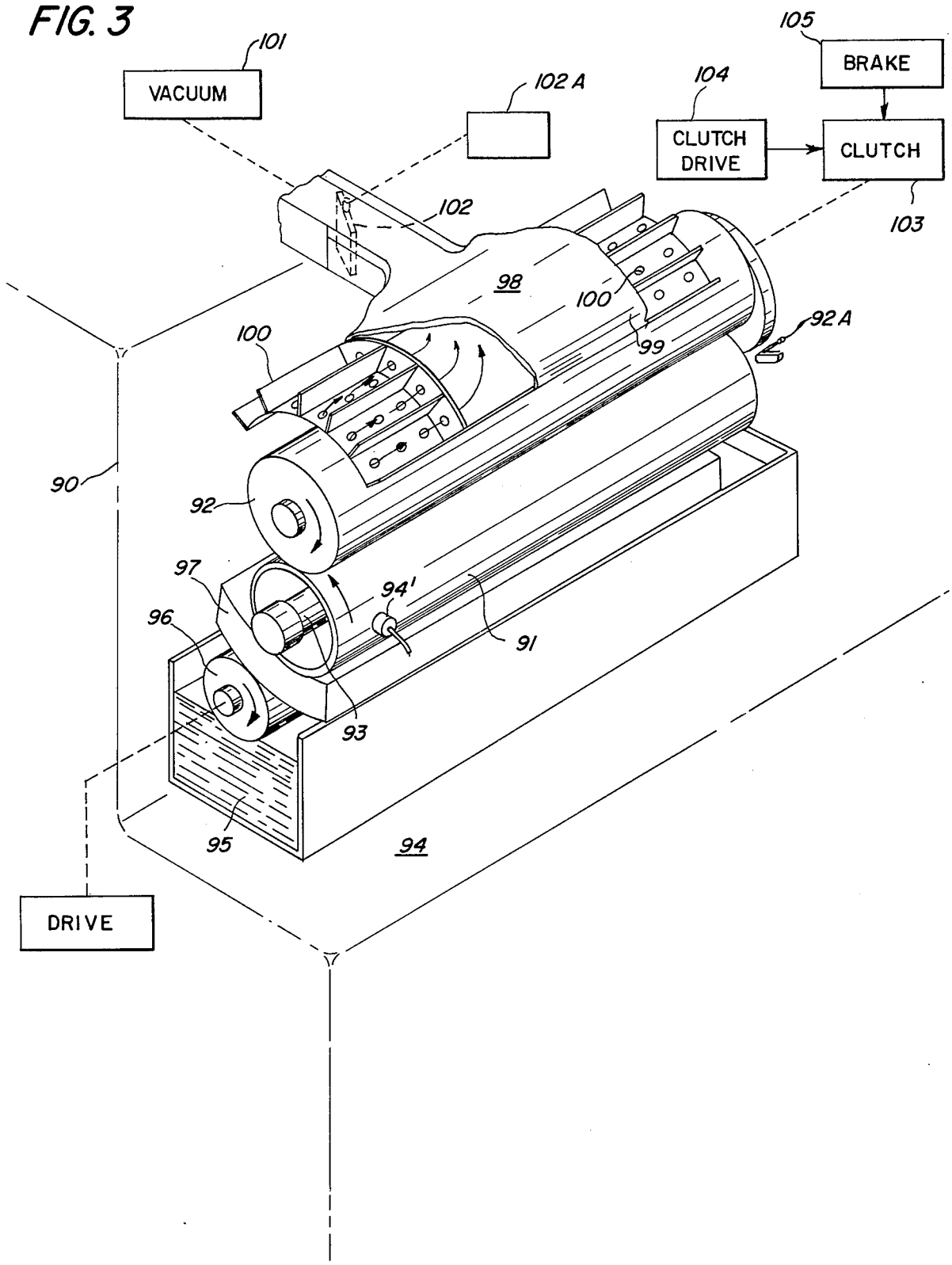
FIG. 3 is a detailed view of the fuser mechanism utilizable with the present invention.

Referring to FIG. 3, a detail of the fuser heating mechanism is shown. As shown, the fuser includes an oil dispensing mechanism 94 which includes an oil reservoir 95 and rotating applicator roll 96 positioned within the oil reservoir. A wick 97 cooperates with the applicator roll 96 to absorb oil placed thereon and transmit the oil to the heated roller 91. The thin film of oil is maintained within the nip formed between the two rollers 91 and 92 for providing the desired heating effect as is well known in fuser technology. Positioned atop the upper pressure roller 92 is a cover 98 which includes edge portions 99 and 100. The edge portions are segmented cooling shoes which are coupled by means of internal channeling to a vacuum source indicated generally as 101. An air valve 102 is positioned within the channel coupled to the edge cooling shoes. The function of the edge cooling shoes is to allow air to be passed along the interior channel to the cooling shoes by adjustment of the air valve 102 when it is desired to provide a narrower heating range over the rollers 91 and 92. The principle function of the edge cooling shoe, used for fusing differently sized paper is to improve and extend fuser roll life. Thus, for wide paper the air valve 102 is left in a position blocking the vacuum through the edge cooling shoes such that the entire length of the rollers 91 and 92 is utilized for fusing. When a narrower paper is used, the air valve 102 is positioned so as to allow the vacuum source 101 to pull air through the edge cooling shoes 99 and 100, thereby providing a slightly narrower heating range over the length of the rollers 91 and 92 for shorter paper. It should be noted that the feeding mechanism of the present invention contemplates feeding paper edgewise from the feed mechanisms. The edgewise feeding means that the edge cooling shoes are activated when shorter paper is to be fed between the nip defined by the rollers 91 and 92. When the fuser is not in operation, the upper pressure roller is removed from the lower roller by means of a control actuated clutch mechanism 103. Activation of the clutch mechanism disables both the drive to the pressure roller 92 and also moves the pressure roller 92 out of engagement with the heater roller 91, thereby disabling the fusing mechanism. The clutch and solenoid mechanism 103 is activated by means of a control signal derived from a suitable clutch drive 104, to be set forth in further detail below.

Fuser temperature control and edge cooling is set forth in greater detail in U.S. Pat. No. 3,735,092, issued May 22, 1973 and U.S. Pat. No. 3,820,591, issued June 28, 1974, both, assigned to the assignee of the present invention and the disclosures of which are incorporated herein by reference.

III. DOCUMENT COPY COLLECTION

Referring again to FIGS. 1A and 1B, copy sheets 51 leaving fuser 89 are carried by intermediate copy output transport 105 to copy output transport 106 and from transport 106 to either copy discharge transport 108 or to the inlet of a copy sheet handling device such as the copy collector 26. Where collector 26 is not in use or where no sheet handling device is provided, a blocking gate 109 serves to route all copies onto discharge transport 108. Discharge transport 108 carries the copies to an output tray 24.

Copy output transports 105, 106 and copy discharge transport 108 each have one or more endless conveyor belts 111 operatively disposed about support rollers 112, one or both of which may be driven. Guides 113 are disposed in operative relationship with each of the transports 105, 106, 108, guides 113 serving to maintain the copy sheets in operative contact with the conveyor belts associated therewith.

Guides 74, 83, and 113 can be released to dashed line positions 114 to enable their respective transports to be cleared in the event of a jam. Sensors disposed in operative relationship with the guides 74, 83, and 113 for transports 70, 79, 105, 106 and 108 serve to indicate jams and release of the guides by the user following a jam, restarting being precluded until the sensors are activated by release of the guides 74, 83, 113 as will appear, and repositioning of the guides.

In the examplary arrangement shown in FIG. 1, a copy collector unit 26 is operatively coupled to processor 14. The unit 26 serves to sort copies 51 as they egress from the processor 14. Referring to FIG. 1B, the unit 26 includes a suitable frame 122 which is preferably mounted on castors 123 to faciliate moving the unit 26. The unit 26 includes upper and lower copy bin rows 28 and 30 respectively. Each rows 28 and 30 contains a plurality of spaced downwardly inclined bins or trays 128 for receiving and holding copies, each bin 128 being open at the top to provide an inlet 129 through which the copies pass into the bin.

A generally horizontal copy sheet transport 130 and 131 is disposed above each row 28 and 30 of bins 128 opposite inlets 129 thereto, the operating length of transports 130 and 131 being sufficient to enable transports 130 and 131 to carry the copies to the endmost one of the bins. Transports 130 and 131 each comprise one or more endless conveyor belts 134 supported on rollers 135, one or more of which may be driven by a suitable means (not shown). A series of idler rolls 137 are arranged below and in operative contact with the lower operating run of transports 130 and 131, an idler roll 137 being provided adjacent the inlet 129 to each bin 128. Idler rollers 137 serve both to hold the copies in operative contact with the transport conveyor belts 134 and as a base about which copies are born by the adjoining deflector 140 into the inlet bin therebelow. The individually actuable deflector 140 is arranged slightly downstream of each roller 137. When actuated to a raised position, the deflectors 140 cooperate with the surface of the roller 137 to turn a copy from the sheet transport 130 or 131 associated therewith into bin 128 therebelow.

The unit 26 includes a copy sheet inlet 142 formed by sheet guide pair 143, the height of sorter inlet 142 being approximately the same as the operating height of copier discharge transport 106. In this way copies from discharge transport 106 pass into output 26 and are sorted thereby, it being understood that in this mode of operation, gate 109 of the processor 14 is in the down position.

A feed roll pair 145 is provided adjacent to the discharge side of inlet guide 143. Roll pair 145, which is driven in the direction shown by the solid line arrow of the drawings, serves to carry the copy forward into the unit 26. A movable inlet deflector 160 is provided just downstream of roll pair 145, deflector 160 serving when in the solid line position shown in the drawings to direct the copies to transport 131 and lower bin row 30.

To enable the copy sheets 51 to be fed to transport 130, and upper bin row 28, an elevator transport 162 is provided. Transport 162 comprises one or more endless belts 163 supported by roll pair 164 one or both of which are driven by suitable means (not shown). A series of idler rollers 165 are disposed in contact with the operating run of transport belt 163, rolls 165 serving to hold the copy sheets on transport 162. Vertical transport 162 is disposed just downstream of roller pair 145 and in operative relationship with deflector 160 such that deflector 160 when moved to the dotted line position shown in the drawings, serves to route the copy sheet 51 emerging from roll pair 145 onto transport 162.

A curved paper guide pair 168 is operatively disposed between the upper discharge end of transport 162 and the inlet to upper transport 130. Guide pair 168 serves to turn the copy sheets leaving transport 162 through an arc of approximately 90° to upper bin transport 130.

During use, copy sheets 51 leaving processor 14 enter inlet 142 of output 26 and are forwarded by roll pair 145 to either lower bin transport 131 or to elevator transport 162 depending on the position of deflector 160. Copy sheets routed onto transport 162 are carried upwardly thereby to upper bin transport 130. Copy sheets 51 from either transport 130 or 131 are routed into selected bins 128 of either upper or lower bins rows 28 or 30, respectively, through selective actuation of deflector 140.

It is therefore evident from the foregoing description that the output 26 is operable by means of controlling the deflector 160 and the deflector 140 in several modes. First, a stack mode may be provided in which duplicates of a single original are stacked in accordance with the desired number of copies in each individual bin sequentially until each bin is full, in accordance with the actuation of the deflector 140, and then the next successive bin is addressed. This operation can continue until the mechanism is full. When used to collate, the bins are filled sequentially. That is, each copy made is inserted sequentially into each successive bin one copy at a time until all the bins of an upper or lower bin row are full. In the preferred form of operation, output 26 will fill all of the bins in its lower module first and then proceed to its upper module. As will be evident from further description, a limitless collation operation may be provided in that the device will operate until its lower module 28 is completely full in accordance with the desired mode selection and then switch to its upper module. Appropriate sensing is provided in each upper and lower module 28 and 30 in the form of a photosensor or the like, sensing the presence or absence of documents along each upper and lower module bin row for indicating, after the completion of collation utilizing the lower module, that the upper module is free. In that event, the deflector 160 will shift its position from feeding the documents up along the elevator 162 and will fed documents directly into the lower module 30. When collation in the lower module 30 has been completed, appropriate sensing in the upper module will indicate that the upper module is now ready, having been emptied by the operator for sequential loading. The deflector 160 will then switch, permitting the copies to be fed into the upper module 28. Thus, a limitless collation operation may be employed utilizing the unit 26.

The collecting operation is set forth more fully in U.S. Pat. Nos. 3,709,485, issued Jan. 9, 1973, and 3,709,492, issued Jan. 9, 1973, and U.S. application Ser. No. 312,143, filed Dec. 4, 1972 all assigned to the assignee of the present invention, and the disclosures of which are incorporated by reference.

IV. DOCUMENT ORIGINAL HANDLING

In the exemplary arrangement shown, an automatic document handler designated generally by the numeral 18 and seen best in FIG. 2 is provided. As will appear, document handler 18 serves to feed one original document at a time from a supply of documents 181 into copying position on platen 34 of the imaging station 20 where a copy or series of copies may be made. Following copying, each document is automatically returned to the document supply 181 and the next document, if any, is brought into copying position on platen 34. As will appear, documents returned to supply 181 may be recycled or simply removed by the user when the copying program is completed.

Document handler 18 includes an inclined base section 183, the lower end of which swingably supports by means of shaft 184, matching left and right hand tray members 185. The trays 185 are substantially U-shaped when seen in cross section, each having a base 187, a top 188 spaced thereabove, and sides 189. A portion of the base 187 of each tray member is cut away at the upper end thereof to accommodate primary document feeder roll 190. The trays 185 are adjustable along shaft 184 to accommodate various size documents.

Document feeder roll 190 is rotatably supported under base section 183 on drive shaft 191 such that a portion of the periphery of roll 190 projects into the document tray area, base 183 being suitably apertured to accommodate the roll 190. Feeder roll shaft 191 is suitably supported for rotation and driven by suitable means (not shown) in the direction shown by the solid line arrow.

A pair of document limiting rolls 193 and 194 are disposed on the downstream side of feeder roll 190, rolls 193 and 194 functioning to prevent passage of more than one document at a time. Shaft 195 of lower limiting roll 194 is turned in the direction shown by the solid line arrow of FIG. 2 Upper limiting roll 193, which is supported from shaft 196, is arranged to be driven by lower limiting roll 194 so long as friction developed between rolls 193 and 194 remains above a predetermined setting. In the event of a decrease in roll friction, as occasioned by an attempt of two superimposed documents to pass therethrough, the upper roll 193 is turned in a document rejecting direction as shown by the dotted line arrow in FIG. 2 by a suitable drive means (not shown).

Documents emerging from limiting rolls 193 and 194 are carried forward by intermediate transport rolls 198 and 199 underneath curved document guide fingers 250 to platen transport 251. Transport 251, which may comprise a belt-type conveyor carries the document onto the platen 34 of the handler 20.

A register edge 252 is provided across the inlet side to platen 34, edge 252 serving to register or locate the documents in pre-set position on platen 34 for copying thereof. Platen transport 251 is reversed for this purpose after the document has been carried past register 252, reversal of transport 251 serving to move the document backwards to bring the document trailing edge into abutment with register edge 252. When copying is completed, platen transport 251, is again operated in reverse to carry the document backwards off platen 34, register edge 252 being retracted for this purpose by a suitable means (not shown). The document guide fingers 250 deflect or guide the returning document upwardly into the nip of a first return transport roll pair 254, roll pair 254 carrying the returning document between suitable return guides 256 and into the nip of a second return transport roll pair 258 and carrying the document back into tray member 185.

To maintain the return documents, which have been designated for convenience by the numeral 181A, segregated from documents 181 awaiting feeding and prevent inadvertent refeeding of returning documents 181A by the primary feeder roll 190 following feed of the last one of the original documents 181, a displaceable bail or separator bar 260 is provided substantially opposite to and above feeder roll 190. Bail 260 is supported from a rockable cross shaft 261. Shaft 261 is suitably journaled in the supporting framework of document handler 18, base section 183 thereof being suitably apertured to permit disposition of the bail support arms 262 therethrough. Suitable means (not shown) are provided to selectively turn cross shaft 261 and raise bail 260 out from under documents 181 resting thereupon and thereafter return bail 260 back onto the topmost one of the documents.

To help guide the returning documents into the document tray, as well as prevent documents from falling out of the tray, particularly when bail 260 is raised, a tray cover 263 is provided. Cover 263 is supported on the shaft 184 to enable the cover 263 to be opened for access to the document tray members 185 and 186 when loading or unloading documents.

A more detailed description of the original document handling mechanism described above is set forth in U.S. Pat. No. 3,697,063, issued Oct. 10, 1972, assigned to the assignee of the present invention, the disclosure of which is incorporated by reference.

V. COPY SHEET PATH

Jam detection and misfeed detection signals are derived from the processor path in accordance with activations of various sensors positioned at appropriate positions along the path line. Referring to FIG. 1A, a main misfeed switch 200 and an auxiliary misfeed switch 202 provide indications of misfed documents of copy paper from the main and auxiliary paper feeds respectively.

The copy paper is positioned by elevator control mechanisms under logic control. A system for elevator position and control is set forth in copending applications Ser. No. 214,297, filed Dec. 30, 197, now abandoned and continued in U.S. Pat. No. 3,806,242, issued Apr. 23, 1974, U.S. Pat. No. 3,768,806, issued Oct. 30, 1973 and U.S. Pat. No. 3,820,777, issued June 28, 1974, all assigned to the assignee of the present invention, and the disclosures of which are each incorporated by reference herein.

Document registration and timing of the processor operation is provided by the use of a registration finger arrangement 204 positioned downstream from the entry location of both main and auxiliary paper entry locations. The registration fingers 204 are designed to rotate once per pitch or per entry sheet and provide both registration function and timing functions. The timing functions are derived by means of a magnet attached to the registration shaft passing a stationary switch 206 mounted on the pretransfer transport, and energized by the passage of the magnet once per revolution. The registration finger arrangement described in greater-detail in copending U.S. applications Ser. No. 284,833 filed Aug. 30, 1972, now abandoned, and continuation filed application Ser. No. 424,258, filed Dec. 13, 1973 and now U.S. Pat. No. 3,790,271, issued Feb. 5, 1974, each assigned to the assignee of the present invention and the disclosure of which are each incorporated herein by reference.

The transport 85 includes jam detection switches 208 and 210 located approximately at the up stream and downstream portions respectively of the paper feed line. A post fuser transport jam detection switch 212 is positioned just down stream of the fuser 89. Referring to FIG. 1B as shown at the output of the processor, another jam detection switch 214 is positioned at the input to the unit 26 and a jam detection switch 216 is positioned at the output to the tray 24.

With reference to FIG. 1B, the processor further includes a sensing device 220 for counting copies delivered by the processor. The unit 26 includes a sensing device 222 in upper and lower collection bins to count copy paper fed into the collection module. Counters are coupled to each of these sensors for counting delivered copies.

With reference to FIG. 2, original documents are counted in accordance with the signals from a sensor 224.

A full description of the interrelationship of a collection unit and document handler with a processor is set forth in copending U.S. application Ser. No. 312,411, filed Dec. 5, 1972, assigned to the assignee of the present invention, and the disclosure of which is incorporated by reference herein.

Similarly, the collection module 26 and original document module 18 each contain jam monitoring switches at appropriate feed path points and can provide jam signals to the processor as will be set forth further below for stopping the processor operation.

VI. CONTROL FUNCTIONS

Figure 4:
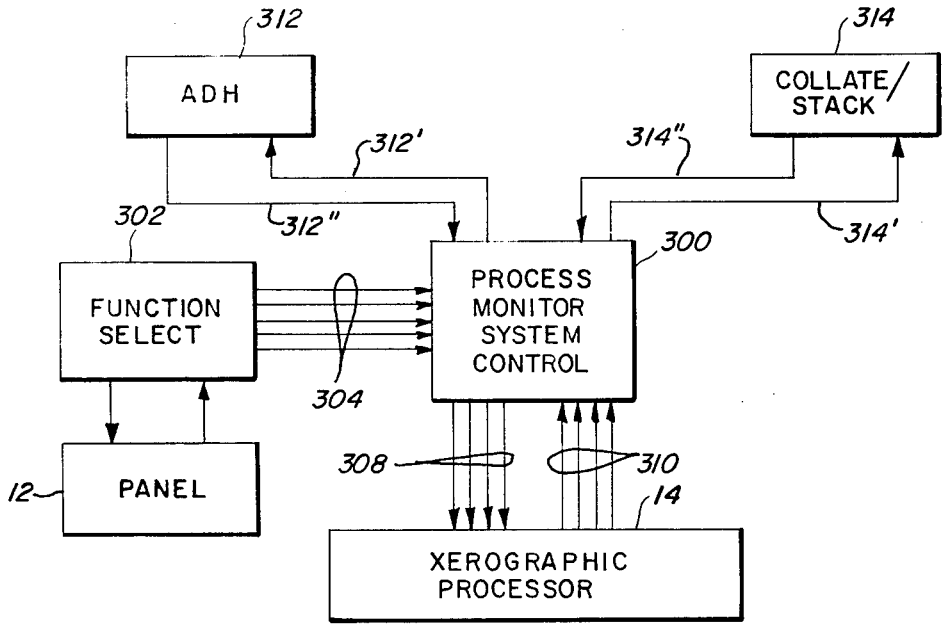
FIG. 4 is a block diagram of the electronic system utilized in conjunction with the processor of the present invention.

Referring to FIG. 4, a process monitor system control unit 300 establishes the interrelationship of the various machine operations to be controlled and sequenced as desired. Coupled to the process monitor system control 300 is a function selection input device 302 which provides a series of signals along the input lines 304 to the process monitor system control 300 for setting the system control 300 in accordance with the desired functions to be performed. The functions are performed in the xerographic processor 306 in accordance with the functions placed therein by the function selection unit 302. The operation of processor 14 is controlled by means of signals supplied thereto from the processor monitor system control 300 along the lines. Control 300, 308 and in turn monitors conditions within processor 14 to insure the proper operation of the processor in accordance with both the function desired and with certain overriding conditions by signals flowing along the lines 310. The control 312 for automatic document handler 18 receives informational input (via line 312) as to operation from the process monitor system control 300 and in turn provides (via line 312) response signals thereto. Similarly, the control 314 for sorter 26 also receives instructional signals from the processor monitor system control 300 (via line 314') and in turn provides (via line 314) response signals thereto.

Figure 5:
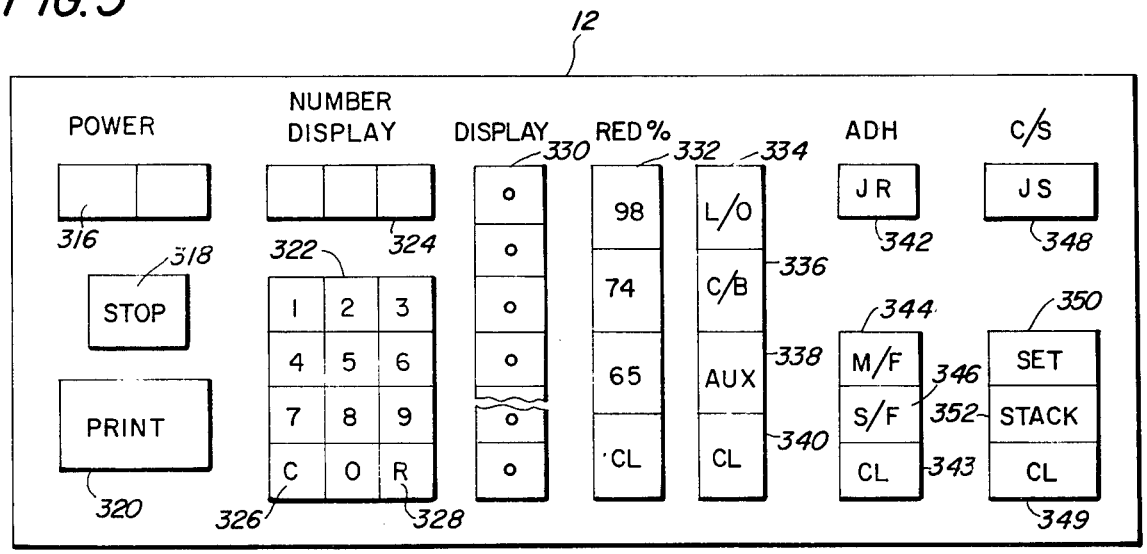
FIG. 5 is a view of the control panel of the present invention.

Referring now to FIG. 5, certain basic operations are provided by means of the control and display panel 12. The first operation a "STOP" button 318 is provided which allows the operator to stop the processor without removing power from the machine. A "PRINT" button 320 is provided for beginning the initiation of the print cycle.

A decimal keyboard 322 is provided with key positions 1 – 9 and zero for entering a desired number of digits into the machine for programming a desired number of copies. The digits entered are displayed on a number display 324, which, by way of example for use in the present invention, shows a three digit display. It should be evident, however, that greater or lesser numbers of digit displays may be employed, as may greater or lesser numbers of program copies. The keyboard also includes a clear "C" button 326 and a recall "R" button 328. The function of the clear button is to remove the number placed into the number displayed by activation of the keyboard 322. In the usual operation, after entry of the desired copy count by activation of the keyboard 322, activation of the print button will generate a sequence of numbers displayed in the display unit 324 corresponding to the number of copies actually made. If during the course of the operation it is desired to review the original number programmed into the keyboard 322, activation of a recall button 328 will recall the initially entered number from a prestored memory location and display it for as long as the key is depressed, in the number display 324.

A display area 330 is provided with a number of levels each containing an indicator description. Since the function of the process monitor and system control units 300 includes monitoring the xerographic processor 306 the use of the indicator display 330 provides various indications of monitored machine activity. The display actually consists of a series of lamps activated in accordance with the desired indication, and a printed transparency for providing a literal interpretation of the lamp condition. By way of example, the following indicator functions may be displayed in this area:

A. PROCESSOR MODULE — COPY PROCESSING

1. Quantity Completed

This function indicates that the number of copies run finally equals the original count entered into the keyboard 322. The indication is a lamp on condition from the time the print button is pushed until an indication is received that the last copy has been made, or when the job incomplete lamp lights. The latter will be described in further detail below.

2. Key operator

The processor 14 is enclosed within a cabinet which is kept locked for reasons of safety. The machinery inside is high power and contains high voltages, as well as being sensitive to internal manipulation by untrained operators. Thus, the call key operator function provides the operator with an indication that a sufficient condition exists which requires a trained operator with a key to unlock the process unit 14 for determining the reason for the internal malfunction. Thus, this lamp will light when a check paper path lamp lights or with a low paper indication or with a clean SOS indication or with a toner bottle/final filter full indication, or with fuser over temperature condition, or with interlock open lamp condition, or with check document path lamp (if the ADH is selected), or with the check paper path (sorter) lamp.

3. Job Incomplete

The job incomplete lamp will light if any one of several conditions occur before the last copy of a desired print run is delivered:

A Jam Condition in either the output 26, the automatic document handling mechanism 18, or in the processor 14; a misfeed condition, an elevator door open condition, a platen cover open condition, activation of the stop print button, activation of the unload sorter lamp in both upper and lower output modules 28 and 30. The job incomplete lamp is turned off and the function cleared by clearing the count in the programmer entered through the keyboard 322, or reactivating the print button.

4. Check paper

The check paper lamp will go on with a misfeed or with low paper, or with the elevator door open.

5. Check paper path (processor)

The check paper path lamp will light with an SOS jam indication, with a jam overrun indicating the registration mechanism described above is not operating properly, or with the interlocks open (during a print cycle), or with the fuser over temperature (during a print cycle) or with a transport jam indication, or with a fuser jam indication. In addition, a check for a prior jam condition during a prior machine cycle, which was not cleared prior to deactivating the machine is made on start-up.

6. Check interlocks

The check interlock lamp will light when any of the covers covering the various portions of the processor 14, the document handler 18, the optic section 20, or the control system 10 are open, or when the belt 37 mistracks on its rollers, or when the voltage regulation governing the operation of a logic circuitry fails, or when the interlock chain in either the processor 14, the output 26, or the automatic document handler 18 or optical unit 20 is open, of if the paper elevator fails.

7. Ready

The ready lamp goes on after the machine warm up or initialization period for the entire time that the machine is on, except for the period defined by the print time, or when the call key operator lamp is on or when the wait lamp is on, or when the check paper lamp is on (except in a misfeed situation).

8. Wait

The wait lamp goes on under certain wait conditions required during warm up. These conditions may occur after the machine is turned on and the print cycle activated and blocks the print cycle. Such conditions include the fuser warm up time, or the paper elevator rising time, or the optical lens system in motion. There is an additional time delay involved in the belt vacuum system and in any charging time necessary to activate jam detection circuitry employed in the SOS jam system.

9. Document glass cover open

This lamp will light when the platen cover over the platen 34 of the automatic document handler is open and when the print button is activated. The light may also be set to light solely upon opening of the platen cover.

10. Check document loading door

This lamp will light when the automatic document handler is selected and the automatic document handling loading door indicated as element 213 in FIG. 2 is open.

B. OPTICS

A reduction mode operation is included within the system operation, and is shown as an array of push buttons 332, each which includes an indicator lamp therebeside for indicating activation of any particular button. The optics mechanism utilizable with the present invention is disclosed in U.S. Pat. No. 3,829,209, issued Aug. 13, 1974 and U.S. Pat. No. 3,778,147, issued Dec. 11, 1973, the disclosure of which are each specifically incorporated by reference herein. Thus, the activation of the 98% button will position the optics for 98% scale reproduction as well as internally lighting the lamp indicating the selection of a 98% reproduction. In addition, a 74% reduction and a 65% reduction are also provided. The clear CL button clears selection of any of the foregoing three percentages and resets the system to a normal reproduction. This normal reproduction is manually variable within a narrow range, for example, from 100 to 102%, as desired.

Two reproduction functions are also provided, light original 334 (LO) and color background 336 (CB). Both of these functions are reproduction quality control functions. Activation of either the light original button 334 or the color background button 336 will also cause the lighting of the lamp therebeside indicating selection of that function.

As was described above, an auxiliary paper tray is also provided. Selection of the auxiliary paper tray (Aux) is accomplished by activating the button 338 which also includes an internal lamp indicating the selection of the auxiliary paper tray button 338.

Activation of the clear button 340 (CL) clears the selection of any of the previously selected buttons 334, 336 or 338, returning the system to a normal selection condition.

It should be noted, however, that the foregoing function indicators may be provided by means of separate indications on the indicator display 330 as well as lighting the appropriate pushbutton when activated.

The function selection panel also includes two areas related to the peripheral components employed with the xerographic processor. Thus, the automatic document handling mechanism 18 is provided with various function selections by means of the vertical column of push buttons appearing in the "ADH" column. The collate and sort mechanism also is provided with a plurality of selectable functions in accordance with the vertical column of pushbuttons underneath the column "C/S".

C. INPUT MODULE — DOCUMENT ORIGINAL

Referring first to the automatic document handling mechanism (ADH), when in one of the ADH modes, the display indicator 330 will provide certain displays.

1. Job Recovery

The job recovery of the display will light when a jammed conditon has occurred in either the paper collection 26 or in the processor 14, and not all of the copies corresponding to an original contained within the stack of originals in the automatic document handler had been flashed. In this case, since the machine works on delayed phase, the job recovery feature allows the automatic document handler to recycle all of the original documents contained therein until the last flashed original, prior to the jam condition, has been returned to the platen. Thus, lighting of the job recovery lamp indicates a condition which must be cleared, and the clearing of this condition i.e. the recycling of the automatic document handler, is effected by pushing the job recovery button 342 (JR). This aspect is covered in detail in copending U.S. applications Ser. No. 312,411, filed Dec. 5, 1972, the disclosure of which is specifically incorporated by reference.

2. Check document path

The check document path lamp will go on in the ADH mode when a forward or reverse jam occurs in the ADH. Raising the ADH transport cover will turn off the lamp.

3. Clear document — glass

This function indication will go on in the ADH mode when power is first supplied to the machine and the platen cover is closed or when a reverse jam occurs, or after the end of a manual job. Raising the platen cover again will turn off the lamp.

4. Multiple feed

A multiple feed indication will light when the activation of a multiple feed button 344 (MF) is provided. The multiple feed mode in the automatic document handler indicates that the automatic document handler will continuously feed a set (more than one) of original documents on a sequential basis until all documents of a set of originals are complete, without any manual intervention.

5. Single Feed Mode

Activation of the single feed mode pushbutton 346 (SF) provides an indication to the automatic document handler that only a single sheet is to be carried up to the platen for each activation of the print button after the previously fed original is complete.

D. OUTPUT MODULE — STACK AND COLLATE

The output unit 26 is also provided with a plurality of indicator functions.

1. Job Supplement

Activation of the job supplement button 348 (JS) will light an indicator lamp on the indicator display 330 indicating that the job supplement function has been selected. Selection is dependent upon further indications on the indicator display of an unload condition, indicating that the collection unit is otherwise filled to its initial capacity. The function of the job supplement is to allow further copy runs to be made without the necessity of unloading the collection unit from its initial capacity point. The lamp is turned off at the end of a multiple feed job, or by delivery of the last original, in a single feed mode, or by delivery of the first original in a manual mode.

2. Check Paper Path

This indicator lamp is provided directly on the output module portion of panel 12 and is lighted when an output jam occurs. Pressing the clear button 349 will turn off the lamp until this module is again selected, at which point the jam must be cleared or the check paper panel will again relight. To insure against sheets remaining at various points in the module, the covers are set such that raising all of the transport covers will turn off the lamp.

3. Unload

As was noted above in connection with function 1, the unload lamp will go on when all the available bins in the unit are filled when in the stack mode or after one module is filled during a multiple feed or after the last original of a single feed is delivered or if paper is present in any bin when the collator is operational. The clear button 349 will turn off the lamp until the output module is again selected. Clearing all paper from the output bins will also turn off the lamp.

4. Sets mode

Activation of the pushbutton 350 (SET) activates the sets mode in the output unit 26. In the sets mode, the output unit performs a collating function, each copy of an original being fed to a separate bin, and selected sequential copies of sequential originals being fed sequentially through the end of the output bins. Thus, the sets mode performs a collating function of one or more originals in the document handler 18.

5. Stack

Activation of the stack pushbutton 352 stack indicates to the output 26 that each bin is to be filled to its capacity by the copies produced by the processor 14 prior to the next successive bin receiving copies, until the number of copies programmed is achieved.

E. TIME OUT

As part of the machine operation, a time out feature is incorporated. After a predetermined period of inactivity, for example, a two minute period, all the special features, including auxiliary tray selection, color background, light original, and reduction mode, input accessory selection, output accessory selection, and the program selection are all cleared. This feature is inhibited in a hold mode, as for a jam condition, and is further time-reset for any activation during the time out period. The feature is advantageous in that it resets the machine for a new operator or operation and enhances indicator lamp reliability.

VII. SYSTEMS PROCESS — AN OVERVIEW

Figure 6:
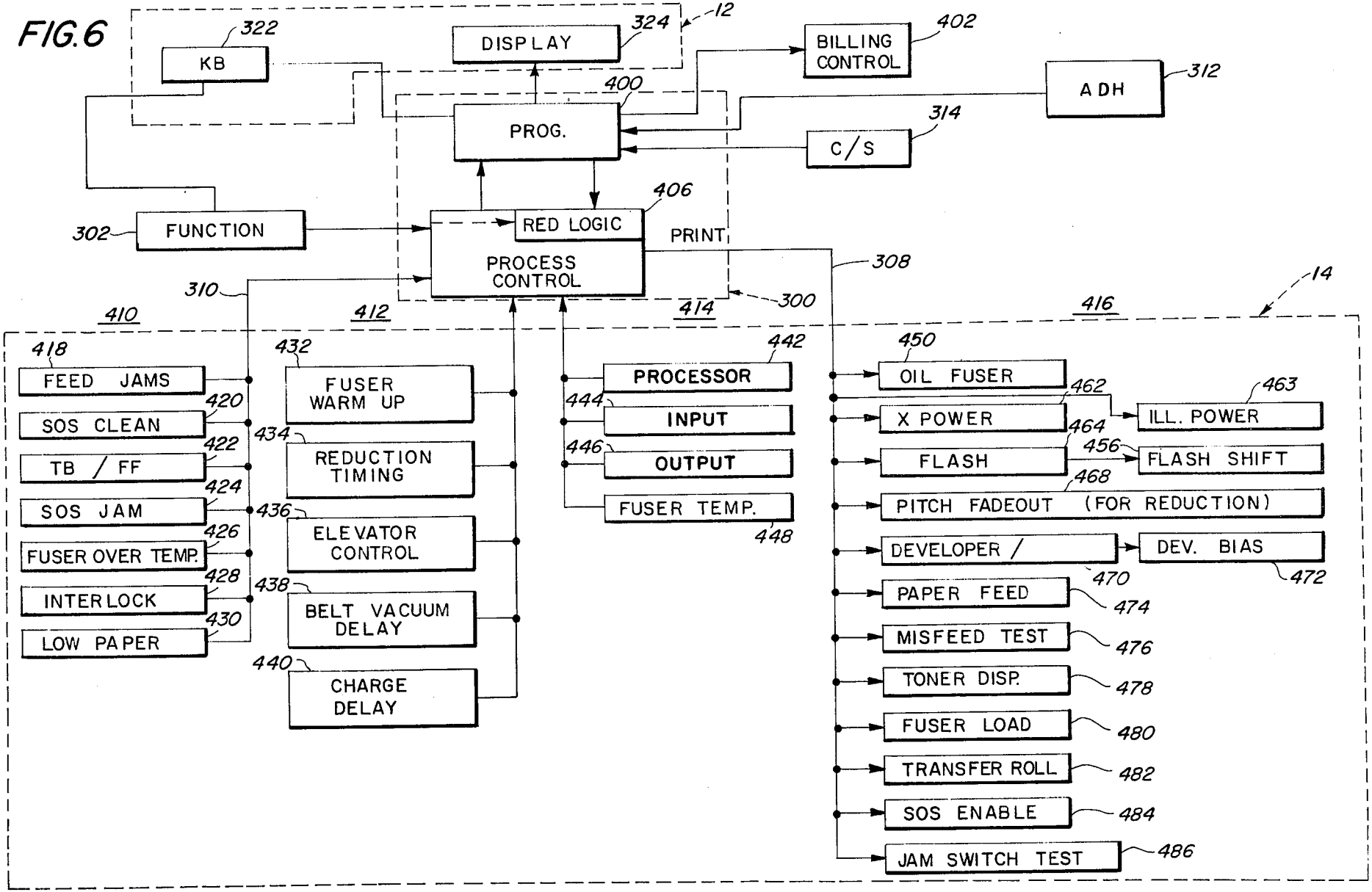
FIG. 6 is a generalized block diagram of the central electronic control system operable in accordance with the present invention.

Referring to FIG. 6, the process and monitor system control 300 is shown in greater detail. The control 300 includes a programmer 400 which responds to data entered from the keyboard 322 of console 12 for display on the display unit 324 and for effecting various operations in the billing control 402 and initiating a processor shut down sequence. Function control 404 provides activation to a process control 406 for interrelating the operation of the automatic document handling logic 312 and the collate and stack logic 314 either singly or in combination with the process control 406. It is, of course, within the framework of the invention to provide a process only function, in which event the automatic document handling and collate-stack modes will not be employed.

The processor control 406 provides information to the programmer 400 regarding both the number of copies started and completed and responds to information from the programmer indicating copies counted. The process control 406 can be separated into four basic functions identified as 410, 412, 414, and 416. The first function 410 relates to problem conditions, and is activated immediately upon activation of the process control by a power application. These problem conditions will have the effect of inhibiting the print operation until some affirmative action is taken by the key operator. This function is generally described as a pre-existing processor jam condition which had not been cleared up and is indicated schematically by the block 418. As will be set forth further hereinbelow block 418 provides an output signal to the process control indicating that a jam condition. The next condition is an SOS (Sheet On selenium clean 420, indicating that the mechanism 209 for detecting a sheet on belt 37 has fallen below its threshold level and must be cleaned. The toner bottle final filter signal unit 422 (TB/FF), indicates that either the toner reclaiming bottle is full, or that the machine filter is no longer sufficiently clean. An SOS jam 424 indicates that a sheet is on belt 37. The fuser overtemperature indicator 426 indicates that the fuser 89 has exceeded its maximum temperature level. The interlock 428 indicates that one of the cover doors is open or one of the other major safety conditions has not been fulfilled. The lower paper signal 430 level indicates that the selected paper tray does not contain sufficient paper. Each of these foregoing conditions signify a problem condition upon machine turn-on in response to a stored indication of a pre-existing condition, triggered during a prior cycle and not cleared on reactivation of the machine.

A second set of functions 412 is provided, these functions coming into play before activation of the print button to prevent the print cycle from beginning for a predetermined time period. For safety considerations, the wait condition inhibits activation of a print cycle until the predetermined period ends, and then indicates that the print button may be reactivated. For each of these conditions, it is not necessary that a key operator be called, only that the print cycle will be inhibited until each of the conditions have been satisfied. Thus, first condition 432 is that of a fuser warm-up. Obviously, the print cycle will not go into sequence until the fuser has reached its operating temperature. The reduction timing function 434 allows the lens mechanism to be placed in proper position in accordance with the desired reduction function selected. Elevator indicator function control 436 will provide a wait condition to allow the paper trays to be properly positioned for feeding before initiation of the print cycle. The belt vacuum delay 438 will also prevent the print sequence from being initiated until the vacuum has reached a condition sufficient to allow the belt 37 described in FIG. 1A to be drawn in, out of position with any external equipment which might otherwise scratch the belt. At this time, the process control can enable the print.

Finally, there are many circuit components in the system requiring capacitance charge or other slight time delay factors sufficient to allow any build up of circuit conditions to occur before proper operation can be achieved. This is a function of the circuit charge time delay 440. The belt vacuum delay and circuit charge time units 438 and 440 respectively are relatively quick operating devices, and will not normally light a WAIT condition lamp.

One other required start condition at this point is the existence of a programmed copy count greater than 0.

The next function is the safety feature function, 414. These features are continuously monitored prior to and during the print cycles and can result in immediate machine shut down in accordance with their activation. Thus, an interlock open 442, indicating that a door has been opened or the like, will result in immediate machine shut down. The opening of paper doors, however, will not result in immediate machine shut down, will provide a signal from the unit 444 which will inhibit the operation of the print. This would include the opening of the elevator door and the opening of the platen cover. The indicator 446 provides a jam indication to the process control for stopping the print operation in accordance with the particular location of a jam, some jams creating an immediate shut down such as a fuser jam, other jams merely causing the print cycle to cycle down. Finally, a fuser overtemperature condition 448 is continually monitored during the process.

The final function is the process itself, shown under the heading 416. These process features occur once the process control has cleared the print function. The operation shown in 416 includes the functional activations provided by the process control unit 406 and are not necessarily performed sequentially. Thus, print cycle activation includes means for activating the oil fuser dispenser 450 for applying oil as needed to the oil mechanism of the fuser. A xerographic power circuit 462 and illumination power circuit 463 apply power to the xerographic process equipment. As shown in FIG. 8A, the xerographic and illumination power supplies are turned on in staggered fashion, one pitch apart, to prevent large transient line loading. A flash circuit 464 and flash shift circuits 456 apply triggering pulses to fire the flash unit. The print cycle also activates a pitch and edge fade circuitry 468. Developer motor 470 and the developer bias control circuit 472 are also activated in accordance with the process control. The process control further activates paper feed cycles when the image is properly positioned upon the belt for reproduction. In accordance with the paper feeding function, a misfeed test activation 476 is provided. In accordance with the development of the image, toner dispensing is also given by the process control 478. The fuser load circuitry 480 is also controlled by the processor, as is the transfer roll load and voltage circuitry 482.

The process control timing provides appropriately timed signals for enabling the SOS sensing system through the enable circuitry 484 for sensing failure of the sheet stripping from the belt 37, as described above.

As part of the process, continuous jam detection is provided. Included in the jam detection is the monotoring of jam switches for presence and absence of paper at appropriate time moments. This is accomplished by providing sample signals to the jam switch test circuitry 486.

VIII. SYSTEM PROCESS — DETAILS

Having set forth a generalized description of the operation of the machine process, with reference to FIGS. 1–6, a more detailed description of the preferred form of process control utilized in accordance with the present invention is set forth below.

It is an important aspect of the present invention to provide high quality reproduction processing at a relatively high speed. Several steps may be taken in the course of the process which improves the quality of the reproduction. Thus, at the beginning of the process it is desirable to cycle belt 37 past cleaning brush 57 for a sufficient portion of its length to provide the greatest possible quality without unduly prolonging the waiting time, and yet maximizing the throughput or quantity produced. Since there are several cycling conditions, a process timing circuit is designed to take various start conditions into account in determining the duration of cleaning necessary to achieve the desired quality.

It is basic to the operation of the machine that timing is actually controlled by the copy sheet registration system and thus is a factor proportional to the travel distance of copy sheets through the machine and not to a timed machine standard. It is thus apparent that the operating condition is known at any given moment in the cycle without regard to timing of an external nature since the timing cycle is preset and is initiated with the presence of each copy sheet entered into the feed path for reproduction. In addition, at the end of the print cycle whether induced purposely by the programmer or whether created as a result of a malfunction such as a misfeed condition, a certain cycle down sequence or operation is established that will prepare belt 37 for the next copying cycle.

As is evident in FIG. 1A, copy sheet registration is produced by means of the registration fingers 204 which perform a full rotation for each copy sheet fed into the machine. A mechanical aspect of the construction of this registration system is disclosed more fully in U.S. Pat. No. 3,790,271, issued Feb. 5, 1974 copening U.S. applications, Ser. No. 284,833, filed Aug. 30, 1972, now abandoned, continued in continuation application Ser. No. 424,258, filed Dec. 13, 1973, U.S. Pat. No. 3,804,507, issued Apr. 16, 1974, all assigned to the present assignee and incorporated herein by reference. Rotational speed of the registration fingers is an indication of the speed at which copy sheets are fed into the machine. For purposes of explanation and by way of example, it will be assumed that the copy sheets are fed into the machine edgewise with their length perpendicular to the path of travel. The maximum width of a sheet of paper fed into the machine also defines the maximum width of an image frame. This distance, referred to as a pitch, occupies a certain proportion of the total photoreceptor belt length. By way of example, if a pitch is 10 inches and the belt possesses a total outside circumference of 65 inches, the belt will therefore be 6½ pitches long. It wil thus be evident that the rotation of the registration mechanism 204 in cooperation with the pickup 206 provides a registration pulse once per pitch.

The process timing control is shown in FIGS. 7A, 7B, and 7C, which together present the logic implementing the timing. FIGS. 8A and 8B, referred to as the timing diagram, illustrate the relative timing of various logic and station operations for a two copy run, wherein a first and second sheet are supplied through the process. The timing diagram is intended as exemplary only, illustrating the relative relationships of timed events, and is not intended to be limiting.

The running of the process thus uses a timing scheme which relies upon a series of machine generated pulses, the frequency of which are directly proportional to the main drive speed, and which are decoded into output counts used for timing machine events. Decode matrix 504 is reset to 0 once per pitch in accordance with the reset pulses provided by the registration mechanism 204. The pitch reset signal provided from the registration mechanism 204 also clocks bits of information through a shift register 512. The shift register stage outputs 512*a* . . . 512*d* are used in conjunction with the decode matrix 504 to control all time dependent machine events including cycle up, cycle down, and jam conditions. The jam detection condition, to be described in further detail later herein, utilizes a scheme of monitoring the progress of copy paper once per pitch throughout it travel in the machine. Utilization of the jam detection sensors in the process, in the positions as illustrated in FIGS. 1A and 1B, and also provided within the automatic document handler and sorter mechanisms, provide condition responses indicating the presence or absence of paper at proper timed moments. Failure of a specific condition to occur will create machine shutdown/cycling conditions in accordance with the nature of the jams.

Referring now to FIG. 7A, a logic circuit detail of the timing mechanism is illustrated. The machine clock pulses used to generate the pulse train into the decode matrix described above are provided from a source 500 which will provide an accurate indication of the speed of the belt 37 as it rotates within the framework of the machine. Source 500 may be derived from a gear driven by the shaft of the motor M driving the photoreceptor belt 37 and using a magnetic pickoff to provide the clock signal for the machine. Such a mechanism, illustrated generally in FIG. 1A, is illustrated in greater detail in U.S. Pat. No. 3,790,271 issued Feb. 5, 1974, assigned to the assignee of the present invention, the disclosure of which is incorporated herein by reference. The clock pulse signals from source 500 pass via digital shaping circuit 502 which provides the clock pulses in proper digital form to a decoding matrix 504. The output of the decoding matrix is a plurality of lines indicated as 506.

The clocking system is designed to provide a fixed number of pulses per pitch. By way of example, it may be possible to define a pitch as consisting of 920 machine pulses. It will of course be evident that the number of pulses defining a pitch may be varied, and the example given is not intended to be limiting. The number of pulses chosen for the pitch cycle may in fact be dependent upon the intra-pitch resolution required for timed events within each pitch, since the decoding matrix 504 will provide output signals in predetermined combinations in accordance with the input clock sequence so as to provide a certain number of output conditions which may be employed to govern the timing of machine functions. The decode matrix 504 is designed to provide logic combinational outputs on various of the output lines 506 in accordance with the particular pulse within a pitch. Thus, for example, if a pitch consists of 920 pulses, then output lines a-c provide a signal for count number 123 of 920, and so on. Obviously, other variations, permutations, and combinations of sequences may be derived utilizing different schemes of decoding.

As was noted above, the decode matrix 504 is reset once per pitch. The reset condition is applied to the reset input R of the decode matrix 504, and serves to reset the decode matrix condition to 0 for recounting clock pulses. Reset signals are provided once for each registration cycle, the signal being provided as an analog signal from the pickup 206 to the pitch circuit 508, for conversion and shaping into an appropriate digital signal. The signal is in turn applied as a high gating signal to the input of an OR gate 510. The resulting high output from the OR gate 510 is applied to the reset input of the decode matrix 504 and resets the matrix. The decode matrix 504 also resets when the machine is not in a Print condition (i.e. in a $\overline{\text{PRINT}}$ condition. This is accomplished by applying a PRINT signal to the other input of the OR gate 510. In a not PRINT condition, the output of the OR gate 510 will go high, thereby resetting the decode matrix 504.

Central to the operation of the processor timing is the shift register illustrated generally as 512. The shift register is divided into several sections, as designated by subtended alphabetical letter designations. The function of the first section **512*a* provides a quality control function for the processor photoreceptor in that it introduces a predetermined amount of delay into the processor after energization of the print button but prior to initiation of the print sequence. For purposes of illustration, the section 512*a* may provide for a three pitch delay from either a fresh start up of processor 14 after a relatively long period of inactivity, during which the machine processing levels have fallen to below minimum operating requirements, or a situation where the machine is starting after a paper (JAM). Here the delay represented by the section 512*a* any residual image on the photoreceptor belt to be cleaned. The section 512*a* will, however, be bypassed to omit this delay in other startup conditions condition. This is accomplished in logic in response to INITIALIZE or JAM signals to inverters 514 and 516 respectively, and the AND gate 518. Thus, if either an initialize signal or paper jam signal is present, the output of the respective inverter 514 or 516 will be low, thereby blocking the AND gate 518. In this event, the section 512*a*, which may conventionally consist of two or more sequentially connected stages of a shift register, will have presented at its input a print signal which will be shifted with each respective pitch pulse supplied from the pitch circuit 508 to the input of the section 512*a*. Thus, for example, if two stages are included within the section 512*a*, it will be evident that a delay equal to at least 2 and as many as 3 pitches will occur before an output signal will be applied along the line 520 from the section 512*a*. In the absence of an INITIALIZE or JAM signal to gate 518, section 512*a* is bypassed. The signal from AND gate 518 will also be applied to a reset input on the section 512*a*** thereby setting the stages therein for the next pulse application.

The next section **512*b* includes two stages Q1 and Q2, each of these stages also receiving a shift input from the pitch circuit 508. The function of the section 512*b* is to provide additional delay of a predetermined number of pitches. The register 512*b* is bypassed under the condition that the machine is still printing, i.e. The PRINT signal is present, but not in print mode. This indicates that an incompleted cycle down operation has not been completed before the print control was reactivated. This will be explained in further detail below. The bypass is controlled by gate 522 which responds to the existence of a print input and an inverted print mode input indicating the presence of the printing procedures and the absence of a print mode and to effectively bypass the delay built into the section 512*b* by applying the signal along line 520 through the gate 522 to the output 524 of the section 512*b*. The outputs of the stages Q1 and Q2 of section 512*b* are used to control certain machine functions. Assuming the stages have not been bypassed, the output of the Q1 stage of section 512*b* is employed to energize the fuser oil dispenser circuit 450. Referring to FIG. 3, the purpose of the circuit 450 is to energize the applicator roller 96 illustrated in that figure for applying oil to the wick. The output of the second stage Q2 of the section 512*b* applies energization to the circuit 462 for applying power to certain control voltage xerographic functions, including charge, pre-transfer and pre-clean corotrons 61, 72; 60 respectively, a magnetic brush rolls 49 bias to the developer, selecting a higher developer bias when the developer is not running etc. Power supply for other xerographic functions is also energized, but remains subject to additional timing control as will be described further below. It is noted that the pre-transfer and pre-clean corotrons 72; 60,** as well as the presence of the developer bias, serves to aid in the cleaning operation by reducing residual xerographic charge during the initial start-up phase.

The next stage of the register is stage 512*c* including Q3 and Q4. The Q3 stage responds to an input pulse along the line 524 for activating the illumination power supply 530, charging the lamp exposure circuits for later triggering as will be set forth. The Q4 stage provides an additional stage of delay, allowing full charging of the exposure circuit, the stages Q3 and Q4 together representing at least a 2 pitch delay in a start-up cycle under any conditional input. The final stage of the shift register 512*d* includes stages Q5 through Q17. Additional stages Q18 through Q25 are also provided for use in connection with a manual document handling cycle as will be set forth in further detail below. The output from the stage Q4 is applied to a gate 532, which inhibits the output pulse from the stage Q4 when a signal from the automatic document handler 18 is applied to the gate 532 indicating that an original is not in proper position on the platen to be flashed. Upon removal of the inhibit condition, stage Q5 of section 512*d* is energized, providing a signal to the flash trigger 464.

As is evident from the timing diagram of FIG. 8A and 8B, there are two conditions necessary to energize the flash trigger 464. Under the first condition, the flash trigger is energized coincident with the application of the Q5 pulse. Under the second condition, an appropriate energization signal applied along line 536 indicates to the flash trigger that the 98% button mode of the reduction 322 has been selected on the function select panel 12. In this condition, the flash shift 456 responds to provide a flash slightly displaced from that provided by flash trigger 464, corresponding to a count from the decode matrix of 008. The count condition is applied along the line 538 and controls actuating of the flash trigger 464 under application of a pulse along the line 536 to provide the slightly delayed flash signal.

The timing of the decode matrix lines 506 thus enables a flash condition in the 98% mode to occur after a slight delay. This delay displaces the ultimate position of the image on the paper. Clearly, by proper selection of flash trigger timing control, any desired margin shifting of the image relative to the paper may be realized. In the reduction mode aspect of the present invention, it is conventional to center the reduced image mechanically by means of controlling the optical system in accordance with the selection of each reduction mode. In regard to 98% mode, however, it is somewhat difficult in view of the narrow tolerances to position the framework of the optical system for recentering in accordance with a 98% selection. Therefore, with the 98% selection, recentering is done automatically by means of triggering the flash in a slightly delayed sequence by means of the decode matrix control.

To provide additional transitional inhibit, the output Q4 of the stage 512*c* may also be fed to flash trigger as an enable signal preparing the flash trigger 464. upon receipt of the Q5 signal, to effect the flash operation. The flash trigger 464 also provides a flash increment signal indicating the flash of an original. The purpose of this signal will become more evident from later description.

Since the pitch fade out lamp station is the next station encountered by the image after being flashed on the photoreceptor belt, the same stage Q5 is employed to effect pitch fade out lamp timing in accordance with the selected reduction mode. As was described above in connection with the reduction mode optics, normal full size copying mode is 101% and it is initially selected with power on. It may also be selected by depressing the clear reduction push button (CL) on the control console function panel 12. Magnification on full size copying mode is adjustable manually from 100 to 102% as was stated hereinabove. Three reduction modes are provided; 98%, 74% or 65%. In all modes, where borders are created, pitch fade out lamp 546 is employed to erase the areas between images while edge fadeout lamps 547' are used to erase areas along the image sides created along the edge of the paper. Pitch fade out is accomplished by selection and energization of the pitch lamp 546 for a predetermined time period causing blanking of the leading and trailing edges of the document. Thus, referring to the FIG. 7B, the signal reflecting selection of an appropriate mode for activating the pitch lamp 546 is provided along the line 540 to the reduction mode control logic 542 of the pitch fadeout circuitry 468. A full disclosure of the reduction mode control logic utilizable in accordance with the present invention is set forth in U.S. Pat. No. 3,778,147 issued Dec. 11, 1973, the disclosure of which is incorporated by reference herein, and which is assigned to the assignee of the present invention. As is set forth in said patent, the reduction mode control logic 542 records the condition of the selection mode and applies the appropriate energization to the pitch fade out lamp timing circuit 544. The timing circuit 544 selectively energizes pitch fade out lamp for a desired time period in accordance with the degree of fade out required. As is noted in the timing diagram, it is the output of the stage Q5 of the shift register section 512*d* which provides the enabling condition to the pitch fade out lamp timing circuit 544. The pitch fade out control is precisely timed by turning lamp 546 off at a preselected count condition on a signal from the decode matrix along lines 506 to pitch timer 544, and turning the lamp back on again at a precise moment within pitch timing represented by the Q5–Q6 time interval. The period of time in which the lamp is off represents the presence of an image passing beneath the lamp. For the remainder of time that the lamp 546 is on, the areas between successive images are blanked.

The output of the pitch timing circuit 544 is applied directly to control energization of a pitch lamp 546, shown in FIG. 1A.

It is noted that the pitch lamp 546 is energized between images for all modes. Variation of the reduction modes only affects the timing cycle of lamp 546.

The optical system also includes edge fade out lamps 547' in FIG. 1A, for blanking out the edges of the photoreceptor in accordance with jam i.e. jam switch 212 width of the copy sheets fed from trays 54, 55. The width can be sensed directly by the adjustment of the paper tray sheet width guides (not shown) to trigger one or the other of the edge lamps 547' for two differing widths. Obviously, additional lamps for more variation can be employed.

The use of pitch and edge fade out presents undesired development, aids the cleaning system, and preserves toner usage.

The pitch fade out timing circuit 54 energizes the pitch fade out lamp 546 in accordance with the desired time frame as indicated in the timing diagrams. Each exposure requires a certain degree of fade out in order to eliminate borders, the pitch fade out being more pronounced where the reduction is greater. For situations wherein extremely narrow border would remain, for example in the 100% reproduction mode, the pitch fade out timing circuit 544 can be provided with vernier adjustment for more precisely controlling the moment of turn off and turn on corresponding to the image field. Pitch fade out timing circuitry and vernier adjustment utilizable in accordance with the foregoing concept is disclosed in coassigned and copending U.S. application Ser. No. 323,690, filed Jan. 15, 1973 now U.S. Pat. No. 3,860,338, issued Jan. 14, 1975, the disclosure of which is incorporated by reference herein.

The next activation on the timing diagrams is the developer motor 548 and developer bias control 472. The developer bias control, as was noted above, was originally activated in accordance with the activation of xerographic power supply 462 at Q2. As part of the cleaning function, it is desirable that the developer bias be raised to its maximum level until actually employed for developing. For example, the developer bias utilizable in accordance with the present invention may be set at 450 volt level. The development bias control circuitry 472 responds to input signals in accordance with the disposition of color background button 336 and the light original button 334 on console 12. Actuation of either button 334 or 336 actuate switching circuitry within the development bias control to apply different potential levels to the magnetic brushes 49 contained within the development station 46 of the xerographic processor 14. By way of further example, it may be assumed that the normal development control bias is 250 volts. Activation of the color background button 336 will set the development bias at 450 volts, minimizing undesirable image background, and thereby relatively enhancing the useful portion of the image desired to be reproduced. On activation of button 334, development bias of 180 volts may be provided.

The developer motor 548 and timing of the developer bias to brushes 49 are both controlled off a timing circuit 552 of developer circuitry 470. The purpose of the timing is to compensate for the length of the developer housing as well as the lead time required to get the developer motor 548 to speed up for proper operation. For example, if the developer housing is 14 inches long, and a 6 inch lead time for development motor operation is required, a total of 20 inches of lead time should be provided. The 20 inch lead time in accordance with the present invention translates into two pitches. Thus, a two pitch timing may be provided by taking the outputs of Q5 and Q6 from the shift register stage **512*d* through an OR gate 554 to a timing circuit 552. The timed circuit 552, which may be a flip-flop, will thus remain enabled for duration defined by both pitches Q5 and Q6 through the OR gate 554. The duration of the timing signal having been fixed, it is now only necessary to trigger the timing circuit 552 in accordance with the desired position within the pitch. This is done by means of an appropriate input applied along the line 556 and derived from the control lines 506 of the decode matrix 504. As shown the timing diagram, the interval corresponding to a count of 418 is selected for both the turn on and the turn off of the timing circuit 552.** It should be noted that the function of the timing, as in the previously described functions, serves merely to shift the duration of the control within the pitch in which the operation takes place.

The timing system now initiates the feed operation causing the copy sheet to be fed from either the auxiliary or main tray 54, 55 along the transport 70 or transport 79 to transport 70 towards the nip 50' formed by belt 37 and 57. A start feed circuit transfer roll 52 responds to the output Q6 of the shift register stage **512*d* of paper feed circuitry 474 to supply an output actuating paper feed timer 558 in accordance with the receipt of the timing pulse from lines 560B or 560A from the output lines 506 of the decode matrix 504. The feed circuit 557 operates in accordance with the selection, using buttons 344 and 346 of console 12, of either the main or auxiliary paper trays 54, 55 to provide two different timing signals 560B or 560A. As will be noted with reference to FIG. 1A, slightly different path lengths exist from the main tray 54 and auxiliary tray 55 to the registration mechanism. The timing of the respective feeds must therefore compensate for the different path lengths to insure that paper fed from either tray will coincide with the image on the belt. Thus, in the selection of the main tray, the enabling of the circuit 557 by the input Q6 will cause the feed circuit to be energized by the receipt of the next 694th timing pulse designated as 560B received during that pitch by the feed circuit 557, and turned off at approximately 180 milliseconds later, or 360 clock counts received by the clock input to the circuit 557. This time duration will result in energizing the power circuit 562 to the main tray stepper motor 564 to drive the main paper feed roller 56 and transport 67 for that time period. Should the auxiliary tray 55 have been selected, signal 560A would enable the feed circuit 557 to respond to the 895th pulse for turning on, and after the same period represented by 360 clock pulses, or approximately 180 milliseconds, for turning off. Power circuit 562 controlling the auxiliary paper feed motor 566, which drives auxiliary paper feed roller 76 and transport 77. The stepper motor circuit 562 is selected by the signal from console 12 feed motor along an input select line 568. The feed circuit 557 may be formed of a pair of AND gates 570A and 570B, each having a first input signal Q6 and timing lines 560A and 560B applied as second inputs. The gate 570A is enabled by a main tray signal and the gate 570B by an inverted auxiliary tray signal. Thus, setting Q6 and either main (570A) or auxiliary (570B) inputs will result in an output to the paper feed timer 558 in accordance with the timing along the respective line 560A** or B.

The paper feed timer 558 also initiates a misfeed test function. The misfeed test function is a sampling of the misfeed switches 200 and 202 positioned at the output of the main paper tray and the auxiliary paper tray, respectively. As shown in the timing diagram, the main misfeed switch test occurs during the Q7 pitch and the auxiliary misfeed switch also occurs during the Q7 pitch. It should be noted, however, that these tests are not related to the timing of the shift register, but rather occur after a fixed time delay indicated as T1, FIG. 8A, B timing diagram, after the energization of the appropriate feed rollers. This time delay is set such as to be sufficient to allow paper to have been removed from a stack by the feed roller 66 or 76, driven into the paper transport 70 or 79, and activated the misfeed detection switches 200 or 202. Switches 200, 202 may be photoelectric or microswitch arms sensed upon receipt of the physical presence of the paper, or any other conventional sensing means. The misfeed test function will be described in greater detail in connection with the jam system described in FIG. 12B.

At the end of the time period T1, the appropriate misfeed test signal is supplied to the misfeed test circuit 476 which may consist of a conventional gate. The auxiliary and main switches 200 and 202 may be commonly coupled through an OR gate 574, the output of which forms the other input to the gate included in the misfeed test circuit 476. If either the auxiliary or main switch 200 or 202, depending upon selection, has not been appropriately energized, misfeed is indicated to the misfeed gate 576. The output signal from the misfeed gate 576 in such case, labeled misfeed cycle out, is returned to the paper feed timer 558 to disable the stepper motor power circuit 562, thereby preventing any further feeding of sheets, and also to the developer timing circuit 552 for turning off the developer motor and allowing the developer bias to switch back to its highest potential level. At the same time, the misfeed cycle out signal is supplied to the pitch timing circuit 544 for turning the pitch lamp 546 on immediately. Finally, the misfeed cycle out is applied to reset the stages Q5, Q6 and Q7 of the shift register stage 512*d.* The effect of these operations forms the equivalent of an abort signal. Since the operation in the system is such that a plurality of images will already have been formed on the process belt relating to subsequent documents which have not been fed, the effect of the operation thus described is to try to remove the residual images by activating the pitch lamp and high bias control voltage, and to reset the flip-flop stages Q5, Q6 and Q7, and prevent the further feeding of paper from the paper tray. The resetting of the flip-flop stages Q5, Q6 and Q7 removes the effect of the jam test signals from the shift register corresponding to those images, and will be further described in connection with the jam system. The misfeed test effectively supplies to the system a signal indicating that the last sheet has been fed, resulting in a cycle out condition, thereby permitting all prior sheets including the last to be fully processed and fed out without declaring a jam condition.

The misfeed cycle out condition thereby provides a convenient reset line within the process control timing system for assistance in cancelling the effects of a flashed image or series of flashed images which is desired to be overcome. Thus, the use of the gate 576 may be expanded to include other functions. As shown, the inputs to the gate 576 includes a first logic signal along the line 580 representing print. If the machine is not in print, the effect is to place a misfeed cycle out condition along the misfeed cycle out line, since that should be the normal condition of these stages during this time. In addition, a series of jam inputs 582 are provided, corresponding to the jam of the transport system i.e. switch 208, a paper jam at the output of the processor i.e. jam switches 214, 216. i.e. jam switch 212 each serving to generate a misfeed cycle out condition through the gate 576, giving rise to the same sequence of operations as described above.

Toner control is also effected as a timed operation. The toner control sensing is a measurement of toner density relative to developer carrier and may be measured in any appropriate manner. One suitable form of measurement and control utilizing a photoelectric system is illustrated in U.S. Pat. No. 3,727,065, issued Apr. 10, 1973. The developer motor 548 requires operation for a certain minimum time period prior to the time an accurate measurement of toner quality may be made. For purposes of example, the developer motor 548 may require running for $\frac{3}{4}$ of a second until a measurement may be appropriately taken. Thus, since the developer motor was turned on as evident in the timing diagram at the 418th pulse or approximately half way into the pitch between Q5 and Q6, use of the leading edge of the Q7 state of the shift register stage section 512d may be employed as a sample window initiation for making a toner quality measurement. Thus, as shown in FIG. 7*b,* toner dispensing circuit 478 includes an AND gate 584 having the pulse provided from the stage Q7, and the output signal from the development timing circuit 552, indicating the presence of a running signal on the developer motor 548 inputted thereto. With both of these conditions, the AND gate is now set to receive toner quantity measurement along its toner quantity input line. An indication of toner quantity needed will be a high input along this toner quantity line, thereby providing an energization pulse through the gate 584 to the motor drive 586, in turn driving the toner motor 588, thereby dispensing additional toner into the developer housing until the toner quantity input to the gate 584 indicates sufficient toner at which time the gate 584 is disabled, thereby disabling the motor drive 586 and the motor 588. The turn off of the toner quantity sample circuit may be effected merely by allowing the normal timing to the developer motor timing control circuit 552, as derived from a decode matrix 504 along the lines 506, to go down, thereby turning off the sample window established in the gate 584. As shown in the timing diagram, the pulse occurs at the 418 point corresponding to the 418 pulse turning off the developer motor.

It should be noted that at Q7, an additional energization signal is provided to the fuser oil dispenser 450. The Q7 is chosen so as to lead the time the first sheet appears at the fuser nip by a time period sufficient to allow the oil to be absorbed into the wick for use. In this case, the delay is about $1\frac{1}{2}$ seconds. The applicator roller is designed to meter sufficient oil to the wick in the fuser system such that one pitch duration is sufficient for each copy sheet. Thus, at the timing diagram, two pitches are provided corresponding to the two sheets which are fed from the paper trays.

It will be recalled from the description of FIG. 1a that the transfer roller 52 is maintained out of contact from the processor photoreceptor 37 until it is desired to actually be employed. Thus, some provision must be made within the timing sequence to enable the activation of the solenoid 52*a* of transfer roll circuitry 482 for placing the transfer roll 52 into operative contact with the photoreceptor surface 37 and applying the appropriate potential.

The transfer roll clutch is placed in operation by virtue of the timing signals derived from the stages Q7 and Q8 of the shift register section 512b. These signals are applied through an OR gate 590 for setting the data flip-flop 592. A timing signal, derived from a line 506 corresponding to the decode matrix 504, is applied along the line 594 to trigger the data flip-flop 592 at the appropriate timed interval after the beginning of a leading edge of the pulse derived from the Q7 stage of the shift register section 512*b.* As is evident from the timing diagram, a timing signal is used to delay the start of the transfer roll clutch mechanism 52A until approximately half way down into the pitch between Q7 and Q8 corresponding to a 450 count. After the end of the Q8 signal, the output of gate 590 goes low and upon receipt of the next timing signal along the line 594, the output of the flip-flop 592 also goes low. During its high period, the output from the data flip-flop 592 activates the solenoid drive circuitry 596, which in turn activates the solenoid 52*a* for placing the transfer roll down onto the processor belt 37.

The data flip-flop 592 is reset upon receipt of two conditions, the first condition indicating the machine is out of print and the second condition indicating some form of transport jam. These conditions are applied along the lines 597 and 598, respectively through an OR gate 599 to the clear input of the data flip-flop 592, thereby resetting the data flip-flop.

After the application of the transfer roll to the processor, the transfer roll bias may be applied. This is accomplished in FIG. *7c* by the use of a data flip-flop 600. The data flip-flop 600 is enabled by the application of the pulse from stage Q8 of the shift register section 512*d*. The data flip-flop 600 is then triggered by the next successive timing pulse applied along the line 602 corresponding to a timing signal count of 208. It is noted in connection with the transfer roll bias application however that it is desirable to apply the transfer roll bias precisely upon the leading edge of Q8. Thus, the Q8 signal is also supplied along the line 604 directly as an input to the OR gate 606. The signal passes the OR gate 606 and thereby energizes the voltage control circuit 608, applying the proper bias voltage to the transfer roller 52. At the end of the Q8 signal, the input enabling the flip-flop 600 goes down, and the next successive timing signal applied along the line 602 causes the output of the data flip-flop 600 to go down. Since the Q8 signal is no longer present, the input along the line 604 to the gate 606 is down and, since the flip-flop 600 output is down, the input applied from the high side of flip-flop 600 to the input of the gate 606 is also down, thereby removing voltage control and the resulting bias to the transfer roll. The data flip-flop 600 is reset when the processor is no longer in print by means of a $\overline{\text{print}}$ signal applied along the line 610 to the reset input of the data flip-flop 600.

A diagnostic condition may also be applied, in the form of a $\overline{\text{print}}$ signal along the line 610 to the gate 606 which in turn causes the voltage control 608 to go high, applying the high bias voltage to the transfer roller 52, which may thus be checked by a service repairman without actually making copies.

The position of the sheet relative to the processor at the stage Q8 is now approaching the detack corotron shown in FIG. 1*a* as corotron C1. In accordance with this operation, the Q8 timing pulse from the shift register section 512d is applied to a first coincident gate 612. A timing signal starting the operation of the corotron is applied from the decode matrix 504 to the timing input line 614 of the gate 612. As shown in the timing diagram, the detack corotron is maintained for a preferably narrow pulse duration fixed by the timing and chosen here by way of example as 50 counts, representative, within the examples applying to the present system, of approximately ½ inch of paper travel, thus applying a detacking potential to the leading edge of the paper sufficient to reduce the charge thereon and enable the leading edge of the paper to be stripped away from the processor belt 37. The start timing signal, with Q8 high, provides a high output from the AND gate 612 to the set input of a flip-flop 616 which responds thereto by going high, thereby turning on a pulse along its high output line 618. The pulse is applied to an OR gate 620 and to a voltage control 622, the latter switch providing the potential to the detack corotron C1. At the end of 50 counts, or whatever duration is chosen for the pulse width, a stop timing signal is also derived from the lines 506 of the decode matrix 504 and supplied to an OR gate 624 and to the reset input of the flip-flop 616, thereby resetting the high output 618 of the flip-flop 616, causing the pulse to terminate at the 50 count duration. Termination of the pulse will cause the voltage control 622 to revert to its normal state, thereby removing the high potential from the detack corotron C1. The gate 624 also receives a $\overline{\text{print}}$ signal, thereby resetting the flip-flop 616 when the processor is not in print. As a diagnostic control, an additional AND gate 626 is provided for actuating the voltage 622 when the machine is not in print by activation of the light original button 334 on the control panel 12.

The use of the light original button 334 in this case is in the interest of convenience and provides a convenient mechanism in the maintenance of the machine for checking the detack corotron potential without the machine being in print. Use of the light original button for this function is, of course, optional, as any other button can be employed.

Removal of the sheet is the next operation occurring after the application of the detack potential. As was noted above, failure of a paper to be removed at this juncture is sensed by means of a sensing device 209 located on the exterior portion of the brush cleaning housing shown in FIG. 1*a*. The enabling of the circuitry employed for sensing the presence of paper on the belt 37 following transfer may be derived from the timing of the transfer roll bias application through the flip flop 600. Thus, as shown in FIG. *7c*, the enabling circuit 484 for the sensing device which consists of a flip flop 630 is set by means of a signal derived from a high output of the flip flop 600. Upon setting of the flip flop 630, the Q output of flip flop 630 goes high, thereby driving the sensor drive enabling circuit 632 and enabling the sensing mechanism for detecting the presence of a sheet. As is evident from the timing diagram, the sensing circuit enabling flip flop 630 will be energized when the 208 timing pulse applied along the line 602 to the flip flop 600 enables the high side of the flip flop 600 for triggering the flip flop 630. The turn on of the enable 632 thus occurs at a point determined to be just prior to the time the first sheet would normally enter the transfer nip under the transfer roller 52.

Referring again to FIG. 1a, and assuming the sheet has been properly removed from the photoreceptor surface, the sheet is next transported along the transport mechanism 85 to the fuser mechanism 90. Utilizing the timing provided by the next three stages of the shift register section 512b, corresponding to Q8, Q9 and Q10, the fuser roll clutch mechanism may now be energized through fuser load circuitry 480. Thus, referring to FIG. 7c, the three inputs to the OR gate 636 correspond to the outputs of the stages Q8, Q9 and Q10 from the shift register section 512d, and provide an enabling input to the data flip flop 638. The data flip flop is directly set by means of a connection from the Q8 side of the gate 636 along the line 640 to the direct set input of the data flip flop 638, thereby providing a high output from the flip flop 638 coinciding with the leading edge of the timing signal Q8. The high signal from the data flip flop 638 is applied to a first AND gate 642 and to a second AND gate 644. The fuser roll loading operation is shown in FIG. 3. When it is desired to load the fuser, the pressure roller 92 is moved against the heated roller 91 by activation of the clutch 103. This couples the drive 104 with the eccentric 91' to turn eccentric 91' and move pressure roller 92 into operative contact with fuser roller 91. A cam loading switch 92*a* is mounted at the periphery of the pressure roller 92 for providing a load signal when the pressure roller 92 has reached the proper position. When the pressure roller has reached the proper position, the clutch 103 is disengaged and a brake 105 applied to hold the pressure roller 92 in its proper loaded position. Referring again to FIG. 7*c*, the clutch and brake operation is accomplished by the provision of a signal from the switch 92*a* indicating proper loading. The switch contacts are normally open, such that the logical 1 condition is normally applied to the input of the AND gate 642. Thus, when the flip flop 638 is set, the clutch mechanism 104 is engaged and the roller 92 begins to move into position. When the roller 92 reaches its proper position, the switch 92*a* changes state, thereby applying a low condition to the input of the AND gate 642, thereby disabling the clutch drive 104. At the same time, the low signal is inverted in the inverter 646, thereby providing a high input signal to the input of the AND gate 644 which will then pass the high signal from the flip flop 638 to the brake mechanism 105, holding the pressure roller 92 in proper position.

As shown in FIG. 3, in addition to fuser loading, when short paper is fed into the nip defined by the pressure roller 92 and fuser roller 91, it is desired to cool the roller ends. End cooling is accomplished from vacuum source 101 to draw cooling air through the end portions 100 of the fuser cover 99. The end cooling is eliminated by actuation of the valve 102 by means of a suitable actuation device such as solenoid 102*a* which blocks the flow of air through the end cooling portions of the fuser cover 99. This energization may take place as shown in FIG. 7*c* by applying a fuser loaded signal indicating that the fuser rollers are in proper position along the line 648 to the input of an AND gate 650. The other input of the AND gate 650 is an indication that long paper is present, thereby providing a high signal from the AND gate 650. The high signal thereby energizes the solenoid 102*a,* causing rotation of the air valve 102 in a manner which blocks the vacuum flow through the end cooling shoes thereby removing the cooling effect which would normally be present. When the long paper signal goes low, the air valve 102 to its initial position, thereby allowing cooling air to flow through the end portions 100 of the cover 99. A long paper signal input may be derived from the operative relation thereto in either main or auxiliary paper feed trays, by means of suitable positioned microswitches located in those respective trays.

At the end of the Q10 period, the output of the OR gate 636 goes low, thereby preparing the flip flop 638 for the receipt of a timing pulse from decode matrix 504 along the line 594 which will terminate the high state of the flip flop 638, thereby deactivating the input to the AND gate 642 and 644.

The use of the line 594 is a convenience since the timing employed in this operation is the same timing as was employed in energizing the transfer roll clutch timing.

Flip flop 638 may be reset automatically. When the processor is not in print or when a transport jam occurs, both of these conditions are fed in through an OR gate 652 to the reset input of the data flip flop 638. When the high output of the flip flop 638 goes down, clutch 103 is released. Suitable return bias (not shown) separates pressure roller 92 from the heated roller 91.

Referring again to the timing diagram, it will be apparent that the last process control operation occurs in the stage Q11 of the section 512*d* of the shift register. As a means of improving the life of the photoreceptive belt 37, activation may be taken of this condition by activating, at the leading edge of the next successive stage, a turn off cycle is initiated for removing power from the various xerographic process stations. In accordance therewith, and referring again to FIG. 7*a,* the xerographic power supply 462 is originally energized by a pulse appearing at the stage Q2 of the shift register stage 512*b.* Turning the xerographic power supply off, at its earliest possible point in time, would therefore require a coincidence of O stages in each of of the shift register stages Q5 through Q11, as well as a condition indicating that the system was not in its print mode. As an implementation, the OR gate 660 receives as a coincidence of inputs the outputs of each of the stages Q5 through Q11 of the shift register section 512d along a first set of input lines indicated generally at 662 and a print mode input applied through inverter 665 along line 664. Thus, the absence of signals on all of the stages Q5 through Q11 as well as the absence of the print mode signal provides a 0 condition at the output of the OR gate 660 which may be applied through an inverter 666 as an energizing signal to de-energize the xerographic power supply 528.

As noted in the timing diagram, the first sheet would normally reach the face up tray some time during the Q13 pitch. If the output module 26 is employed, the stages Q14 through Q17 will define a sufficient time interval, of about 2 seconds within the examples provided by the present invention, for the sheet to reach the last bin of the output module. If at the time the stage Q17 is finally reached, there are no one conditions left in any of the shift register stages Q5 through Q17, an early cycle out condition may be created. This signal is generated in FIG. 7*a* by combining the output of the OR gate 660, representing the condition of stages Q5 through Q11 with a further OR gate 670. Gate 670 has therein a plurality of input lines 672 representing each of the output conditions of stages Q12 through Q17 of the shift register stage 512*d.* Should each of the shift register stages Q5 through Q17 have 0 conditions on their outputs, and should the system not be in print mode, a 0 condition will pass from the OR gate 670, indicating an early cycle out condition. As will be set forth in further detail herein, the early cycle out condition is inputted with a print condition signal to OR gate 674, the signal from gate 674 being utilized to remove the input inhibit which normally prevents the operator from entering any modification into the control console 12 during the print condition. Thus, even though the processor is still in print condition, the operator is given an opportunity to modify the function selections on an early cycle out condition. The stages Q8 through Q17 also perform jam switch monitoring, as will be described further below in conjunction with the jam monitoring system. Thus, in accordance with the timing of the operation, there are no longer any sheets remaining with the processor at the moment the Q17 and the stages Q5 and Q16 have returned to their 0 condition. Thus, the Q5 through Q17 0 stages may be employed to generate the early cycle out signal at the output of the gate 670.

Referring to the FIG. 7A, an extra 8 shift register 8 stages, Q18 through Q25 are provided to provide a 4 second time delay in the event for the automatic document handle 18 is operated manually. If this is the case, bits are continuously shifted from Q17 into Q18 through an AND gate 676, one input of which has been enabled by a signal applied along the line 678 from push button 344 on console 12 indicating selection of the ADH manual mode. The additional time delay provided by the stages Q18 through Q25 allows the operator a certain time period in which to make function selections which are now uninhibited by the presence of the early cycle out signal. Thus, the early cycle out signal will remain active without the system going into a print reset condition with the additional time period determined by the shift register stages Q18 through Q25.

When the Q18 through Q25 stages have been completely shifted, and an entirely zeroed condition remains in the shift register Q5 through Q25, an additional OR gate 680 is provided. The output signal from gate 680 along the line 682 is inverted in an inverter 684 to a high condition which is fed to the print reset OR gate 686 to provide a print reset signal along the line 688. A processor jam condition applied the line 690 to the other input of the reset OR gate 686 will also provide a print reset signal along the line 688.

The print reset signal along line 688 is conducted to the print logic 700 shown at the right hand side of FIg. 9. For purposes of illustration the print logic 700 is shown as including a bistable circuit such as the flip flop 702 having a set input and a reset input indicated by the label S and R respectively. A print signal along line 688 acts to reset the flip flop 702 causing the print logic 700 to go out of print, thereby placing a low condition along the line 704 and a high condition on the $\overline{\text{print}}$ line 706 for subsequent application to various points in the logic described in FIGS. *7a 7b* and *7c* as noted therein. The output of the flip flop 702 is also coupled to a print relay 710. The resetting of the flip flop 702 causes the print relay 710 to drop out.

IX. Power Sequencing

Two major relays are activated in accordance with the logic shown in FIG. 9. The first is the print relay 710. The second is the standby relay 712. Before describing the logic function of FIG. 9 in conjunction with the relays 710 and 712, the operation of the relays 710 and 712 will be explained in greater detail. Thus, referring to FIG. 10, the powering sequence utilized in accordance with the present invention is shown. The sequence of operation is begun by activation of the on/off switch, switch 315 on console 12 in FIG. 6. Utilizing a latching relay 714 of conventional configuration, activation of the ON button will in turn activate the on/off latching relay 714 causing power to be applied to the logic voltage supply circuit 716 and fans 717. The power, derived through circuit breakers 715, and which may be a 208 volt two phase alternating voltage, results in a first power on operation applying a low voltage logic level to the logic circuitry by means of the logic voltage supply 716. Activation of the standby relay SBR 712 will close the standby relay contacts SBRC 718, thereby applying power to activate a fuser power source 719, the vacuum source 720 for purposes of creating a vacuum applied for various uses as was described in conjunction with FIGS. 1A and 1B, the power to the elevator mechanisms 721 for positioning the trays as described in conjunction with FIGS. 1A and 1B, and motor drive power 722 for driving the reduction lens to its proper position.

With contacts SBRC 718 closed, activation of the print button 320 on console 12 energizes print relay PR 710 to close the print relay contacts PRC 724 to apply the power through to the main drive motor M via circuit 726, the erase lamp 546 via circuit 728, to the drive motor (not shown) for cleaning brush 57 via circuit 730, and the drive clutch (not shown) for coupling vacuum transport 85 with main drive motor M via circuit 732.

Coupled to the output of the logic voltage supply 716 is an initialize circuit 734. The initialize circuit 734 serves to monitor the level of the logic voltage supply 716 to insure that proper logic voltage levels are being supplied to the system logic to prevent erroneous logic signals. The initialize signal along the output line 736 of the initialize circuit 734 is applied to various points in the logic to indicate proper or improper logic voltage levels for accomplishing various functions. Thus, referring again to FIG. 9, the presence of an initialize signal along the line 736, when applied to the print logic 700, will act to reset the print flip flop 702, thereby causing the print relay 710 to be deactivated, thereby opening the contact 724 disabling the various functions coupled to the print relay.

Initialization thus acts as an inhibit, preventing activation of the print relay during the period of time of the machine operation immediately after turn on, while allowing a logic power supply voltate 716 to build up to its proper levels, and also acts as an alarm or safety condition in providing the initialize signal along the line 736 in the event some failure should cause the logic voltage level supplied by the source 716 to drop beneath a minimum required value.

X. PROCESS OPERATION CONDITION LOGIC

Referring again to FIG. 9, the print mode signal employed to load 1's into the shift register 512 of FIG. *7a, 7b* and *7c,* thus controlling the timing of the print operation of the process is derived from the print mode logic 750. The print mode output signal from the print mode logic 750 is supplied to the print logic 700 and serves to set the flip flop 702 in a high condition, thereby activating the print relay 710 and the print line 704. It is evident that the presence of the print mode signal at the output of the print mode logic 750 will in each case serve to set the print relay 710 by activating the print logic 700. Thus, the print mode logic 750 governs both the timing of the print sequence operation insofar as the shift register is concerned by providing the logic 1 signals loaded into the shift register and in addition activates the print logic 700. Thus, the print mode block 750 serves as a central decision element which will determine the processor operation both in terms of starting the processing of copies, containing the processing of copies, and ending the processing of copies. The print mode block 750 also provides an output along line 752 to the standby relay 712 for governing the operation thereof. The print mode block 750 thus may be described as a machine state condition monitor.

The print mode block 750 provides two basic output signals. The first output signal along line 752 provides energization to the standby relay 712 for closing the standby relay contacts described in connection with FIG. 10. The second signal is provided along the output line 754 and defines the print mode signal described above.

As was described in conjunction with the logic set forth in FIGS. *7a, 7b* and *7c,* the print mode logic 750 acts to supply a binary logic level in the form of a binary one to the shift register 512 indicating a processing operation. The print mode signal remains in its high condition until the print mode logic 750 is reset by means of the print mode reset logic 758, or an emergency override condition. Emergency override conditions are supplied along line 760 to the print mode logic 750. The print mode logic 750 as stated above, accomplishes two functions, the first being to de-energize the standby relay and the second to activate and deactivate the print mode signal along line 754. Since the standby relay applies power to the machine, as well including fuser 89, the emergency override conditions along the line 760 are designed to inactivate the standby relay directly as well as to block the print mode signal. An example of emergency conditions which will be supplied along the line 760 are those conditions indicating that one of the interlocks on the processor has been broken, such interlocks including sensors responsive to opening of one of the panel covers and the like, and an indication that the fuser 9 has exceeded safe temperature A further condition causing standby relay 712 to drop out is caused by an initialize indication from the initialize circuit 734 along the line 736 which indicates that the voltage supplied to the logic is not of a sufficient level for the logic to operate properly.

The other input condition supplied to the print mode logic 750 is supplied from the print mode reset logic 758. The signal from logic 758 resets logic 750 but is insufficient to cause the standby relay 712 to drop out. The signal from print mode reset logic 758 causes only a print mode signal along the line 754 to go down, thereby inhibiting the loading of ones into the shift register 512. It is noted that the absence of the print mode signal along line 754 does not cause the print logic 700 to drop out. This is only occasioned by the print reset signal 688 which in turn will occur when the shift register 512 has reached a zeroed out condition as was described in conjunction with FIG. *7a, 7b* and*7c* or on an initialize signal in line 736.

The print mode reset logic conditions causing the print mode signal to drop may be broken down into several major categories. The first major category is a signal supplied along the line 762 to the OR gate 764 which forms the essence of the print mode reset logic 760. The signal supplied along the line 762 is representative of all the conditions which go to make up the definition of a ready condition insofar as the processor is concerned. The second condition, applied along the line 766, is another safety condition defined by the platen cover for the automatic document handling mechanism 18 specifically, in the requirement that the platen cover be closed in order for the processing operation to continue. The third condition is supplied from the logic 768 and represents processor shutdown. The processor shutdown logic is a functional signal derived from the interaction of the programmer 400, automatic document handler 18, and sorter 26 and which in total represent the completion of a desired operaton in accordance with the operation of the program. This logic function will be described in further detail below.

The print mode logic 750 receives a further input signal gated from the print switch 320 from the function console 12 shown in FIG. 6. The print mode logic 750, which may include a plurality of input gates 770, responds to the gated print switch by monitoring for the presence of an emergency override condition along the line 760, the absence of a print mode reset signal from the OR gate 764 and the ready signal which is supplied from the set of output gates 772 of the print mode logic 750. The latter signal, a ready condition, merely indicates that the initialization signal is also absent indicating that the logic is up to proper voltage levels for activation of the print mode signal. Thus, summarizing the foregoing, if there are no open interlocks, if the fuser is not over temperature, if there is no initialization condition present and if there is no print mode reset condition, activation of the print switch 320 on the front panel shown in FIG. 6 will set the flip flops 774 and 776 causing the gating circuit 772 to place a high print mode signal along the line 754, thus loading the shift register 512 and beginning the processing operation designed in connection with FIG. *7a, 7b* and *7c.* Should any of the undesired conditions be present, activation by the gated print switch 320 will be inhibited although the print mode logic 750 will remain in a standby activated condition unless one of the emergency override conditions suppled along the line 760, or the absence of an initialized signal indicating improper levels, is applied to the print mode logic 750.

The emergency override signals applied along line 760 to the print mode logic 750 are derived from the gating circuit forming the interlock logic 771. The interlock logic 771 may consist of a Or gate 775 which receives interlock signals from the input of automatic document handler 18, the output module 26. and the processor 14. The emergency override to the print mode 750 however includes only interlock systems from the processor insofar at this portion of the logic is concerned. Thus, it is the processor interlock signal which is applied to the OR gate 777 in conjunction with a signal from a fuser temperature sensing device indicating that the fuser 89 is or is not over temperature and forms the output signal applied along line 760 to the print mode logic 750.

As described above, the print mode reset logic 758 receives reset condition signals along input lines 762, 766 and from the processor shutdown logic 768. Turning first to the input line 766, this signal a reset provided in the event that automatic document handling covers are not properly in position. To this end, a cover logic block 780 is provided which receives a signal indicating that the automatic document handling cover is not properly in position, the signal being applied along the line 782 to an automatic document handling cover lamp 784, signifying to the operator that the automatic document handling cover is not properly in position. As a safety factor the platen cover should be closed prior to the flash of an exposure. To this end, if the system is in print, the print signal is supplied along the line 786 to the AND gate 788. Should the platen cover be open at this time, an appropriate high signal is also supplied along the line 790 to the AND gate 788, thereby giving rise to a high signal lighting the lamp 792, indicating the platen cover to be open. A reset signal is also supplied along the line 766 which in turn will cause the print mode signal to go low, thereby preventing the shift register from initiating the next flash. As a further safety precaution, the platen cover may be locked during flash by preventing release thereof for a time period covering each copy flash. The timing for this operation is shown in FIG. 8A under platen cover release.

The next reset condition applied to the print mode reset 758 along 762 represents all the machine ready conditions. To this end, a ready logic block 800 provides an output logic signal along the line 762 indicating the presence of a condition defining a not ready condition indication that print switch 320 is to be inhibited, thereby preventing the mode logic 750 from entering the print mode.

The ready logic 800 is associated with a ready lamp 802. The ready lamp will be activated when the ready logic indicates that none of the conditions which would prevent a processor operation are present. Thus, the lighting of the ready lamp 802 will indicate to the operator that activation of the gated print switch 320 may be accomplished and the machine is now ready to enter its processing phase. The ready logic 800 is shown schematically as including an OR gate 804 receiving a plurality of condition inputs. The presence of a signal on any one of the conditioned input lines to the OR gate 804 will indicate a condition meaning that the machine is not ready for initiation of the processing operation. Thus, a stop print signal applied as a high condition to the line 806 to the OR gate 804 provides a high condition along the output line 762 of the ready logic 800 which will thus apply a reset signal to the print mode reset logic 758. Similarly, should sorter 26 not be ready, or should document handler 18 not be ready, or should the main paper tray door be open, a high signal is applied along the line 812. The advantages of the logic system of the present invention is such that additional inputs may be applied to the machine ready OR gate 804 for further monitoring various operational conditions as may be desired. It is therefore feasible within the concept of the present invention to add many additional features determining machine ready condition, the features being shown being illustrative of the usage of such input conditions.

Two additional lines are shown to the input of the OR gate 804. The first of these input lines 814 represents the output of the wait condition logic 816 while the second of these lines 818 represents the output of the call key operator logic 820. Thus, the presence of a wait condition, as discussed in FIG. 4 will also give rise to a machine not ready logic signal by virtue of the action of the logic 816. In addition, certain machine features which result in a call key operator indication as was discussed above will be supplied along the line 818 to the gate 804 for similarly indicating a machine not ready condition.

Should the input conditions to the OR gate 804 all indicate that no conditions are present which inhibit a ready operation, the low signal derived from the output of the gate 804 will be inverted in the inverter 822 and applied as a high condition input to the AND gate 824. The other input from the AND gate 824 is derived from an inverted signal from print mode 750. In the absence of print mode from the logic 750, meaning a low condition on line 754, a high condition will result through the inverter 755 along the line 826. The coincidence of high conditions to the AND gate 824 will cause the machine ready lamp 802 to light. Activation of a gated print switch signal, by depressing the print switch button 320 will thus cause the print mode logic 750 to apply a high print mode signal along line 754 which will in turn be inverted through inverter 755 and applied along line 826 to the input of the AND gate 824, thereby causing the output of the AND gate 824 to go low and extinguish the ready lamp. In addition, the presence of a inhibiting input signal to the OR gate 804 will also cause a high output on line 762 to place a low input to the AND gate 824, also extinguishing the ready lamp 802.

Referring to logic unit 816 the wait conditions comprise a series of inputs to wait condition OR gate 830. The input conditions to the OR gate 830 are numbered to correspond to the input condition signals generated at the various test and sense points through the process operation as was described in conjunction with FIG. 6.

Certain of the wait conditions are time delays resulting from the starting of the processing operation. If a sufficient time delay between operations has elapsed, certain machine operating parameters, necessary to proper processing, will have fallen below minimal operating levels. Thus, for example, the input condition along the line 432 represents a time delay required to allow the fuser to warm up to its proper operating temperature. A fuser warm up signal may be provided by means of a thermistor or other temperature measuring device preset to some standard calibration level required for particular fuser operation. Fuser temperature control utilized in conjunction with an apparatus such as is described in accordance with the present invention is disclosed in U.S. Pat. No. 3,735,092 issued May 22, 1973, assigned to the assignee of the present invention, the disclosure of which is incorporated herein by reference. The input condition applied along the line 438 is another condition of this type, representing the time delay required for vacuum operation to reach its proper pressure levels. Belt vacuum pressure may be sensed by suitable transducers operating within the plenum chamber being evacuated and compared with a fixed reference signal which may then be applied to the wait condition OR gate 830 along the line 438 to indicate that the vacuum has reached its appropriate level.

Two additional functions are shown as wait conditions. The first is the reduction timing applied along the line 434. As was described above, several reduction modes are possible in accordance with the operation of the present invention. The machine in its normal operation is adjusted to its full scale reproduction mode. Should another mode be chosen, a certain time delay is necessary to allow the lens drive system to reposition the optics in accordance with the desired reduction mode. This time delay is also applied to the OR gate 830 as an inhibiting wait condition to allow the optics lens to be seated prior to the initiation of a print operation. In addition, should a reduction mode other than the normal mode have been selected during a previous processor operation, the optics will remain positioned in that previously selected mode until the machine is reactivated for the next subsequent process. If no selection is made of the same optical reduction, the lens optics will automatically reseat for full scale reduction. The time delay required for this adjustment also acts as an inhibit signal applied to the OR gate 830 and acts as an inhibit condition preventing the machine from operating due to the action of the ready logic 900 as applied to the print mode reset logic 758 as was described above. A complete disclosure of a motor driven reduction system having various selectable modes and utilizable in accordance with features of the present invention is described in U.S. Pat. No. 3,778,147 issued Dec. 11, 1973, and assigned to the assignee of the present invention, the disclosure of which is incorporated herein by reference.

Finally, an elevator control system is provided for driving both the auxiliary and main trays 54,55 into proper position for feeding paper. This will be a function of either the paper height in the tray, paper tray selection, or both. After the energization of the machine, a time delay will be effected in order to permit the elevator control 436 to place the paper trays in their proper position prior to the time of the processor operation. A full disclosure of elevator control operation including positioning logic and drive is fully set forth in U.S. Pat. No. 3,820,777, issued June 28 1974, and assigned to the assignee of the present invention, the disclosure of which is specifically incorporated herein by reference.

The output of the wait condition OR gate 830 is coupled through AND gate 832. The output of the AND gate 832 is coupled to a wait lamp 834, and forms an input condition along the line 814 to the OR gate 804 of the ready logic 800. The AND gate 832 receives an input condition along the line 836 which is a function of whether the input (document handler 18) and output (document handler 18) mechanisms are ready. These signals (sorter 76) are be derived from the lines 810 and 808 as input conditions to the ready logic 800 and pass through a NOR gate 838. Thus, an input not ready or output not ready condition appearing as a high signal along the lines 808 or 810 will pass through the NOR gate 838 as a low condition to be applied to the input of the AND gate 832. It will be evident that input and output not ready conditions will inhibit the wait conditions through the AND gate 832. The output of the AND gate 832 is passed through an AND gate 839, the output of which is applied to the wait condition lamp 834. Gated into the AND gate 839, is a 2Hz oscillator 840. Activation of the AND gate 839 by a wait condition through the AND gate 832 will cause the 2Hz oscillator 840 to apply a flashing condition to the wait lamp 834, thereby making the wait lamp 834 more visible to the eye of the operator.

The wait condition lamp 834 represents conditions which need not require the intervention of an operator. These conditions should each be conditions which will, upon completion of the timing cycle necessary for accomplishing the respective input functions thereto, automatically go down, thereby extinguishing the wait lamp and allowing the wait condition output applied along the line 814 to go down, thereby causing the ready logic 800 to go into its low state.

An additional logic function 820, receives conditional inputs 760, 858, 858' which require the intervention of a key operator. The phrase key operator refers to a specially trained operator possessing the necessary unlocking equipment required to open the machine covers to correct some specific condition. The call key operator logic 820 produces an output signal along the the condition line 818 to the ready logic 800 placing an inhibit condition along the line 762 to the print mode reset logic 758 as was described above.

The input conditions to the call key operator logic 820 represent more serious machine problem situations. The first of these is the system jam logic 842. The system jam logic 842 represents an ORed condition, through an OR gate 844, of various jam states within the machine. Thus, an input jam condition applied along the line 846 represents a jam found in the automatic document handler 18 described above in connection with FIG. 3. An input condition along line 848 represents a jam condition evident in the sorter 26 utilized in conjunction with the processor, illustrated in FIG. 1*b*. Finally, along line 850, a jam condition existing with processor 14 will apply a high signal along line 850 to the OR gate 844. The presence of a high signal at any one of the three lines 846, 848 or 850 indicating a jam will be applied through the OR gate 844 to generate a system jam signal which will be applied along the output line 852 as a condition input to the OR gate 854 of the call key operator logic 820. A high condition at any input of the OR gate 854 will indicate a call key operator condition and provide a high logic level signal along line 818 to the OR gate 804 of the ready logic 800. The second input line to the OR gate 854 is provided from the output of the interlock logic 770. The interlock 770 represents opening of one of the document handler, sorter or processor 18, 26, 14 respectively interlocks. Opening of the interlock in any one of these components in addition to lighting the interlock lamp 773 will also apply an output signal along line 856 which forms the next input to the OR gate 854.

The input line 858 to the OR gate 854 represents a combination of problem conditions requiring the intervention of an operator and as was specifically set forth in connection with functions 410 shown in FIG. 6. Thus, the first function (SOS Clean) is a monitoring device sensing the proper operation of the detector sensing failure of the pickoff mechanism to remove a document after the transfer station. A monitoring device utilizable in accordance with the foregoing function is disclosed in greater detail in U.S. Pat. No. 3,727,065 issued Apr. 10, 1973, and assigned to the assignee of the present invention, the disclosure of which is specifically incorporated by reference herein. Should the monitoring of this system indicate that some corrective operation is necessary regarding such detector before the machine process can continue or begin, an appropriate high signal is applied along the line 420 representative of this function.

The next function monitored by the call key operator logic represents the conditions of the toner bottle and the final filter shown as combined into a single element signal applied from the circuit 422 (TB/FF) shown in FIG. 6. Toner bottle monitoring is merely a means and mechanism for reclaiming centrifugally separated toner coming off the brush cleaning mechanism. When the toner rises above the maximum allowable level, the appropriate signal is generated by circuit 422 to the call key operator logic 820. The final filter represents a similar detection scheme in that the dirt level accumulated in the final filter is also continuously monitored. When the filtered level has reached a point beyond which the filter is not operating efficiently, an appropriate signal is supplied to the logic 820 from circuit 422.

The last condition shown along the input line 858 to the OR gate 854 of the call key operator logic 820 is the SOS jam condition 424. This condition represents failure of a pickup mechanism to remove paper remaining on the belt 37 after the transfer station roller 52, and as detected by means of the monitoring circuit described in conjunction with circuit 420 above. A jam detection circuit of the character described is described more fully in the aforementioned U.S. Pat. No. 3,791,729, issued Feb. 12, 1974, assigned to the assignee of the present invention, the disclosure of which is incorporated by reference herein.

The next line applying an input to the OR gate 854 is input line 760. Input line 760 represents an output condition derived from the output of OR gate 777. This condition represents both processor interlock and a condition indicating that the fuser has exceeded its maximum temperature. Since the processor interlock signal has already been applied along line 856 to the OR gate 854, there is some redundancy in reapplying the processing signal through the OR gate 777. However, the use of the backup system only increases the reliability of the system and in any event provides a convenient logic point for the introduction of the signal from line 760 to the OR gate 854 for providing a call key operator indication for fuser over temperature condition.

Summarizing the foregoing descriptions, the presence of a high signal to the OR gate 854 on any one of its input lines will give rise to the presence of a high signal at the output thereof, which will be applied in turn along line 818 to the OR gate 804 of the ready logic 800.

As is stated above, any one of these conditions will therefore provide an inhibit signal along line 762 which will either activate the print mode reset or otherwise inhibit the gated print switch 320 from activating print mode. In addition, the output of call key operator logic 820 is inverted along line 862 as a further input to the AND gate 832, thereby allowing any one of the call key operator conditions to inhibit the wait condition lamp 834, and thereby superceding the wait condition which is a lower level priority signal. The output of the OR gate 854 is also applied to an AND gate 864 which has its output coupled to a call key operator lamp 866. The other input to the AND gate 864 is derived from the 2Hz oscillator 840. The presence of a high signal in the call key operator OR gate 854 will thus cause a 2Hz signal to be applied to the AND gate 864, causing the call key operator lamp 866 to flash, thereby attracting the attention of the operator.

XI. JAM DETECTION

In accordance with the operation described in conjunction with FIGS. *7a, 7b, 7c,* the shift register 512 provides a convenient timing cycle sequence for accurate jam detection within the processor. More particularly, it is the stages Q9 through Q17 of the shift register 512 which are employed as a functional sequence for detecting the various states and conditions of the jam switches. Since the process is controlled as a result of sheet movement on a machine time basis, the requirement for a presence or absence of a sheet at any given point in the process will be predetermined. Thus, the shift register stages may be used as test points for sampling the conditions of the various jam switches i.e. 208, 210 provided throughout the length of the processor for determination of the proper condition of these switches in accordance with the expected or predetermined position of the process sheet corresponding to the timing of the switching of the particular shift register stage. It will be evident from the foregoing description that the philosophy of the system of the present invention is that certain required conditions are constantly monitored such as interlocks, fuser temperature, etc., whereas certain jam conditions are detected in accordance with criteria establishing paper position in a correct location during sampling, at a rate of once per pitch. As is discussed above, in accordance with the examples being employed for the present description, a pitch represents 10 inches of paper travel.

When the jam check monitors indicate a problem, the machine is subjected to one of three possible operations. First, the machine may be immediately stopped; secondly, stopped after a slight delay; and, thirdly, normally cycled out. The type of the shut down is determined by the potential criticality of the detected condition.

A. Jam Detection System

As was set forth in FIGS. 7A, B, and C, when the machine is running, a machine clock 502 generates a pulse train which feeds into the decode matrix 504. This matrix counts the pulses and provides certain output counts that are used for timing machine events. The decode matrix count 504 is reset to zero once per pitch when a magnet attached to the registration shaft 204 passes a stationary reed relay (see FIG. 1A) mounted on the pretransfer transport and energizes it. This pitch reset signal also clocks bits of information through the shift register 512. The shift register 512 Q stage outputs are used in conjunction with the decode matrix 504 times to control all time dependent machine events, including jam detection. The progress of copy paper is monitored once per pitch throughout its travel in the machine. If paper is not on a paper path switch at the right time, or is on a paper path switch at the wrong time when the logic signals are sampled, the appropriate type of jam will be declared and the machine will be stopped in the proper manner.

The following describes what is occurring in each of the functional blocks which are shown in the machine jam detection system functional block diagram (FIG. 11), and in the specific circuitry relating thereto, shown in FIGS. 12A and B, which are left and right sides respectively of the functional diagram of FIG. 11.

Referring to FIGS. 1A, 1B, 11, and 12A and B, the paper switch 208, which inputs to paper sensing logic block 900, is located after transfer 52 in the post transfer transport 85. Paper switch 210 is located before the entrance to the fuser 89. Paper switch 212 is located after the fuser. Paper switch 214 is positioned after the deflection gate in the output transport leading to the sorter 26. Paper switch 216 is positioned after the deflection gate 160 in the transport leading to the face-up tray 24. Misfeed switches 200 and 202 (FIG. 12B) are located after each paper tray.

When a sheet remains on the selenium belt 37 after roll 52, rather than going into the post transfer transport 85, it is sensed by the SOS jam sensor. The signal energizes the stripper finger solenoid (not shown) which moves a stripper finger proximate belt 37 in a relatively short time. The sheet is guided over the finger toward the misstrip switch 209, which is mounted on the brush housing. When the switch 204 is actuated, the misstrip signal is fed through a reed relay 920 to gate 916.

Signals from each of the paper path switches 208, 210, 212, 214, 216 are sent through reed relay interfaces, to relays R2, R3, R4, R5. The relay interfaces isolate the noisy switch signals from the logic. When a paper path switch is actuated, its contact is closed and energizes the reed relay. The reed relay contacts send logic signals to the rest of the circuitry in the control console. Thus, switch 209 is coupled to relay $R_1$, switch 208 to relay $R_2$, switch 210 to relay $R_3$, switch 212 to relay $R_4$ and switches 214 and 216 through OR gate 902 to relay $R_5$.

The output of relay $R_5$ is coupled to a jam memory block 904 for switches 214/216. There are two important reasons for having a memory at the point where paper is leaving the input station to enter either the output module of the face-up tray. The first is that this is the only position in the machine where it is critical to know that a copy has arrived and exited. The other reason is that the switches 214 and 216 are located such that certain sizes of paper may not be on the switch at the jam sample time. Therefore, the memory is utilized to remember what has occurred at the switches. Since it is impossible for both switches 214 and 216 to be actuated at the same time by one copy, their inputs to the logic are brought in to the same point, effectively resulting in one exit jam check.

When a copy arrives at switch 214 or 216, the signal goes through bounce elimination circuitry (not shown) and sets a memory 906 (FIG. 12A). This memory signal goes to gate 922 in the jam or misstrip detection block 908, where it is checked. The memory 906 is reset at a time $T_1$, such as 057 in the time scale shown in FIG. 8, or when the machine goes out of print, through the OR gate 910. If a copy does not leave either exit switch 214 or 216, the memory 906 cannot be set. This condition leads to a transport or timed jam at the next sample time, as will be explained further below, by providing a high signal along the output line 913 from the $\overline{Q}$ side of the memory 906. Thus, this jam at the exit will be detected at the next copy after the jam occurred. If the last copy jams at the exit switch 214 or 216, the jam is detected at which time a processor jam will be declared and the paper jam lamp lights. If a copy does not arrive at the exit switch, the jam will be detected at jam sample time for this copy.

B. Jam or Misstrip Detection

The jam and misstrip detector 908 is designed to detect jam conditions in accordance with shift register positions, supplied from the shift register 512. The detector employs exclusive OR gates 910, 912 and 914 to compare paper position signals with shift register Q states. When the two signal levels are logically different (e. g. one high and one low) there is no jam. When the two signal levels are the same, there may be a jam. Paper is either present or absent when it should not be or a paper path switch has failed. The jam is signaled through an OR gate 916, along line 918.

As noted above, when a sheet remains on the belt 37 after transfer roll 52 transport 86, a stripper finger guides the sheet toward mistrip switch 208, which is mounted on the brush housing. When the switch 208 is actuated the misstrip signal 208 is fed through a reed relay 920 ($R_1$) to the OR gate 916.

In addition, the signal generated in the jam 214/216 memory is supplied along the line 913 for sampling in the exclusive OR gate 922, as well as timed against the timing stage Q 13 through the inverter 924 to the AND gate 926. The output of both exclusive OR gate 922 and AND gate 926 are supplied along a common line 928 to the OR gate 916.

When no paper condition exists at time Q 13, and when paper is present at either switch 214 or 216, the AND gate 926 provides a high signal, signifying a jam. Alternatively, when a paper present condition exists at time Q 13 or when paper is not present at either switch 214 or 216, the AND gate 926 also provides a low signal signifying no jam condition at these switches.

The jam signal supplied along line 918 is fed to a timed jam latch 930. The timed jam latch is a bistable switch having a condition input (C), a set input (D), a direct set input (DS) and outputs Q and $\overline{Q}$. As noted in FIG. 8, timing to the timed jam latch 930 is provided at the appropriate moment within the pitch to sample the condition of the switches. Thus, at $t_2$ (057) in the timing cycle, the jam timing cycle logic 932 supplies a timing signal to the condition input of the latch 930. If the set input D of the latch was high when the jam sample timing signal was applied, the latch output Q would go high, signifying a timed jam condition, a condition which may include a transport jam condition, and for which the term transport jam may be used. This output thus indicates a jam occurring within the processor, and its utility will be described in further detail later in this specification.

The jam timing logic 932 includes an AND gate 935 which permits the $t_2$ timing signal, derived from the decode matrix 504-timing lines 506, to pass in coincidence with a PRINT signal, indicating the machine is in print.

The essence of a timed jam thus provides a unique monitoring condition set which monitors not only for the absence of paper when it should be present, but the presence of paper when it should be absent, and the failure of a jam switch. Any of these conditions, due to the timed sampling of the jam switches, will generate a jam condition. The use of jam memories to maintain a jam condition along the line 918 is also effective in insuring that jam conditions existing prior to a shutdown must be cleared after a subsequent start-up to allow the processor to go into print.

C. Stop Running Conditions

When the machine is in print the stop running conditions block 934 provides a signal to Jam Shutdown logic block 936, which will stop the processor if an interlock is opened or if the fuser 89 goes over temperature. Since these events are random and not logically time dependent, they are continually monitored by the logic. There is an immediate reaction to the sensing of one of these conditions to generate a jam signal, inhibiting the present operation. As shown, the signal is also coupled to the timed jam latch 930 as a back up control.

Referring more specifically to FIG. 12A, the JAM Shutdown logic block includes a plurality of logic AND gates 938, 940, 942 and 948. Each of these gates receive an input corresponding to a condition which will result in a shutdown. The gates 938, 940 and 942 receive respectively an interlock open signal, a fuser over temperature, and a time out. As was explained above, the interlock signal results from the opening of an interlock, such as a high voltage panel cover or the like. The fuser over temperature control derives from a temperature measurement in the fuser. The time out signal is a function derived from the timing lines 506 and activates a shutdown signal. The timing cycle is designed to utilize a count of 999 within each pitch to activate the shutdown. Since the counter 508 (FIG. 7A) is designed to reset at a count of about 920 by the action of the rotating mechanism 204, the occurrence of a higher count indicates a fault condition. Thus, a time out jam indicator is provided by signalling a jam condition should the decode matrix provide a signal on its 999 line to the gate 942. A time out jam signal indicates a malfunction at the registration input, or a fault in the reset system.

Each of the foregoing signals are gated in the gates 938, 940 and 942 with the PRINT signal since each is a function of a print operation. The output of the gates 938, 940 and 942 are gated through the OR gate 944 to provide the jam shutdown signal along the line 946.

Two additional conditions are generated in this logic block. The first, through gate 948, signals a jam condition if the magnetic latching jam reed relay 950 (to be described further below) is set when power is initially turned on (INITIALIZE), indicating a jam existing from the period before power was removed (e. g. from shutting down for the night, or due to a power blackout). The second condition is a function of the SOS jam memory.

Regarding the SOS condition, should a sheet remain on the selenium belt 37 after transfer roll 52, an optical sensor actuates a stripper finger as described. At the same time, a timer is started. If the finger picks the sheet off the selenium and guides it to actuate the misstrip switch 200 the timer is reset. If the finger fails to pick the sheet off the belt, the timer times out and signals an SOS jam, which sets the latching reed relay $R_6$ in the logic. The sheet will end up in or under the brush housing 58. The relay R6 is reset by a switch (not shown)

which is actuated when the brush housing is pivoted open.

If the optical sensor fails, or if the operator does not remove the sheet from the brush housing when resetting the SOS relay, a back up switch may be provided in the brush housing 58 which senses that the pressure in the housing has increased. This is due to the sheet blocking the air duct to the brush housing. This switch sends a signal to the logic which also sets the SOS latching reed relay $R_6$. When an SOS jam has been signalled, it must be cleared before any other jam is cleared. This is because the SOS jam forces transport and fuser jams by providing a signal along line 952 to OR gate 944. These other jams cannot be reset until the SOS jam is reset because the SOS jam overrides any reset signals.

The output signal from the gate 944 is coupled along the line 946 to the DS input of the timed jam latch 930 and to the DS input of the immediate jam latch 952. Thus, any of the jam conditions passing a signal through the gate 944 of the jam shutdown logic 936 will actuate both latches 930 and 952 to provide jam signals on their respective Q output lines.

The SOS jam condition also provides a signal lighting the lamp 954 for indicating an SOS jam condition to the operator.

Where the inertia of the various paper transports are high, it is convenient to employ a suitable brake 956, responsive to the SOS jam signal to brake the transports, thus reducing travel of the system after an SOS jam stop, limiting the paper travel and reducing the complexity of jam clearance.

D. Jam Reset

The jam reset logic block 958 contains circuitry which resets the timed and immediate jam latches under various conditions. When power is turned on these latches will be reset if the jam relay memory is not set. In addition, after one or both of these jams have been signaled, they are reset by actuating a switch when the timed and immediate jams have been cleared. The switch signals energize reed relay interfaces which clear the latches.

Referring to FIG. 12A, the jam reset block 958 includes reed relay $R_7$ coupled to a two stage register 960. The two stage register functions to determine the state of the transport clearance switches. Since the switch will pulse the relay upon opening and closing, the use of the two stage register allows only the second of the two pulses, indicating closing, to be employed as a reset. The utilization of the reset pulse is derived by the gate 962. The opening pulse at S sets the Q output of the first stage 960A high with a clock pulse at C. The closing pulse sets the $\overline{Q}$ output of the first stage 960A high, and at the next clock pulse thereafter the $\overline{Q}$ output of the stage 960B goes from high to low. The overlapping highs of the Q output of stage 960A and the Q output of stage 960B thus combine through the gate 962 to place a momentary high condition to inverter 964, causing a momentary low at the input of the OR gate 966. The resulting output along line 968 acts to reset the latch 930. The latch 930 is designed to reset upon the application of a low signal at its R input terminal.

The fuser jam reset logic functions in a manner corresponding to the transport jam reset logic. The fuser jam reset signals are applied to a relay $R_8$, coupled in turn to a two stage register 970. The two stage register operates in the manner described above in conjunction with the transport jam logic. The jam reset signal is derived by the AND gate 972, passed through inverter 974, to the OR gate 976, and applied as a low to the R (reset) input of the immediate jam latch 952. It is noted that the logic also provides for a transport jam reset signal to be applied to the OR gate 976 from the inverter 964 for resetting the immediate jam latch 952. This is done because one of the transport jam switches 212 is coupled through the exclusive OR gate 914 along the line 978 to the set input of the immediate jam latch 952. This transport switch triggers the immediate jam latch to save time in effecting a shutdown since the paper is nearing the end of the transport path and a quick stop is more beneficial to prevent paper jams in the output device or from becoming more difficult to clear.

The action of the transport jam reset logic is blocked by applying a high fuser jam signal to the OR gate 966, indicating that while a timed jam may have been cleared, an immediate jam remains.

The two stage registers 960 and 970 each further include a reset condition provided upon initialization, or power on. The reset of the register stages 960 is designed to occur upon receipt of a high signal, indicating power has been turned on and is approaching operation, along the initialization line 980.

The reset is also operational upon entering print or upon initialization (power on) if no prior jam exists which has not been cleared. Prior jams, as will be noted, are signalled by the state of the jam relay set signal applied along line 982 from the jam memory block 984 (FIG. 11, FIG. 12B). Referring to FIG. 12A the initialization and print signals are ORed together in an OR gate 986. The resulting high signal is applied through inverter 988 as a low signal to the R input of the transport jam latch 930, and through the inverter 990 as a low signal to the R input of the immediate jam latch 952, thereby resetting both latches.

The resetting of the latches is inhibited if a jam memory condition is applied along the line 982, thereby preventing the resetting of the latches 930 and 952.

E. Jam Latches

Referring to FIG. 11, the jam latches 930 and 952 each respond to various input conditions to signal a jam, and each is reset by appropriate inputs, as described above. The immediate jam latch output signals the jam memory 984, and energizes the print lockout 1028, which in turn provides a processor jam and jam lamp signal. The immediate jam latch 952 also signals the paper jam logic 994 which in turn signals misfeed cycle-out logic 996. Additionally, the immediate jam latch triggers the fuser jam lamp 998.

The timed jam latch 930 also signals the print lockout logic 1028 and paper jam logic 994, and in addition, activates the fuser trap solenoid 1000 and the enable deflection gate logic 1002.

Summarizing each latch operation, the immediate jam latch is set if a Jam Shutdown occurs. It is reset under the jam reset conditions. If a fuser jam exists when the jam sample pulse occurs, the information is clocked into this memory. It results in a processor jam which immediately stops the machine via the print lockout. It also signals a paper jam and lights the fuser jam lamp.

The timed jam latch is set if a Jam Shutdown occurs. It is reset under the jam reset conditions. If a misstrip is present when the jam sample pulse occurs, the information is clocked into this memory. It results in a timed jam which stops the machine after a jam delay via the print lockout 1028. This delay allows the copy in the fuser to exit from the fuser and travel to the output transport. The fuser trap solenoid 1000, which is located upstream of fuser 89 opposite transport 85 and which serves when energized to advance into contact with the transport frame thereby trapping the copy sheet on transport 85 and preventing entry of the sheet into fuser 89 is energized to prevent the next copy from entering the fuser. The deflection gate is also signalled.

F. Jam Memory

The jam memory logic 984 includes a magnetic latching reed relay $R_9$, shown in FIG. 12B, having a normally open contact $L_1$. It will remain in one state (e.g. set, $L_1$ open or reset, $L_1$ closed) until the coil on the opposite side is energized, resulting in a change to the opposite side of the relay. In the event of a power failure or an overnight jam, the latching feature ensures that the jam condition will be signalled when power is turned on again.

When the machine goes into print, signalled along line 1004, the relay $R_9$ is set. It remains energized until the machine successfully cycles out of print, when it is reset. If a jam occurs during a run, the memory cannot be reset until the machine is out of print and all the jam conditions have been successfully reset. If the relay was reset when the power was turned off, it will remain reset when power is reapplied. The logic state of this relay allows the jam reset and jam shutdown logic blocks to perform their proper functions.

The logic indicating failure to remove all of the jam conditions is determined through the use of the AND gate 1006. Each of the jam conditions are applied in inverted logic to the input of the AND gate 1006. The $\overline{\text{SOS JAM}}$ signal is derived from the inverter 1008 along line 1010 (FIG. 12A) from the SOS jam memory relay $R_6$. The $\overline{\text{TIMED JAM}}$ signal is derived from the $\overline{Q}$ side of the immediate jam latch 952 along line 1012. The $\overline{\text{TIMED JAM}}$ signal is derived from the $\overline{Q}$ side of the timed jam latch 930.

In operation, a print signal will set the relay R9 by applying a high signal to the inverter 1016 which in turn applies a low signal to the lower coil of the relay $R_9$, closing the contact $L_1$. The resultant grounding of the input to the inverter 1018 will place a high signal on the JAM RELAY SET output of the jam memory 984.

When the machine goes out of print, a low signal is applied by the print line 1004 to the inverter 1016, applying a high signal to the AND gate 1006. If the remaining signals applied to the AND gate 1006 are also high, signifying removal of each jam condition, the gate 1006 will pass a high signal through the inverter 1018 as a low, allowing potential $+V_2$ to energize the upper coil, thereby opening the relay contact $L_1$. Since the jam memory relay $R_9$ is a latching relay, the setting of the relay and blocking of a reset will survive power outages and attempts to go back into print without clearing the jams. Thus, an important feature of jam determination is provided by the jam relay set signal provided by the jam memory.

A jam bypass function is provided by a switch 1020 in the control console which, when it is pulled out, bypasses the timed jam detection system. This is done by preventing the set or lower coil side of the latching jam reed relay $R_9$ from being energized. The purpose of bypassing all timed jams is to allow trouble-shooting and diagnosis without continual jam stops.

When the bypass switch 1020 is open and the latching jam reed relay is reset, the timed and immediate jam latches are held clear. When the machine goes into print, the misfeed memory 1022 is also held clear. This effectively bypasses the complete timed jam detection system. If one of the timed jams occur the machine will not shut down. If one of the Jam Shutdown logic functions are sensed, the machine will stop due to setting the immediate jam latch, but the jam memory relay $R_9$, being bypassed, will not remember the jam. However, if paper is on any of the paper switches after the machine goes out of print, the machine is prevented from going back into print by the Print Lockout logic. Once the paper is cleared and the jam reset logic clears the immediate jam latch 952, the machine can go back into print. Closing the swtich 1020 restores the machine to normal operation.

In addition to jam bypass, a misstrip bypass circuit 1024 responds to a coincidence between a PRINT signal and a JAM RELAY SET signal, indicating bypass, for inhibiting the SOS system from signalling, a timed jam, and in turn effectively closing relay $R_6$, thus indicating an SOS JAM SET condition if an SOS condition is actually present. This is accomplished in accordance with operation of the switch 1020 and aids in the diagnostic process. In addition, operation of the SOS jam set for each operation insures against an actual SOS jam should that situation occur.

The voltage initialize logic 1026 insures that the jam memory reed relay $R_9$ does not change its state when power is either turned on or turned off. The current path to ground is opened to eliminate the possibility of either side of the reed relay coil being energized by virtue of a transistor coupling each side of the reed relay coil to ground upon activation by the initialize signal. As set forth previously, the initialize signal represents a level below logic voltage levels, and is a high logic signal for those intervals.

G. Print Lockout

The print lockout logic block 1028 (FIG. 11 and 12B) accepts jam signals and determines the timing of when the machine will be stopped. It signals a PROCESSOR JAM which in turn generates via system jam 842, call key operator 820, Ready 800, and Print mode reset 758 a print reset signal to reset the print mode logic 750, as set forth in FIG. 9, and lights the paper jam lamp 1030.

If a fuser jam occurs, the machine is stopped immediately by the immediate jam latch 952 signal. If a transport jam occurs signalled by the time jam latch 930, machine shutdown is delayed until a timed count $T_3$, such as 843 on the 920 count scale, is reached. This allows the copy in the fuser 89 to clear the fuser and enter the output transport 113. If a misfeed occurs the machine will cycle all good copies out and then shut down. If a sheet is jammed on any paper switch (including the misfeed switches) when the machine goes out of print, the print lockout 1028 signals a processor jam, lights the paper jam lamp 1030, and prevents the machine from going into print untl the paper has been cleared.

As shown in greater detail in FIG. 12B, the print lockout logic 1028 includes a first AND gate 1032 responsive to a coincidence between a TIMED JAM signal from the Q side of latch 930 (FIG. 12A), a JAM RELAY SET signal from the jam memory 984, and a timing signal $T_3$, which may represent an appropriate timing point in the pitch cycle, such as count 843. The resultant signal, PROCESSOR JAM, is applied along the output line 850 to logic block 842, shown in FIG. 9, and resets print reset 758 and print mode logic 750. The IMMEDIATE jam logic signal is derived from the Q side of latch 952, and is fed directly to the output line 850 to bypass the timing signal $T_3$.

Once the timed jam latch has been reset, and with the mechanism out of print, the print lockout logic 1028 may maintain the PROCESSOR JAM signal on line 850, thus inhibiting print, until each misfeed or paper switch has been cleared. This is accomplished by the OR gate 1034 having a plurality of inputs representing each paper and misfeed switch condition. Thus, line 1036 corresponds to the output of the misstrip relay $R_1$ (FIG. 12A), block 900; line 918 corresponds to the output of the jam and misstrip logic block 908; and line 928 corresponds to the output of the 214/216 switches. In addition, the $\overline{\text{TIMED JAM}}$ signal from the $\overline{Q}$ side of latch 930 is also applied through an inverter 1037 to the OR gate 1034 as a protective back up.

Since a high condition on any of these lines signifies a jam, and since this jam condition will keep the machine from going into PRINT, an AND gate 1038 gates the output of the OR gate 1034 with a $\overline{\text{PRINT}}$ signal to the output 850. When the jams are all clear, the line 850 will go low and the system is operational.

H. Timed Solenoid Controls i. Fuser Trap Solenoid

The fuser trap solenoid 1000 is energized whenever a timed jam is signalled and is physically formed of a plunger which pushes against the vacuum transport to trap paper and prevent it from entering the fuser. This mechanism is shown in FIG. 1A as box FTS just before the fuser rollers 91/92.

As shown in FIG. 12B, the timed jam signal from Print lockout 1028 is applied to an AND gate 1040 where it is gated with a SYSTEM RUNNING signal for energizing the fuser trap solenoid. The system running signal actually represents a condition indicating that an output module is being used, or that the system is in print, or that the machine is coasting. Coasting is a timed function provided by a predetermined delay circuit (not shown) timing being derived from the clock pulse source 502.

ii. Deflection Gate Solenoid

The deflection gate logic 1002 enables solenoid DGS (FIG. 1B) when an output device such as the sorter 26 is being used. When the face up tray 24 is being used the solenoid is not energized, thereby allowing the gate 109 (FIG. 1B) to be in the lower position, guiding paper to the output transport. The gate is raised when a timed jam is signalled, guiding copies to the face up tray 24. An output module jam can also cause the gate to be raised by enabling the face down logic gate. The logic for this function is shown in FIG. 12B. An AND gate 1042 responds to a high signal along the PRINT line and a high signal from the TIMED JAM line (signifying a timed jam), to enable the solenoid actuating the deflection gate 109, thereby deflecting copies into the face up tray 24.

I. Misfeed

The misfeed sample logic block 1043, shown in FIG. 11 and FIG. 12B contains a latch 1044 which is set by a $\overline{\text{PRINT}}$ signal to the DS input of the latch, when the machine is out of print. After the machine goes into print the latch 1044 is reset by the PRINT signal applied to the R input and a rate of paper feed signal, derived from clock 502 is clocked into the C input of the latch. At the completion of the paper feed from either paper tray 54 or 55 by a signal to the D input of the latch, the Q latch output changes from low to high. The signal from latch 1044 activates the misfeed memory latch 1046 to check the misfeed paper switches 200 or 202.

When latch 1046 of misfeed memory 1022 checks whether the misfeed paper switches are actuated, it is sampling the state of relay $R_{11}$. When sampled, either the main or auxiliary misfeed switch 200 or 202 should be actuated, indicating the feeding of paper. If they are not, a misfeed is signalled by the output Q of latch 1046 going high. The high signal is applied through an inverter 1050 and provides a $\overline{\text{MISFEED}}$ or low logic signal to the processor-shutdown circuit 768 (FIG. 9) indicating improper feeding of paper from within the main or auxiliary trays.

The latch 1046 provides a high signal along line 1052 indicating a misfeed, and is gated with a LIGHT CHECK PAPER indicating that the reset for the misfeed is not operational. The resultant high signal lights the check paper lamp 1054.

The misfeed memory 1022 is reset by a misfeed clear signal from the misfeed reset logic block 1056. This signal is generated by various actions, including clearing the programmer; clearing special features (which effectively selects the main tray 54 if the auxiliary tray 55 was being used); selecting the auxiliary tray; or simply pushing the print button 320 after the machine has stopped running. These are all logical actions which the operator might perform, and which will overcome a misfeed. The logic assumes that the situation which caused the misfeed will be self-cleared or cleared by the operator before the next time the print button is pushed. All of these functions are fed into the OR gate 1058, and gated with a jam relay set signal indicating no other jams by AND gate 1060. The signal from gate 1016 resets the latch 1046 and clears the misfeed.

J. Paper Jam

The paper jam logic block 994 generates a logic signal whenever a misfeed, timed jam, or immediate jam is detected, causing a misfeed cycle out. As shown in FIG. 12B, the paper jam logic includes OR gate 1062 which responds to the TIMED JAM, IMMED JAM and MISFEED logic signals to generate a PAPER JAM logic signal. The PAPER JAM signal is gated in an OR gate 1064 with a $\overline{\text{PRINT}}$ signal to provide the MISFEED CYCLE OUT signal which is utilized in conjunction with the logic of FIG. 7B. It will be recalled that that MISFEED CYCLE OUT signal forces certain actions which permit an orderly system cycle down with minimum process impact. The processor has flashed three images before a sheet of paper is fed. If a misfeed occurs there will be no paper upon which to transfer the image and a paper transport jam would be detected. To limit the image transfer and cleaning problems, misfeed cycle out turns of the developer motor M-1 and turns on the pitch fadeout lamp 546. Shift register stages Q5, Q6 and Q7 are cleared, resulting in removing the knowledge of the flashes and therefore the potential jam cconditons from the system. These actions also cause the machine to stop trying to feed paper and start a normal cycle down. At the next timed count such as 208, the bias voltage to transfer roll 52 will be turned of to minimize toner transfer to roll 52 from the belt 37. Also, if sorter 26 is being used the misfeed cycle out resets three bits in the output module counting system (not shown) shift register to correct the last sheet tracking logic.

In the event of a timed or immediate jam the misfeed cycle out is utilized to turn off the aforementioned process functions while allowing the print lockout block to determine the timing of the machine stop.

K. Jam Indicator Latches

One final element in the jam system logic includes the jam indicator latches block 1070, shown in FIG. 11. The function of the indicator latches 1070 is to provide a visible indication of the location of a jam. Since any jam is sensed by a respective switch, i.e. switches 208, 210, etc., which activate a relay associated therewith, i.e. R2, R3, etc., FIG. 12A, it is evident that by providing a latch for each jam relay, $R_1$, $R_2$, $R_3$, etc. the triggering of a jam relay can be further employed to set a latch in the logic 1070. A latch in logic 1070, once set, may then be sampled by logic 932 (FIG. 12A), and thereby light appropriate lamps.

By providing a pictorial representation of the processing path, and incorporating the lamps at corresponding points in that path, the location of a jam may be easily shown. The pictorial representation can be provided on the inner cover of the upper portion of the processor. When a jam condition occurs, it is only necessary for the operator to raise the cover and observe the location of the jam by noting the location of the lighted lamp on the pictorial representation.

Correction of the jam condition will extinguish the lighted lamp.

XII. Programmer

Referring to FIG. 9, the processor shutdown logic block 768 utilizes signals from the ADH, 18, sorter 26 misfeed logic 1022 and programmer 400 for initiating a normal processor shutdown through logic block 758. Before discussing this block in detail, the programming mechanism will be discussed.

As shown in FIG. 13, data from the keyboard 322 of console 12 is entered into the data load block 1102 which in turn loads the copy select register 1104 with a number corresponding to the number of copies desired. By way of example, a three digit keyboard entry system is employed. The data load block loads the first digit as a units digit. The second digit shifts the first to the tens position and assumes a unit position, and the third shifts both first and second digits to the hundreds and tens positions respectively. The copy select register is provided with internal lockout to prevent an excess of digits from being entered. It will be understood however, that the programmer is capable of additional or less capacity and that three digits is merely exemplary.

The data load block places the data into the copy select register 1104 for storage while the processor continues in operation.

The programmer further includes a copy count register 1106, and a copy delivered register 1108.

In operation, each flashed image is counted in the copy count register by pulsing the FLASHING line 1110. This signal is derived from the flash trigger 464, FIG. 7A. Each time a copy is delivered to an appropriate output point, i. e. the face up tray 24 (FIG. 1) or the sorter 26 (FIG. 1), a delivered increment count DEL INC on the line 1112. When the count in the copy count register 1106 is equal to the count set in the copy select register 1104, an output pulse FLASH COINC is provided through gate 1116 along line 1118. When the count in the delivered count register 1108 is equal to the count set in the copy select register, an output pulse DEL COINC is provided through gate 1120 along line 1122.

Should a hold condition be created as a result of the processor going out of print resulting in turn from a jam, operator depressing STOP button 318 (FIG. 5) or other cause, a HOLD signal is applied along line 1124 to the gate 1126 and effects a transfer of the count from register 1108 to 1106, thereby undating the count in register 1106, and automatically allowing the processor to remake copies lost as a result of the jam. It will be understood that the nature of the process is such that the copy count register 1108 will always lead the copy delivered register. The use of the HOLD signal triggers the transfer of the count from regiter 1108 to register 1106. The flash coincidence signal and delivered coincidence signal each act to reset the respective counter. Specifically, the flash coincidence signal will reset the copy count register, and the delivered coincidence signal will reset the copy delivered register. The reset lines are not shown for ease of illustration.

The hold signal is provided by means of a latch 1128, which is set by the processor going out of print when the job is incomplete or the system is running. The output JOB INCOMPLETE is a function of the output module programming and will depend on the number of copies desired versus the number achieved at hold. The SYSTEM RUNNING function has been described in conjunction with FIG. 12B. These two signals are ORed in gate 1130, and gated with $\overline{\text{PRINT}}$ in AND gate 1132.

The programmer is also designed to operate with sorter 26 module employed, where repeat sets of documents are to be sorted. For example, for 100 copies of each of 5 originals, and with a 25 copy bin capacity sorter, the first 25 copies into the sorter 26 signals an output FLASH COINCIDENCE signal which in turn provides a LOAD COPY COUNT LDCC signal to the programmer. The sorter includes a counter for comparing the bin capacity with the actual number delivered. When the bin capacity is achieved the sorter indicates same with a logic signal indicating an output delivered coincidence.

The programmer includes a temporary storage register 1134 coupled to an AND gate 1136 and which will transfer the contents of the register 1134 to the register 1106 upon opening of the gate 1136 by the LDCC signal.

After completion of the first 25 copy run, representing the bin capacity of sorter, the LDCC signal is provided from the sorter 26 to the gate 1136, transferring the count in register 1134 to the copy count register 1106. For the initial run, the count in register 1134 will be zero. Thus, the copy count registers counts from 0 to 25, and immediately upon achieving a count of 25 is reset to 0 by the transfer of the zero from the temporary storage register by the LDCC signal. This cycle is repeated for each original sequentially, as the ADH module 18 brings each original up to the platen for flash.

Upon completion of the cycle, that is upon the 25th copy of the 5th original, the LDTS signal is generated from a coincidence of the output FLASH COINCIDENCE signal and the absence of an INPUT CONTINUE IN PRINT signal. As stated before, the output FLASH COINCIDENCE signal represents the sorter bin count capacity, in the example herein, a 25 copy count. Referring to FIG. 14, the INPUT CONTINUE IN PRINT signal is derived from the ADH module and continues until each original has been flashed. The ADH 18 also includes means for providing a signal indicating a run is in progress and not complete in accordance with the number of originals still present under the bail bar 266 (FIG. 2). When the last original is flashed, the signal representing an INPUT CONTINUE IN PRINT goes down. The coincidence of these two signals, shown schematically in FIG. 14, provides a transfer signal LDTS to the gate 1138.

In response to this signal, the count in the copy count register 1106 is transferred to the temporary storage register 1134. The temporary storage register 1134 now stores a count signifying all originals have been run of the initial output cpacity. Now the cycle repeats. Assuming a module portion is available in the sorter i.e. the upper module portion the copy counter will again cycle through a run, counting this time from twenty five to fifty for each of the originals to be flashed, in accordance with the INPUT CONTINUE IN PRINT signal from the ADH. That is to say, the copy count register counts from 25 to 50, and at 50 a LDCC signal is provided, transferring the 25 count from the temporary storage register 1134 to the copy count register 1106, and the cycle repeats until the last original is flashed. The ADH 18 then again provides a low condition input continue in print, causing the LDTS signal at gate 1138 to transfer the 50 count from the copy count register 1106 to the temporary storage register 1134. The cycle then repeats from 50 – 75, and from 75 – 100, as sorter module portions are or become available, until the 100th copy of the last original is delivered.

At this same time, when the copy delivered count coincides with the output delivered coincidence, a LDCD signal is applied to the gate 1140, transferring the temporary storage register 1134 count to the copy delivered register 1108. The copy delivered count thus lags the copy count accurately though the count shifts. This latter aspect permits the job recovery function to be performed by allowing the reset of the copy count register to begin recounting after a jam or other hold situation without loss of position. This area is discussed in greater detail in the aforementioned copending U.S. application Ser. No. 312,411, filed Dec. 5, 1972 now Pat. No. 3,944,794 issued Mar. 16, 1976, and incorporated herein by reference.

The display function is shown in FIG. 13. The display unit 1142 is any convenient form of conversion device for converting binary coded decimal signals to a suitable display form, such as a seven segment luminous display, an LED display, or any otherform, for display on the panel area 324 of the panel 12 (FIG. 5).

The display logic includes an OR gate 1144 receiving both HOLD and SYSTEM RUNNING signals, providing a high output for either of those conditions to the dual AND gates 1146 and 1148. The AND gate 1146 includes an inverted input position. When HOLD or SYSTEM RUNNING are high, the gate 1148 is enabled and the count in the copy register 1106 is displayed. This is a display of the job in progress count. If neither SYSTEM RUNNING nor HOLD is high, the gate 1146 is enabled, and the count in the copy select register 1104 is displayed. In addition, should recall of the copy select count be desired while the SYSTEM RUNNING or HOLD conditions exist, the recall button 328 (see FIG. 5) is pressed, enabling gate 1150, for display.

The registers 1104, 1106, 1108 and 1134 are preferably recirculating shift registers of conventional variety. It will be understood that the data transfer operations are conventionally effected by gating the entire contents of the transmitting register, as it recirculates along a feedback path, into the input of the receiving register under the control of a shift signal. The register contents may be synchronized by means of a flag bit which is inserted by means of a flag bit register (not shown) in accordance with the entry of new data into the transmitting register. Obviously, other forms of transferring data in accordance with the gating scheme will be apparent to those skilled in the art.

The FLASH COINC logic signal on line 1118 is used to trigger a processor normal shutdown, unless inhibited, as explained in further detail with reference to FIG. 14. The DEL COINC logic signal on line 1122 is employed in the billing logic system for counting actually delivered copy sheets for billing, discussed further with reference to FIG. 15, and for signalling the end of a job.

XIII. Processor Normal Shutdown

Regarding the process control sequences, and referring to FIG. 9, logic block 768 effects normal processor shutdown in accordance with the signals received from the ADH electronics 312, the sorter electronics module 314 (See FIG. 4), the misfeed logic 1022 and the programmer 400.

Referring to FIG. 14, the ADH and output relationship to the logic implementation of the processor normal shutdown is shown. The ADH electronics 312 provides a plurality of output signals. The $\overline{\text{INPUT READY}}$ signal, when logically low, indicates the ADH is on and operative. When high, a not ready condition will be generated. This signal is fed to the READY logic block 800, FIG. 9, along line 810. The INPUT JAM signal, when high, indicates a jam condition in the ADH. This signal is provided along line 846 to the logic block 842, FIG. 9.

The $\overline{\text{INPUT CONTINUE IN PRINT}}$ signal is derived from the ADH 312 and fed to the processor shut down logic block 768. The $\overline{\text{INPUT CONTINUE IN PRINT}}$ signal is a function of the number or originals placed in the ADH unit. As long as there are originals which have not yet been moved up to the platen of the ADH 18, FIG. 2, the $\overline{\text{INPUT CONTINUE IN PRINT}}$ signal will remain a logically low signal. When all of the originals have been removed from the area beneath the bail bar 260 in the ADH unit, the $\overline{\text{INPUT CONTINUE IN PRINT}}$ signal will go high. This signal, applied along the line 1200 to the logic block 768 acts as an inhibit as will be described in further detail below.

The next signal from the ADH electronics 312 is the ADH interlock. The ADH interlock signal is the signal determining opening of any of the interlocks critical to the continued operation, in a safe manner, of the processor 14. The opening of an interlock such as a panel cover or the like would result in a high signal being applied along the ADH interlock to the input interlock line of the logic block 771, FIG. 9. This causes the interlock lamp 773 to light, as well as creating a call key operator condition, a not ready condition, and ultimately, print mode reset.

The next signal provided by the ADH is the input ready for flash. The input ready for flash signal is logically high when the document has been removed from its area beneath the bail bar 260 and correctly positioned on the platen for flash. At this point, the input ready for flash signal is provided to the logic gate 532, FIG. *7a*, for loading the stage Q5 of the shift register 512 for activating the flash trigger 534 and providing the flash increment signal therefrom.

The ADH sets delivered signal is an indication from the ADH 18 acknowledging the complete delivery of all originals in a set, and an output delivered coincidence. The purpose of the ADH sets delivered signal is to reset the billing counters as will be described in conjunction with FIG. 15 relating to billing.

Turning now to the collator/stack sorter electronics 314, a similar set of output signals is provided. First, the output provides an output ready signal indicating that the sorter is in proper position and configuration for operation. This is indicated by the provision of the output ready signals from the output along the line 808 of the ready logic block 800, FIG. 9. Again, the indication of a high level on the sorter ready line indicates that the output is ready.

The electronics 314 additionally provides an output jam signal. As in the case with the input jam signal, the output jam signal is generated when one of the jam sensing devices within the sorter 26 indicates improper operation. The presence of an output jam signal is placed along the line 848 in the logic block 842, FIG. 9, indicating a system jam.

The electronics 314 provides an output interlock signal corresponding to the ADH interlock signal. The output interlock signal is placed along the output line to the logic block 770.

The flash coincidence signal, described in conjunction with FIG. 13, is a function of the capacity of the bin capability of the sorter. Thus, should the sorter contain 25 bins in each module, an output flash coincidence signal will be provided when each of the bins has received one copy when run in the limitless sort mode discussed above. The output flash coincidence signal is also supplied to the processor shut down logic 768 along the line 1202.

The electronics 314 also supplies an OUTPUT MOD AVAILABLE signal to the processor shutdown logic block 768 along the line 1204. A low signal indicates that another module is available in the sorter for continuing the limitless sort operation.

Turning now to the details of the logic block 768, shown in FIG. 14, processor shut down is accomplished by the introduction of a programmer flash coincidence signal or an output flash coincidence signal to the OR gate 1206. The programmer flash coincidence signal introduced along the line 1118 devices from the corresponding line in the programmer disclosed and described in FIG. 13. Either of these signals will pass the OR gate 1206 and be introduced to the AND gate 1208. If no output module is available, a high signal will be applied along the line 1204. In addition, if all of the originals have been delivered to the platen by the ADH, the INPUT CONTINUE IN PRINT signal supplied along the line 1200 will also be high. Finally, the last input to the AND gate 1208 is derived through an inverter 1210 from a normally low input. The normally low input will provide a normally high input to the AND gate 1208. Under these conditions, the AND gate 1208 will pass the signal through the OR gate 1212, thereby providing an output along the processor shut down line 1214. The output of the processor shut down along line 1214 is supplied as the third input to the print mode reset logic 758, shown in FIG. 9. The output of the OR gate 1206 will be inhibited however under various conditions. Thus, if all of the originals have not been delivered, a low signal will be applied along the line 1200 blocking the operation of the AND gate 1208. Additionally, if an output module is or becomes available, the high signal along the line 1204 will become low and inhibit the operation of the AND gate 1208. Finally, the use of the gated print switch button 320 on the control panel may be employed to repeat the entire cycle. Activation of the gated print switch 320 will cause the bail bar 260 in the ADH 18 to flip, thereby raising the input continue in print signal along the line 1200. If the processor is still in print mode, a function which will depend on the amount of time that has passed since the processor shut down began, the cycle will repeat. The repeating cycle occurs when a coincidence of the gated print switch signal and the print mode signal through the AND gate 1216 place a high condition along the line 1218, in turn causing the ADH bail 260 to flip and the input continue in print signal to go high. Since the gated print switch interval is short, the pulse immediately drops and the inverter 1210 again places a high input at the input to the AND gate 1208 thereby removing the inhibits. It will be noted that the print signal will stay high only for a very short period of time after flash coincidence, the period of time being determined by the rate at which the shift signals progress through the shift register, thereby allowing processed copy sheets to clear the processor.

Further, if the ADH 8 is in its single feed mode, the input continue in print signal will not be employed as an inhibit to the gate 1208. In addition, the output will react to the single feed mode for making full output capacity including upper and lower modules available. The shut down operation will occur at output flash coincidence when no output module available signal is applied as a high along the line 1204.

In the manual mode, the ADH 18 will run originals up to its capacity.

When the sorter is in a stacking mode, the bins 128 merely increment automatically as each is filled to its respective capacity. Processor shut down again occurs only when the output module availability signal indicates that no additional space remains, thereby setting line 1204 high.

The internal operation of the sorter utilizes a counter sequence chain similar to that described in the programmer. The number of copies flashed and delivered are stored in first and second registers respectively. Further detail of the output module mechanisms will be found in the aforementioned copending U.S. application Ser. No. 312,411, filed Dec. 5, 1972, now U.S. Pat. No. 3,944,794, issued Mar. 16, 1976.

XIV. Billing

As was noted in FIG. 6, a billing control 402 is provided in conjunction with the programmer. Referring to FIG. 15, the billing control system is illustrated.

When a copy is delivered past the switch 220 (FIG. 1*b*) to the output device, such as the sorter 26 or the face up tray 24, an exit pulse is delivered through the latch 1300, shaped by the incrementing pulse unit 1302, sent to the programmer as the delivered increment and through the output electronics for timing purposes. The resultant signal is designated the output delivered coincidence signal to an OR gate 1304, where it is gated with the programmer delivered coincidence signal provided along line 1122 from the programmer 400, and provides an original complete signal. This signal is coupled to the ADH module electronics 312 wherein it increments a first ADH counter 1306 for comparison to the total number of originals stored in counter 1308 set in the ADH by the operator. If the counter 1306 compares in comparator 1310, equally with counter 1308, the ADH electronics sends out an ADH sets delivered signal. This means all originals in a set are complete. It is noted that the ADH counter units may operate in the same manner as the counter systems in the programmer, using data entered from the keyboard, and transferring counts to keep pace with the delivered copies.

The ADH sets delivered signal is gated with a signal indicating programer delivered coincidence in AND gate 1312, which provides an end of job signal, employed to reset the billing counters as set forth below.

The delivered increment signal from unit 1302 is used to increment a first counter 1314.

The billing system is based upon a set of counters incremented by delivered copies and employed to control break point comparators to adjust the billing schedules in accordance with the number of originals as well as the numbers of copies of a copy run. Using the system concepts set forth above, and by way of example, the counters are designed to respond to sets of 25, the exemplary number of bins employed in each sorter module. The number may obviously vary in accordance with the desired use, the number here intended as exemplary only.

The set of counters thus described includes first counter 1314, incremented by the delivered increment pulse from the incrementing pulse unit 1302. A second counter 1316 is coupled to the first counter and is set to operate as a block counter. The second counter is incremented by blocks of counts from counter 1314. For example, using the 25 count capacity, the counter 1314 can be a modulo 25 counter, resetting at each 25 counts and providing one count for each 25 counts to the counter 1316. The counter 1316 will only respond to completion of a block of original sets, however, before being incremented by one, since the billing system is designed to respond to copies of originals and the number of times a set of originals is run. Thus, an gate 1350 respond to a coincidence of signals from the sorter delivered increment line, the 25 count signal from the counter 1314, and the ADH sets delivered signal from the comparator 1310, for incrementing the counter 1316. Thus, the counter 1314 will count delivered papers in each block at a repeating rate, e.g. 0 – 25, 0 – 25 etc., until the ADH indicates that all its' originals have been copied. At that time, the counter 1316 will advance one increment, indicating that a second block run will be performed. This can be repeated as often as required until the end of a job. The end of a job is signalled from gate 1312, and the signal from gate 1312 applied to the counters 1314 and 1316 as a reset signal.

Each counter is coupled to a break point coupled comparator (BP) 1318, 1320. The break point comparator 1318 is coupled to a billing meter 1322, and the comparator 1320 to a billing meter 1324.

The system is designed to provide volume billing in accordance with any preset combinations of factors. For examples, each copy of a run can be billed at a first rate up to 25 copies per original, at a second rate between 0 copies and 700 copies per original, and so on. By setting the break point comparator 1318 to provide a signal to the billing meter 1322 in accordance with the number of copies made in a single run, a billing rate can be set. Since the system is designed to copy multiple originals, a second break point 1320 comparator can respond to the number of originals run. Thus, for each original in the ADH, the counter 1316 is incremented by one.

The billing counters are thus designed to run in repeating sets of 25 when the sorter 26 is in limitless mode, that is filling its respective modules repeatedly until the programmed count is complete, or until machine capacity is met, etc. As an alternate mode, the output can be programmed to stack copies of an original or originals rather than collate.

In the stack mode, a function equivalent to the processor operating alone delivering copies to the face-up tray, the counting system counts as one sequential counting chain. The delivered increment is provided to the first counter 1314 which counts up to its count capacity, such as 25. At a count of 25, the pulse delivered from counter 1314 is applied to the AND gate 1326. If sorter 26 is not present, or is in stack mode, a high signal will allow the pulse from counter 1314 to be delivered to the counter 1316, indicating that the counter 1314 is now counting in its next following group, 26–50. The billing system operates by comparing, in comparators 1318 and 1320, each respective count level in each counter with preset billing rates, and incrementing a billing meter under the control of the sheet exit signal. Thus, if the comparator 1318 is set at 20, the billing meter 1322 will indicate a first rate up to 20, and when counter 1314 crosses 20, the first comparator 1318 will stop the billing meter 1322 from counting.

When the counter 1316 is incremented to 1, the AND gate 1330 become blocked, preventing the first break point comparator 1318 from further enabling the billing meter 1322. The break point comparator 1320, depending upon its setting, will indicate the continuance of the copy run for counts 26–50, and so on, up to its break point setting. Obviously, other break points may be employed, and the rates established accordingly.

A further billing meter 1336 is also provided for indicating one copy. This occurs by a coincidence of a count = 0 signal from counters 1314 and 1316 along with the sheet at exit signal through AND gate 1334. This enables a special billing rate to be set for a one copy run, in addition to the billing rates set for the counting meters 1324 and 1326.

Finally, the billing meter 1338 can be directly coupled to the sheet of exit line for providing a total cumulative copy count.

When the limitless sorter mode is employed, a different counting scheme is used. In this mode, an original document is copies up to the count capacity of the sorter bins, in this case the example given is 25. Thus, the first original will provide a 25 copy run and the ADH will position a second original for the next 25 copy run. The cycle repeats for each original until all of the originals complete. If the number of copies per original is still deficient, the cycle repeats until all originals have been reproduced to the total desired number of copies. It is obviously necessary, for billing purposes, to have the billing counters follow this procedure accurately.

This operation is indicated by a high condition out of inverter 1340 at (SORTER OFF + STACK MODE), applied as an input to both AND gates 1342 and 1344. The JK flip-flop 1346 acts as an up/down mode control. In the initial condition, the flip-flop 1346 is in the up mode, thereby inhibiting AND gate 1342, and applying a high signal to the AND gate 1344. As a further input to gate 1342, the counter 1314 provides a high signal at the 25 count. The last input to gate 1344 represents the complement of either the output delivered coincidence or the programmed delivered coincidence. Since the multiple original mode is being used, the output will only collect 25 copies per original. In this mode, it is desired to maintain the flip-flop 1346 in its up mode such that each ADH sets delivered signal will result in incrementing the second counter 1316 thereby enabling it to properly track the limitless collate operation. Since the count line from counter 1314 is high only at the 25 count, the gate 1344 is inhibited in this mode and the flip flop 1346 will remain in its up mode.

The counter 1314 then repeats its 25 count operation until all originals in a set have been copied. At this point, the ADH sets delivered signal is applied along the line 1348 to the gate 1350 and applies an increment pulse to counter 1316. Since counter 1316 is in its up mode, maintained by the high signal from the Q-mode of the flip flop 1346 to the U input of the counter 1316, the counter 1316 increments up. The condition of the flip flop 1346 is reinforced by the ADH sets delivered signal applied to the clear input of the flip flop.

In the single feed mode, the original complete gating signal will not appear at the 25 count point, since in this mode it is desirable that 50 copies be provided at one time. Failure of the output delivered signal at the 25 count will thus apply a high signal along the original complete gating line to gate 1344, thereby passing the 25 count pulse from the counter 1314 to the clock input of the flip flop 1346. At the same time, the 25 count output of the counter 1314 is applied to the JK input of the flip flop 1346, setting flip flop 1346 to its down mode condition, indicated by a high signal from the Q output thereof. In synchronism with the flip flop 1346 changing state, the gating signal from gate 1344 passes through gate 1350 and increments the counter 1316 in its up direction. The counter 1314 now repeats its input from 0 to 25, but with the counter 1316 in a one condition, indicating to the billing comparators that the count is now proceeding for the next 25 copies.

At 50 copies, the second 25 sorter delivered increment pulse now appears as low signal at the original complete gating line to gate 1344. In the meantime, flip flop 1346 has changed states, applying an enable signal to gate 1342 and an inhibit to gate 1344. The low signal pulse at the original complete gating line is inverted to an high, through inverter 1352, and passes the gate 1342 to the clock input of the flip flop 1346 and through the gate 1350 to increment the counter 1316 in accordance with the high state at the D input thereof. The flip flop 1346, synchronously, changes states. The counters 1314 and 1316 are now returned to their initial condition, and the billing has a recorded a 50 copy run. The cycle thus repeats for each original unitl the last original is readied. At the end of the run for the last original, with flip flop 1346 in its set position (down mode) and with gate 1342 enabled as described above, the ADH sets delivered signal will appear along line 1348. At the same moment, the inverted output delivered coincidence signal appears along the original complete gating line. The ADH sets delivered signal however, will reset the flip flop 1346 directly, not in synchronism, thereby changing the flip flop 1346 state and setting, counter 1316 in its up condition. The ADH sets delivered signal also passes through the gate 1350, but in this instance the counter 1316 will already have been placed in its up increment condition by the direct set of flip flop 1346. Thus, the counter 1316 will up increment. As a result, the combination of the counters 1314 and 1316 show a total count of 50, and the next cycle begins at 51.

The operator can now be repeated for the next block or originals. It will be evident that either single feed mode, or multiple feed mode, allowing the output to indicate whether a 25 or 50 count mode will be employed.

The breakpoint counting system utilizable with the present invention is disclosed in copending application Ser. No. 343,067, filed Mar. 20, 1973, and assigned to the assignee of the present invention, the disclosures of which is specifically incorporated herein by reference.

To insure proper counting in the event of a malfunction, a jam inhibit circuit 1360 is provided. The jam inhibit circuit serves to insure against overcounting or undercounting during a system malfunction. This is a particularly valuable control in view of the shutdown features evident in the jam controls of the present system wherein the process enters a shutdown sequence of varying speed in accordance with the nature of the jam condition.

The logic 1360 includes an OR gate 1362 having applied thereto the various jam condition signals described above. Thus, a paper jam signal is applied along line 1364 from the logic of FIG. 12B, a sorter jam signal along the line 1366 from sorter 26, and an input jam signal from the ADH module 18. These signals, also discussed in connection with FIG. 9, are derived from their appropriate units in accordance with the state of the respective jam condition switches.

As was described hereinabove, the output increment signal is keyed upon the delivery of a copy through the sorter of the processor, either to the output module or to the face-up tray. It is important insofar as billing is concerned to ascertain that under or over counting does not result after a jam shutdown. To this end, the jam inhibit logic 1360 utilizes the jam signals provided through the OR gate 1362 to set the RS flip flop 1370 to provide a jam inhibit to the increment latch 1300.

The increment latch 1300 operates by incrementing the flip flop 1372 in accordance with each copy delivered as described above. The output increment signal is supplied through the AND gate 1374 to set the flip flop 1372 with each copy delivered at the output of the processor. The output increment signal, in the logic configuration, shown for logic 1300, is a high signal. The low signal resets the flip flop 1372 through inverter 1376. When a jam inhibit signal appears, as a result of a jam condition setting the flip flop 1370, the resulting low condition on the $\overline{Q}$ output of the flip flop 1370 inhibits the gate 1374, blocking the output increment pulse and inhibiting the flip flop 1372. The increment is designed to occur on the trailing edge of the copy sheet. Thus, if a sheet arrives at the increment sensor switch, and a jam occurs, the inhibit prevents the shutdown from causing the flip flop 1372 to be set to increment. When the process is reactivated and the jam inhibit removed, indicated by applying a SYSTEM RUNNING signal to reset the flip flop 1370, the trailing edge of the copy sheet will generate the output increment signal which will be passed by the now uninhibited gate.

As a further advantage of this logic, if the copy sheet on the sensor is removed from the system during the inoperative position of this cycle, the copys will never be counted at all. This is desirable since removal of the sheet, as by the operator, is taken as an inference of the undesirability of that sheet since the removal occurs after a jam condition has been signalled. Since the trailing edge sensing scheme is employed, removal of the sheet with the latch 1300 inhibited prevents a false count.

Thus, a logic scheme for maintaining the accuracy of copy count for billing purposes, as well as a count control scheme for billing flexibility in a high volume processor-duplicator, has been described.

XV. Summary

The foregoing description thus provides a system for controlling a process in accordance with a timing sequence established in accordance with the speed of the process. The timing is established by virtue of a copy paper registration which sets the pace for each process suboperation to be performed in providing copies of the highest quality and with maximum speed. The processor operates with a malfunction monitor which will halt the independent operation of the process should copy paper not follow the desired sequence path due to a failure of operation. It will be understood that the various machine operations controlled by the process control system as set forth herein are exemplary in terms of their combination and use, and that other quality and reproductive features may easily and obviously be incorporated into the process sequence. For example, multiple imaging may be employed, additional cleaning lamps provided to increase quality, margins shifted, copy size varied, and so on. The concept of sequential control easily lends itself to incorporation of further and additional sequences of subprocess operation. The use of timing control within each pitch timing sequence easily may be expanded to include such further operational control.

Program control has also been described for establishing numbers of copies from single or multiple originals. Sorter 26 can perform collating or sorting functions as well as stacking functions, while document handler 18 can permit single or multiple originals to be employed as the source. Control for interfacing these peripherals into the process control operation has also been set forth. It is understood that other peripherals may additionally be employed, and that these peripherals, as well as the ones described herein, can be used singly or in combination with the processor control using the concepts disclosed in the foregoing description.

Finally, accuracy of billing can be maintained with the malfunction shutdown features of the processor described herein by use of a logic inhibit control and with a flexible logic control for adapting to the programmed copy count quantity.

It will be understood while certain numerical descriptions have been employed to indicate numbers of copies in sequences, or capacities employed, or in conjunction with programmer logic, that such designations are intended solely as exemplary and not intended to be limiting in any sense. It will be obvious to those skilled in the art that the foregoing systems may employ differing count levels, capacities, and other such designations without departing from the spirit and scope of the present invention.

It will be further understood while certain types of logic control have been described, such as AND and OR gates, that other forms of logic such as NAND and NOR gates may be employed or substituted for all or a portion of the logic gating described herein without departing from the spirit and scope of the present invention. It will also be understood that while various logic circuits of the control system have been described in terms of discrete logic gates and elements such as AND and OR gates, and counters and latch circuits, part or all of the circuits may be rendered in MOS (Metal Oxide Semiconductor) or LSI (Large Scale Integrated) circuits without departing from the spirit and scope of the present invention. Other modifications, substitutions and variations of the elements employed and options disclosed may be additionally made without departing from the spirit and scope of the present invention.

What is claimed is:

1. In an automatic document processing system for reproducing one or more copies of an original document comprising in combination central process control means;

means for supplying said original document to be reproduced;

an output device for accumulating said copies; and a feed path for said copies, said feed path including a plurality of copy processing components for processing said copies, said process control means including electronic sequencing means progressable through a plurality of states, means for generating plural timed control signals within said states for actuating said copy processing components to produce said copies, means for monitoring the movement of copies along said feed path, said monitoring means including means effective on an unscheduled interruption in the movement of copies along said feed path to intervene and interrupt operation of said sequencing means whereby to stop processing of said copies, said sequencing means including a multi-stage shift register, gating means coupled to said multi-stage shift register for shifting signals there through in synchronism with the movement of copies along said feed path at a rate of one shift signal per copy, and means responsive to completion of processing of the last of said copies to terminate operation of said system.

2. The combination of claim 1 wherein said multi-stage shift register is divided into a plurality of groups of shift registers, each of said groups of shift registers controlling preselected ones of said copy processing components, and means responsive to each of said groups of shift registers for selectively disabling certain of said copy processing components in a predetermined sequence.

3. An automatic document processing system for reproducing one or more copies of original documents on copy material comprising:

process control means;

an original document handling means;

an output device for accumulating said copies, and a feed path for said copy material, said feed path including a plurality of stations operating upon said copy material for reproducing images of said original document thereon, said process control means including electronic sequencing means, said sequencing means having a plurality of states, means for subdividing said states into a plurality of defined timing signals for controlling operation of the processing components that comprise said stations to produce copies and means responsive to a malfunction in said feed path to intervene and stop processing of said copy material, said malfunction monitoring means including a plurality of switching means disposed for actuation along said feed path, means effective during preset ones of said states on predetermined timing signals for sampling said switching means individually for the improper presence or absence of a copy material along said feed path, said malfunction monitoring means being responsive to actuation of one of said switching means to interrupt said sequencing means and stop processing of said copy material.

4. The combination of claim 3 wherein said process control means includes cycle out means for bringing said processing system to a normal stop, said switching means including a first switch means effective upon actuation to stop processing of said copy material without delay, a second switch means effective upon actuation to stop processing of said copy material after a timed delay, and a third switch means effective upon actuation to trigger said cycle out means to bring said processing system to a normal stop.

5. The combination of claim 3 wherein said processor control means includes drive means for said shift register for shifting signals through said shift register in synchronism with the flow of said copy material along said feed path, print means for gating said signals into said shift register to produce said copies, and means responsive to actuation of one of said switching means for disabling said print means.

6. The combination of claim 5 wherein said processor control means includes means for monitoring the operating condition of at least one of said stations, said monitoring means generating a signal in response to said station being inoperative, and gating means responsive to said monitoring means signal for blocking enabling of said print means thereby inhibiting operation of said shift register.

7. The combination of claim 3 wherein said malfunction monitoring means includes memory means responsive to a jam condition for setting a jam condition state, reset means for resetting said memory means, and clearance means for preventing resetting of said memory means by said reset means until said jam condition has been cleared.

8. The combination of claim 7 further including means for bypassing said memory means to operate said processing system regardless of the setting of said memory means.

9. The combination of claim 3 wherein said feed path includes a transport portion and a fuser portion, said switching means including first switch means for monitoring a jam condition in said transport and second switch means for monitoring a jam condition in said fuser, said malfunction monitoring means including first latching means settable by said first switch means in response to a jam condition in said transport and second latching means settable by said second switch means in response to a jam condition in said fuser, said process control means including first control means responsive to setting of said first latching means for causing a timed shutdown of said processing system and second control means responsive to setting of said second latching means for shutting down said processing system without delay.

10. An automatic document processing system for reproducing one or more copies of original documents on copy material, comprising:

process control means;

an original document handling means;

an output device for accumulating said copies, and a feed path for said copy material to be processed, said feed path including a plurality of stations operating upon said copy material for reproducing images thereon, said process control means further including electronic sequencing means, said sequencing means including a plurality of stages, each of said stages controlling operations of at least one of said stations, means for generating a plurality of defined substage intervals during sequencing of said stages, said process control means including means for utilizing said intervals to produce timing signals to control precise operation of said at least one station, and wherein said processor control means includes means for monitoring a flow of copy material along said feed path, said monitoring means including means for interrupting the sequencing of said plurality of stages in response to a feed path malfunction, said document processing system including an imaging station, said sequencing means generating an image trigger signal activating said imaging station, said document processing system further including a programmer, said programmer including first means for counting said image trigger signals, second means for counting copies delivered to said output device, and means responsive to an interruption of said sequencing of said plurality of stages for transferring a count from said second counting means to said first counting means, said programmer further including a third counting means, and means for entering into said third counting means a number corresponding to a desired number of copies, said programmer including means for comparing a state of said first and said third counting means and means responsive to a coincidence between said states of said first and said third counting means for initiating a process shut down signal.

11. The combination of claim 10 wherein said programmer includes a temporary storage register, said temporary storage register including gating means responsive to an input device indicating additional originals to be reproduced, said gating means transferring the contents of said temporary storage register to said first counting means for repeating a reproduction operation.

12. The combination of claim 10 wherein said stages are comprised of a multi-stage shift register, said process control means further including means coupled to said shift register for shifting signals therethrough, said signal shifting means synchronized with the flow of each of said copies along said feed path at the rate of one shift per copy; print means gating a shift signal into said shift register stages for shifting; and means responsive to a completion of a reproduction process or a malfunction along said feed path for disabling said print means.

13. The combination of claim 11 further including means for providing a plurality of conditional inputs to said process control means, each of said conditional inputs representing a machine operating parameter, and gating means responsive to said conditional inputs for blocking an enabling of said print means, thereby inhibiting the operation of said shift register.

14. The combination of claim 11 wherein said multistage shift register is divided in a plurality of groups of shift registers, each of said groups of shift registers controlling selected portions of said operations at each of said stations, and wherein said process control means includes means responsive to each of said groups of shift registers for selectively disabling certain of said stations in a predetermined sequence.

15. The combination of claim 14 wherein said gating means includes a first output condition for applying major power to said processor, and a second output condition for enabling said print means, the combination further including means for monitoring processing system operation for emergency conditions, said gating means responsive to said means for disabling said first output and said second output conditions, and responsive to said conditional inputs for disabling said second output condition.

16. The combination of claim 15 further including means for monitoring the electronic switching level voltages employed by said gating means, said gating means further responsive to said voltage level monitoring means for disabling said first and second output conditions in event said voltage level falls below a minimum level.

17. An automatic document processing system for reproducing one or more copies of original documents on copy material, comprising: process control means; means for supplying an original document to be copies; an output device for accumulating said copy material with copies thereon, a feed path for processing said copies, and a plurality of stations operating upon said copy material for reproducing copies thereon, said process control means including an electronic sequencing means having a plurality of stages, each of said stages controlling operations at said stations, said sequencing means including means for generating a plurality of defined substage intervals associated with each stage, means utilizing timing signals associated with said substage intervals to control operation of said stations, said process control means including means for monitoring a flow of copies along said feed path, said flow monitoring means including means for interrupting a sequencing of said plurality of states in accordance with a feed-path malfunction, and feed sensing means responsive to one of said stages for sensing said copy material entering said feed path, said feed path sensing means providing a misfeed signal in the event of a misfeed condition of said copy material, said sequencing means including a first group of stages for controlling power to said stations and a second group of stages for activating said stations to produce copies, and means responsive to said misfeed signal for resetting said second group of stages thereby cancelling producing of copies upon detection of said misfeed condition.

18. The system of claim 17 wherein said feed path sensing means includes: a memory, means for setting said memory in response to said misfeed condition, and means for resetting said memory in response to an elimination of said misfeed condition.

19. An automatic document processing system for reproducing one or more copies of original documents on copy material comprising: process control means; means for supplying an original document for copying; an output device for accumulating said copies, a feed path for said copy material to be processed, and a plurality of stations operating upon said copies for reproducing images of said original documents thereon, said process control means including an electronic sequencing means having a plurality of stages, each of said stages controlling processing operations at said stations, means for generating a plurality of defined substage intervals associated with each of said stages, means utilizing said intervals to provide timing signals to control operations at said stations precisely, means for monitoring a flow of copy material along said feed path, said monitoring means interrupting said sequencing means in accordance with a feed path malfunction, billing means including counter means, latch means responsive to each copy processed for incrementing said counter means, and inhibit means responsive to a feed path malfunction for inhibiting operation of said latch means to prevent incrementing of said counter means, said inhibit means permitting operation of said latch means in response to removal of said feed path malfunction.

20. The system of claim 19 wherein said counter means includes at least two counters, a first of said counters counting copies of each original delivered, said first counter repeating for each subsequent original of a set, a second of said counters incrementing once for each original completed by said first counter.

21. The combination of claim 20 wherein said billing means includes a first break point comparator coupled to said first counter, a second break point comparator coupled to said second counter, a first billing meter coupled to each of said first and second point comparators for indicating a billing count reflecting the state of said first and second counters, and a second billing meter coupled to said second counter for indicating a billing count reflecting the counting range of said first counter.

22. An automatic document processing system for reproducing an original representation on copy material comprising: an image photoreceptor element; a processing station; means for driving said photoreceptor in a direction traversing said processing station, optical means for placing an image of said original representation on a surface area of said photoreceptor element; developing means for developing said image; feed means for feeding a copy surface of said copy material to said image area; transfer means for transferring said image to said copy surface; output means for receiving said imaged copy surface; sequencing control means, said sequencing control means including a plurality of stages; means for sequentially energizing said stages in accordance with each reproduction; means responsive to a condition of respective ones of said stages for enabling said optical means, said feed means and said transfer means; timing control means, said timing control means providing a series of subsequence timing signals for each of said stages; and switching means coupled to said sequencing control means and said timing control means, said switching means responsive to said respective enabling stages and to a predetermined timing control subsequence for energizing said optical means, feed means, development means and transfer means.

23. The system of claim 22 wherein a plurality of said images are placed on a successive plurality of areas of said photoreceptor surface, said feed means being energized after said plurality of images have been placed on said photoreceptor surface areas, said document processing system further including suppression means responsive to a condition signifying a non-feed of said copy material for suppressing those of said images placed but not transferred and resetting those of said stages activating said feed means.

24. The system of claim 23 wherein said developing means includes optical fade out means for defining peripheral areas of said images, said suppression means further enabling said optical fade out means to suppress further the undesired image areas.

25. The system of claim 22 wherein said developing means includes: dispensing means for dispensing particulate development material for electrostatographic development of said image areas in accordance with a variation of electrostatic potential levels corresponding to said images, said dispensing means being enabled and disabled by a one of said stages and activated by a subsequence during activation of said stage; means responsive to a signal provided in response to energization of said one stage prior to said subsequence for sampling said development material for sufficiency thereof; and means responsive to a low sufficiency of said development material to maintain dispensing means enabled for additinal stage time periods until sufficiency is achieved.

26. The system of claim 22 wherein said transfer means includes: a transfer roller movable between a first position out of contact with said photoreceptor and a second position in contact with said photoreceptor; transfer bias means including means for applying said transfer bias to said roller; switching means responsive to sequencing of a one of said stages and to a first subsequence during activation of said one stage for moving said roller from said first position into said second position, said switching means deactivated in response to a malfunction or normal shutdown of said system for moving said roller back into said first position.

27. The system of claim 26 wherein said transfer bias is applied subsequent to said transfer roll movement, said system including further switching means responsive to an activation signal for applying said potential to said roller, and means for enabling said activation signal subsequent to said first subsequence and disabling said activation signal prior to deactivation of said switching means.

28. The system of claim 27 further including means for activating said transfer bias means independently of said sequencing control means.

29. An automatic document processing system for reproducing originals on copy material, comprising: an image photoreceptor element movable along a processing path; optical means for placing an image of an original on said photoreceptor element; developing means for developing said image; feed means for feeding copy material to said image area; transfer means for transferring said image to said copy material; output means for receiving said image copy material; sequencing control means, said sequencing control means including a plurality of stages; means for sequentially energizing said stages in accordance with each reproduction; means responsive to a condition of associated ones of said stages for enabling said optical means, said feed means and said transfer means; timing control means, said timing control means providing a series of subsequence timing signals for each of said energized stages; switching means coupled to said sequencing control means and said timing control means and responsive to said associated enabling stages and to a predetermined timing control subsequence for energizing said respective optical means, feed means, development means, and transfer means; means for generating a signal in response to the presence of said copy material on said photoreceptor element downstream of said transfer means means for stripping said copy material from said photoreceptor element in response to said signal, a sheet sensor for detecting the presence of copy material on said photoreceptor element downstream of said stripping means, said switching means being responsive to said signal for sampling said sheet sensor and providing an indication in response to failure of said stripping means to strip said copy material surface from said photoreceptor.

30. An automatic document processing system for reproducing an original representation on copy material, comprising; a continuous elongated photoreceptor element; means for driving said photoreceptor in a direction along an elongated length, optical means for placing an image of said original on a surface area of said photoreceptor element; developing means for developing said image; feed means for feeding a copy material surface to said photoreceptor image area; tranfer means for transferring said image to said copy material surface; output means for receiving said image copy material surfae; sequencing control means, said sequencing control means including a plurality of stages; means for sequentially energizing said stages in accordance with each reproduction; means responsive to a condition of associated ones of said stages for enabling said optical means, said feed means and said transfer means; timing control means, said timing control means providing a series of timing signals for each of said energized stages; and switching means coupled to said sequencing control means and said timing control means and responsive to said associated enabling stages and to a predetermined timing control subsequence for energizing said respective optical means, feed means, development means and transfer means, wherein said optical means including flash means for flashing said image onto said copy material surface, trigger means for triggering said flash means, said trigger means responsive to an enabling signal from a one of said stages corresponding to arrival of said copy material surface at a position of said optical means on said photorecptor element, wherein, on a subsequent activation signal from said subsequent timing control means during energization of said one stage associated with said optical means, a timing of said subsequent timing control activation signal relative to said stage timing signals determining a margin location of said image relative to said copy material surface.

* * * * *

UNITED STATES PATENT OFFICE
CERTIFICATE OF CORRECTION

PATENT NO. : 4,054,380

DATED : October 18, 1977

INVENTOR(S) : James M. Donohue et al

It is certified that error appears in the above-identified patent and that said Letters Patent are hereby corrected as shown below:

In Claim 25, Column 67, line 12, change "additinal" to --additional--.

In Claim 29, Column 68, line 7, after "means" (first occurrence) insert -- ; --.

In Claim 29, Column 68, line 27, change "surfae" to --surface--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*